US012129145B2

(12) United States Patent
Shibasaki et al.

(10) Patent No.: US 12,129,145 B2
(45) Date of Patent: Oct. 29, 2024

(54) ENCLOSING APPARATUS AND IMAGE FORMING SYSTEM

(71) Applicants: Yuusuke Shibasaki, Tokyo (JP); Michitaka Suzuki, Kanagawa (JP); Shinji Asami, Tokyo (JP); Nobuyoshi Suzuki, Tokyo (JP); Takahiro Matsuda, Kanagawa (JP); Makoto Hidaka, Tokyo (JP); Kazuyoshi Matsuo, Miyagi (JP); Shingo Yoshizawa, Kanagawa (JP); Akira Kunieda, Tokyo (JP); Takahiro Watanabe, Kanagawa (JP); Takuya Morinaga, Tokyo (JP); Atsushi Shinoda, Kanagawa (JP)

(72) Inventors: Yuusuke Shibasaki, Tokyo (JP); Michitaka Suzuki, Kanagawa (JP); Shinji Asami, Tokyo (JP); Nobuyoshi Suzuki, Tokyo (JP); Takahiro Matsuda, Kanagawa (JP); Makoto Hidaka, Tokyo (JP); Kazuyoshi Matsuo, Miyagi (JP); Shingo Yoshizawa, Kanagawa (JP); Akira Kunieda, Tokyo (JP); Takahiro Watanabe, Kanagawa (JP); Takuya Morinaga, Tokyo (JP); Atsushi Shinoda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 260 days.

(21) Appl. No.: 17/742,878

(22) Filed: May 12, 2022

(65) Prior Publication Data

US 2022/0380168 A1 Dec. 1, 2022

(30) Foreign Application Priority Data

May 27, 2021 (JP) ..... 2021-089439
Mar. 22, 2022 (JP) ..... 2022-045798

(51) Int. Cl.
*B65H 45/04* (2006.01)
*B65H 45/16* (2006.01)
*B65H 45/26* (2006.01)

(52) U.S. Cl.
CPC ..... *B65H 45/04* (2013.01); *B65H 45/163* (2013.01); *B65H 45/167* (2013.01); *B65H 45/26* (2013.01);
(Continued)

(58) Field of Classification Search
CPC .... B65H 45/04; B65H 45/163; B65H 45/167; B65H 45/26; B65H 2801/06;
(Continued)

(56) References Cited

U.S. PATENT DOCUMENTS 1,803,051 A * 4/1931 Bouton ..... B43M 3/045 53/569
2,865,155 A * 12/1958 Nydegger ..... B43M 3/045 53/284.3

(Continued)

FOREIGN PATENT DOCUMENTS

JP 5-042903 2/1993
JP 7-061407 3/1995

*Primary Examiner* — Dariush Seif
(74) *Attorney, Agent, or Firm* — Harness, Dickey & Pierce, P.L.C.

(57) ABSTRACT

An enclosing apparatus for enclosing an enclosure into an envelope at an enclosing position includes a conveyance roller that conveys the envelope to the enclosing position and an envelope conveyance path through which the envelope is conveyed. An enclosing support is disposed in the envelope conveyance path and supports enclosing of the enclosure into the envelope. The enclosing support retracts a flap of the envelope from the envelope conveyance path while the conveyance roller conveys the envelope to the enclosing position.

14 Claims, 46 Drawing Sheets

(52) U.S. Cl.
CPC ..... *B65H 2801/06* (2013.01); *B65H 2801/66* (2013.01)

(58) Field of Classification Search
CPC ..... B65H 2801/66; B43M 3/00; B43M 3/02; B43M 3/04; B43M 3/045
USPC ..... 53/473, 569, 284.3, 381.5, 381.6, 381.7
See application file for complete search history.

(56) References Cited

U.S. PATENT DOCUMENTS 3,593,486 A * 7/1971 Helm ..... B65H 45/18 53/460
3,965,644 A * 6/1976 Stocker ..... B43M 3/045 53/284.3
4,077,181 A * 3/1978 Asher ..... B43M 3/045 53/284.3
4,337,609 A * 7/1982 Foster ..... B43M 3/045 53/284.3
4,499,705 A * 2/1985 Russell ..... B43M 3/00 53/284.3
4,674,258 A * 6/1987 Ehlscheid ..... B43M 3/045 53/284.3
4,813,209 A * 3/1989 Foster ..... B43M 3/045 53/284.3
4,852,334 A * 8/1989 Auerbach ..... B43M 3/045 53/284.3
5,156,585 A * 10/1992 Dimur ..... B43M 3/045 493/465
5,251,425 A * 10/1993 Kern ..... B43M 3/045 53/569
5,257,805 A * 11/1993 Belec ..... B43M 3/045 271/107
5,297,376 A * 3/1994 Taguchi ..... B65H 31/3027 53/284.3
5,301,935 A * 4/1994 Miki ..... B43M 5/042 53/284.3
5,388,388 A * 2/1995 Belec ..... B43M 3/045 53/53
5,410,860 A * 5/1995 Coudray ..... B43M 3/045 53/381.5
5,517,797 A * 5/1996 Ballard ..... B43M 3/045 53/64
5,552,691 A * 9/1996 Pierce ..... G05B 19/416 318/568.11
5,560,185 A * 10/1996 Petkovsek ..... B43M 5/042 53/284.3
5,618,375 A * 4/1997 Suzuki ..... B43M 5/042 53/284.3
5,630,312 A * 5/1997 Ballard ..... B43M 3/045 53/284.3
5,642,598 A * 7/1997 Cannaverde ..... B43M 3/045 53/284.3
5,651,238 A * 7/1997 Belec ..... B43M 3/045 53/284.3
5,660,030 A * 8/1997 Auerbach ..... B43M 3/045 53/284.3
5,692,364 A * 12/1997 Staniszewski ..... B43M 3/045 53/569
5,715,648 A * 2/1998 Yates ..... B43M 3/045 53/381.1
5,740,663 A * 4/1998 de Haan ..... B43M 3/045 53/284.3
5,802,808 A * 9/1998 Lyga ..... B43M 3/045 53/381.5
5,832,702 A * 11/1998 Jacobson ..... B43M 3/045 53/284.3
5,848,518 A * 12/1998 Bufalini ..... B43M 3/045 53/284.3
5,924,265 A * 7/1999 Auerbach ..... B43M 3/045 53/569
5,971,385 A * 10/1999 Belec ..... B43M 3/045 271/106
5,982,129 A * 11/1999 Belec ..... B43M 3/045 358/300
6,016,638 A * 1/2000 Bernard ..... B43M 5/042 53/284.3
6,036,185 A * 3/2000 Baumann ..... B43M 3/045 271/902
6,155,031 A * 12/2000 Ballestrazzi ..... B65H 39/043 53/381.5
6,164,043 A * 12/2000 Miller ..... B43M 3/045 53/381.6
6,199,348 B1 * 3/2001 Button ..... B65H 29/12 53/381.5
6,206,816 B1 * 3/2001 Cook ..... B43M 3/045 493/69
6,226,959 B1 * 5/2001 Krasuski ..... B43M 5/042 53/569
6,425,223 B1 * 7/2002 Miller ..... B43M 5/042 53/381.6
7,181,895 B1 * 2/2007 Rozenfeld ..... B43M 3/045 53/284.3
7,600,755 B1 * 10/2009 Rozenfeld ..... B43M 3/04 198/689.1
7,662,080 B2 * 2/2010 Kapturowski ..... B31F 1/10 493/403
8,281,919 B2 * 10/2012 Rozenfeld ..... B43M 3/045 271/259
2004/0035528 A1 * 2/2004 Brignell ..... B43M 5/042 156/441.5
2004/0089706 A1 * 5/2004 Hill ..... B65H 37/04 235/375
2004/0123571 A1 * 7/2004 Rozenfeld ..... B43M 3/045 53/569
2004/0211158 A1 * 10/2004 Miller ..... B43M 5/042 53/381.6
2004/0250517 A1 * 12/2004 Hsieh ..... B43M 3/045 53/284.3
2005/0034433 A1 * 2/2005 Gomez ..... B43M 3/045 53/569
2006/0042196 A1 * 3/2006 Stemmle ..... B65B 43/28 53/381.5
2006/0144016 A1 * 7/2006 Sytema ..... B43M 3/045 53/381.7
2006/0163793 A1 * 7/2006 Sytema ..... B43M 3/045 270/58.06
2006/0220307 A1 * 10/2006 Lyga ..... B65H 5/26 271/279
2006/0254223 A1 * 11/2006 Passoni ..... B43M 3/045 53/381.7
2007/0125045 A1 * 6/2007 Sytema ..... B43M 3/045 53/284.3
2007/0164497 A1 * 7/2007 Feijen ..... B43M 5/042 271/2
2009/0288373 A1 * 11/2009 Feijen ..... B43M 3/045 53/284.3
2010/0229504 A1 * 9/2010 Ten Donkelaar ..... B43M 3/045 53/284.3
2010/0313530 A1 * 12/2010 Smith ..... B43M 3/045 53/569
2011/0099946 A1 * 5/2011 Fijnvandraat ..... B43M 3/045 53/381.5
2011/0154778 A1 * 6/2011 Oshio ..... B65B 5/045 53/64
2011/0203230 A1 * 8/2011 Heemstra ..... B43M 3/045 53/235
2012/0192529 A1 * 8/2012 Sytema ..... B65H 39/043 53/469
2012/0322641 A1 * 12/2012 Matsushita ..... B65H 45/18 493/405
2013/0055686 A1 * 3/2013 Batzer ..... B65G 15/58 53/235
2013/0333333 A1 * 12/2013 Batzer ..... B43M 3/045 53/381.5
2014/0196414 A1 * 7/2014 Schempp ..... B43M 7/004 53/569

(56) References Cited

U.S. PATENT DOCUMENTS

| | | | | |
|---|---|---|---|---|
| 2016/0243883 | A1* | 8/2016 | DePoi | B43M 3/045 |
| 2017/0129274 | A1* | 5/2017 | Price-Stephens | B43M 3/04 |
| 2022/0380168 | A1* | 12/2022 | Shibasaki | B65H 45/04 |

* cited by examiner

ENCLOSING APPARATUS AND IMAGE FORMING SYSTEM

CROSS-REFERENCE TO RELATED APPLICATIONS

This patent application is based on and claims priority pursuant to 35 U.S.C. § 119(a) to Japanese Patent Application Nos. 2021-089439, filed on May 27, 2021, and 2022-045798, filed on Mar. 22, 2022, in the Japan Patent Office, the entire disclosure of each of which is hereby incorporated by reference herein.

BACKGROUND

Technical Field

Exemplary aspects of the present disclosure relate to an enclosing apparatus and an image forming system, and more particularly, to an enclosing apparatus and an image forming system incorporating the enclosing apparatus.

Discussion of the Background Art

Related-art enclosing apparatuses enclose an enclosure into an envelope automatically. Related-art image forming systems interlock an image forming apparatus with a folding apparatus and an enclosing-sealing apparatus. The image forming apparatus forms an image on a sheet to be enclosed into an envelope, for example. The folding apparatus folds the sheet formed with the image. The enclosing-sealing apparatus encloses the folded sheet formed with the image into the envelope.

SUMMARY

This specification describes below an improved enclosing apparatus. In one embodiment, the enclosing apparatus encloses an enclosure into an envelope at an enclosing position. The enclosing apparatus includes a conveyance roller that conveys the envelope to the enclosing position and an envelope conveyance path through which the envelope is conveyed. An enclosing support is disposed in the envelope conveyance path and supports enclosing of the enclosure into the envelope. The enclosing support retracts a flap of the envelope from the envelope conveyance path while the conveyance roller conveys the envelope to the enclosing position.

This specification further describes an improved image forming system. In one embodiment, the image forming system includes an image forming apparatus that forms an image on a medium and the enclosing apparatus described above that encloses the medium as an enclosure sent from the image forming apparatus into an envelope at an enclosing position.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
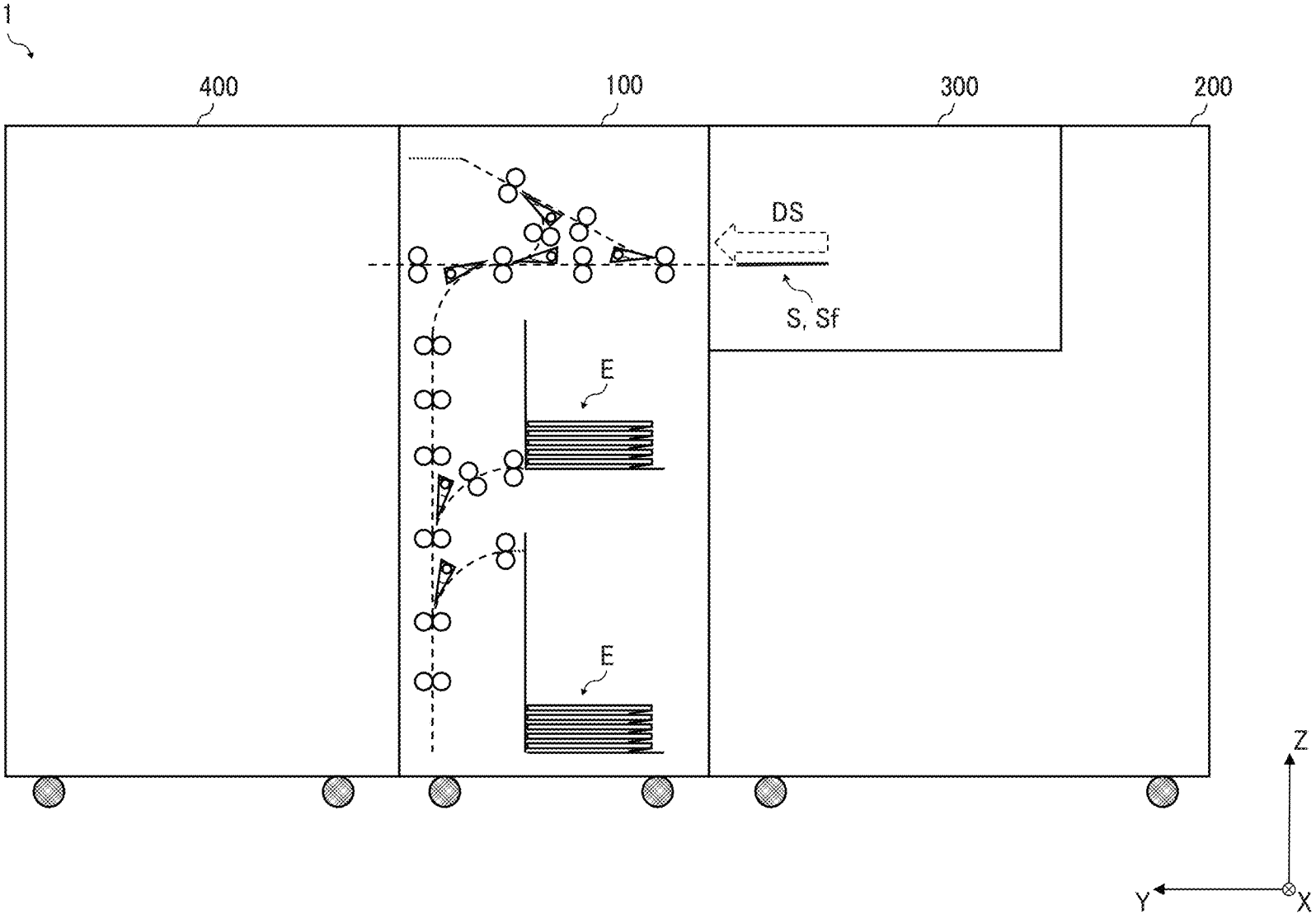
FIG. 1 is a front cross-sectional view of an image forming system according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

A description is provided of a construction of an image forming system according to an embodiment of the present disclosure.

FIG. 1 is a front cross-sectional view of a print system 1 as one example of the image forming system, schematically illustrating an interior construction thereof. The print system 1 includes an image forming apparatus 200, a folding apparatus 300 serving as a sheet processing apparatus, an enclosing-sealing apparatus 100 serving as an enclosing apparatus according to an embodiment of the present disclosure, and a post-processing apparatus 400.

The image forming apparatus 200 is one example of an apparatus that forms an image on a sheet S serving as a medium by a predetermined image forming method and ejects the sheet S into a downstream apparatus disposed downstream from the image forming apparatus 200 in a sheet conveyance direction DS. The medium bearing the image (hereinafter referred to as the sheet S) is ejected to the folding apparatus 300. The folding apparatus 300 performs predetermined folding on the sheet S to produce a folded sheet Sf and ejects the folded sheet Sf to the enclosing-sealing apparatus 100. Alternatively, the folding apparatus 300 may not fold the sheet S and may eject the sheet S to the enclosing-sealing apparatus 100. The image forming apparatus 200 includes a controller (e.g., a printer controller 260 described below with reference to FIG. 2) that outputs an instruction (e.g., a control signal) to fold or not to fold the sheet S to the image forming apparatus 200 or the folding apparatus 300 based on information input by a user of the print system 1. Alternatively, a folding controller 320 illustrated in FIG. 2, that is incorporated in the folding apparatus 300, may output the instruction to fold or not to fold the sheet S based on the information input by the user of the print system 1.

The enclosing-sealing apparatus 100 performs enclosing-sealing processing to enclose the folded sheet Sf serving as an enclosure into an envelope E and seal the envelope E. The enclosure is ejected by an upstream apparatus (e.g., the image forming apparatus 200 or the folding apparatus 300) disposed upstream from the enclosing-sealing apparatus 100 in the sheet conveyance direction DS in which the sheet S or the folded sheet Sf is conveyed into the enclosing-sealing apparatus 100. In the present disclosure, the enclosure defines a medium, an object, or the like that is conveyed to an enclosing position described below. Hence, in addition to the folded sheet Sf conveyed to the enclosing position, the enclosure also defines the sheet S that is not folded. Alternatively, the enclosing-sealing apparatus 100 may not convey the folded sheet Sf or the sheet S to the enclosing position and may eject the folded sheet Sf or the sheet S to the downstream apparatus disposed downstream from the enclosing-sealing apparatus 100 in the sheet conveyance direction DS. For example, the enclosing-sealing apparatus 100 may not perform the enclosing-sealing processing on the sheet S or the folded sheet Sf conveyed from the upstream apparatus disposed upstream from the enclosing-sealing apparatus 100 in the sheet conveyance direction DS and may eject the sheet S or the folded sheet Sf to the downstream apparatus disposed downstream from the enclosing-sealing apparatus 100 in the sheet conveyance direction DS.

The post-processing apparatus 400 is one example of the downstream apparatus disposed downstream from the folding apparatus 300 and the enclosing-sealing apparatus 100 in the sheet conveyance direction DS. The post-processing apparatus 400 performs post-processing, such as stapling, instructed via the controller on the sheet S or the folded sheet Sf ejected from the folding apparatus 300 or the enclosing-sealing apparatus 100 disposed upstream from the post-processing apparatus 400 in the sheet conveyance direction DS.

The enclosing-sealing apparatus 100 encloses the folded sheet Sf into the envelope E in a proper orientation. The envelope E may be provided with a transparent window produced at a predetermined position in advance so that the user visually recognizes information such as an address printed on the folded sheet Sf serving as the enclosure from an outside of the envelope E also through the transparent window after the folded sheet Sf is enclosed in the envelope E. The transparent window is created by producing a hole having a predetermined size on a face of the envelope E and attaching transparent film or the like on the hole. The proper orientation with respect to the envelope E defines, among orientations of the enclosure with respect to the transparent window, an orientation of the folded sheet Sf in which an information area such as the address or the like printed on the folded sheet Sf enclosed in the envelope E overlaps the transparent window formed on the envelope E.

A plurality of types of folding is available for the folded sheet Sf. An orientation and a position of the information area such as the address with respect to the sheet conveyance direction DS vary depending on the type of folding. To address this circumstance, before the folded sheet Sf reaches the enclosing position, the enclosing-sealing apparatus 100 controls the orientation of the folded sheet Sf that enters the envelope E to be a proper orientation according to the type of folding of the folded sheet Sf conveyed as an enclosing target. For example, the enclosing-sealing apparatus 100 determines whether or not to reverse the folded sheet Sf in a direction perpendicular to the sheet conveyance direction DS of the folded sheet Sf while the folded sheet Sf is conveyed.

The enclosing-sealing apparatus 100 includes a conveying mechanism that reverses the folded sheet Sf that is conveyed. If the enclosing-sealing apparatus 100 determines that the folded sheet Sf is to be reversed, the conveying mechanism reverses the folded sheet Sf by using a conveyance path disposed upstream from the enclosing position in the sheet conveyance direction DS, and then conveys the folded sheet Sf to the enclosing position. Details of control processes for reversing and conveying the folded sheet Sf are described below. Similarly, the enclosing-sealing apparatus 100 determines whether or not to reverse the sheet S serving as the enclosure that is not folded based on a positional relation between a position of the information area such as the address printed on the sheet S and a position of the transparent window on the envelope E, before the sheet S reaches the enclosing position, and encloses the sheet S into the envelope E.

A description is provided of coordinate axes referred to in descriptions of embodiments of the present disclosure.

As illustrated in FIG. 1, Y-axis defines an axis that is parallel to a placement face on which the print system 1 is placed. Y-axis also defines an axis that is extended in an arrangement direction in which the apparatuses (e.g., the image forming apparatus 200, the folding apparatus 300, the enclosing-sealing apparatus 100, and the post-processing apparatus 400) that construct the print system 1 are arranged. In the present disclosure, a direction indicated with an arrow of Y-axis defines a positive Y-direction. A direction opposite to the positive Y-direction defines a negative Y-direction. Hence, as described below in detail, the sheet S bearing the image formed by the image forming apparatus 200 is conveyed in the positive Y-direction. Thereafter, the sheet S is conveyed to the folding apparatus 300, the enclosing-sealing apparatus 100, and the post-processing apparatus 400 that are disposed downstream from the image forming apparatus 200 in the positive Y-direction.

Similarly, X-axis defines an axis that is parallel to the placement face on which the print system 1 is placed and is extended in a front-rear direction of the print system 1. A direction indicated with an arrow of X-axis defines a positive X-direction. A direction opposite to the positive X-direction defines a negative X-direction.

Z-axis defines an axis that is perpendicular to X-axis and Y-axis and is extended in a height direction of the print system 1. A direction indicated with an arrow of Z-axis defines a positive Z-direction. A direction opposite to the positive Z-direction defines a negative Z-direction.

If drawings referred to in descriptions below are also attached with coordinate axes similar to the coordinate axes described above, directions of the coordinate axes are also defined as described above.

The sheet S bearing the image formed by the image forming apparatus 200 is ejected in the positive Y-direction. Thereafter, the sheet S is conveyed to the folding apparatus 300, the enclosing-sealing apparatus 100, and the post-processing apparatus 400 that are disposed downstream from the image forming apparatus 200 in the positive Y-direction. Hence, the positive Y-direction is equivalent to the sheet conveyance direction DS. However, although the sheet S or the folded sheet Sf enters the enclosing-sealing apparatus 100 in the positive Y-direction, the sheet S or the folded sheet Sf is conveyed in a Z-direction when the sheet S or the folded sheet Sf is inserted into the envelope E and the envelope E is sealed.

For example, in the enclosing-sealing apparatus 100 of the print system 1, the envelope E is conveyed in the Z-direction. The envelope E is conveyed to the enclosing position in the positive Z-direction. The envelope E is conveyed from the enclosing position to a sealing position where the envelope E is sealed in the negative Z-direction.

Figure 2:
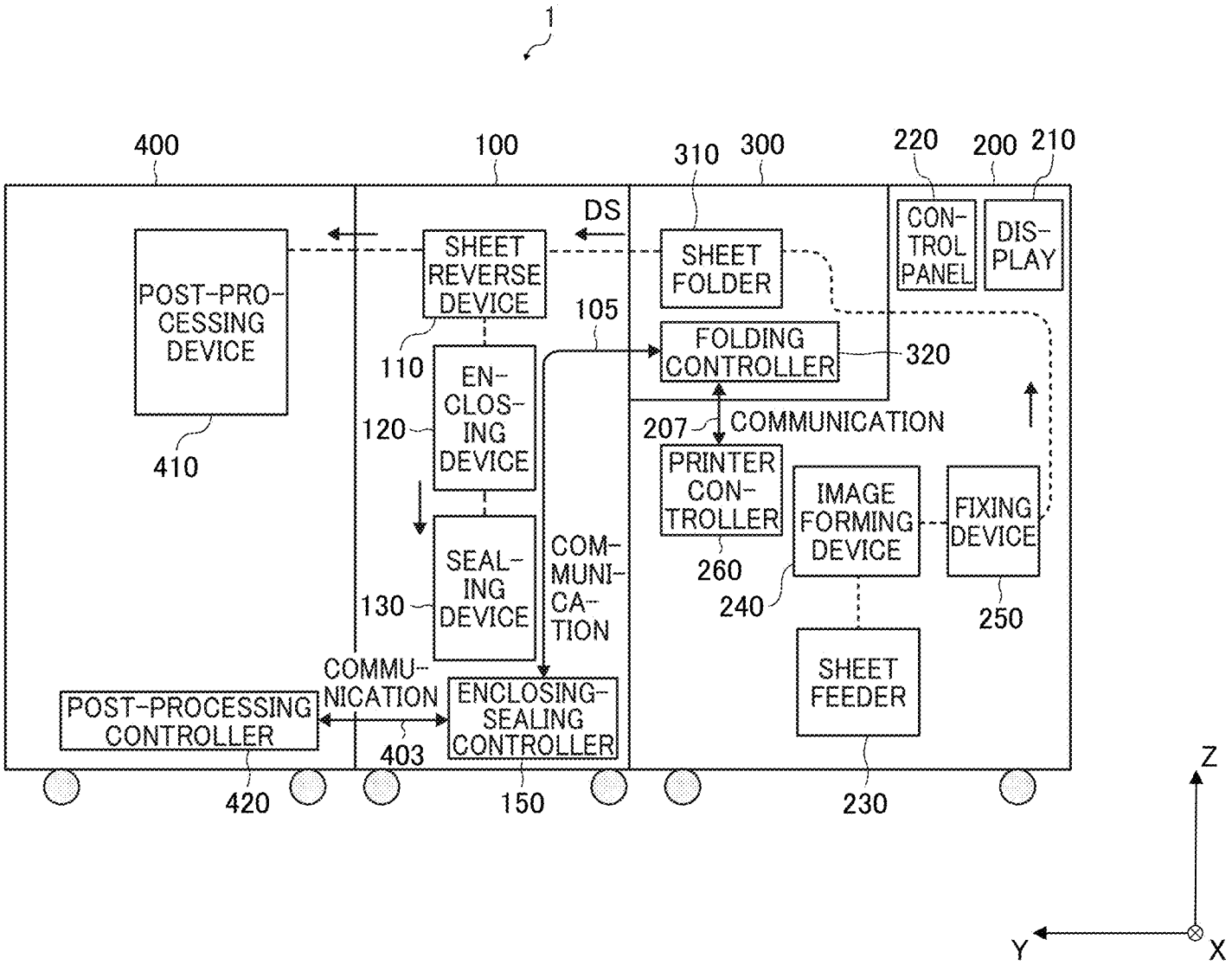
FIG. 2 is a block diagram of the image forming system depicted in FIG. 1, illustrating a control configuration thereof.

Referring to FIG. 2, a description is provided of functional blocks of an entirety of the print system 1.

In a description below, an enclosure serving as a medium conveyed and inserted into the envelope E is the folded sheet Sf that bears the image formed by the image forming apparatus 200 and is treated with predetermined folding by the folding apparatus 300. FIG. 2 illustrates a motion path (e.g., a conveyance path) of the folded sheet Sf with a broken line. FIG. 2 illustrates a channel used for sending and receiving a signal between the functional blocks with a solid line. FIG. 2 illustrates a motion path (e.g., a conveyance path) of the sheet S with the broken line also.

For example, the image forming apparatus 200 forms the image on the sheet S by general electrophotographic processes. The image forming apparatus 200 includes a display 210, a control panel 220, a sheet feeder 230, an image forming device 240, a fixing device 250, and the printer controller 260.

The display 210 displays information to the user, such as a status of each function and an operation to be specified by the user. The control panel 220 is equivalent to an operation interface with which the user performs settings such as a setting for specifying an operating mode and a number of prints and a setting for reversing the sheet S or the folded sheet Sf when the enclosing-sealing apparatus 100 inserts the sheet S or the folded sheet Sf into the envelope E. The sheet feeder 230 includes a sheet feeding mechanism that stocks the sheets S and separates and feeds the sheets S one by one. The image forming device 240 forms a latent image on a photoconductor, develops the latent image into an image (e.g., a toner image), and transfers the image onto the sheet S. The fixing device 250 fixes the image transferred onto the sheet S thereon. The printer controller 260 controls operations of the functional blocks described above.

The folding apparatus 300 includes a sheet folder 310 and the folding controller 320. The sheet folder 310 folds the sheet S conveyed from the image forming apparatus 200 with a folding type, that is, by a folding method, specified by the printer controller 260 of the image forming apparatus 200 via a communication line 207. The folding controller 320 controls an entirety of the folding apparatus 300. The folding controller 320 also controls communication with the printer controller 260 and an enclosing-sealing controller 150 that is disposed downstream from the folding controller 320 in the sheet conveyance direction DS of the sheet S and is coupled with the folding controller 320. Alternatively, the sheet S may be conveyed to the enclosing-sealing apparatus 100 without being folded by the sheet folder 310.

The sheet folder 310 may selectively employ a plurality of types of detailed constructions. A state of the folded sheet Sf after being folded by the sheet folder 310 may vary depending on the type of the construction. Specifically, at a predetermined position in an enclosing device 120 described below, a leading end of the folded sheet Sf in an enclosing direction in which the folded sheet Sf enters the envelope E may vary depending on the type of folding. Even with an identical folding, the leading end of the folded sheet Sf in the sheet conveyance direction DS may change places with a trailing end of the folded sheet Sf in the sheet conveyance direction DS according to an interior configuration of the sheet folder 310.

A description is provided of a construction of the enclosing-sealing apparatus 100.

As illustrated in FIG. 2, the enclosing-sealing apparatus 100 includes a sheet reverse device 110, the enclosing device 120, a sealing device 130, and the enclosing-sealing controller 150.

The sheet reverse device 110 performs sheet conveyance processing that conveys the folded sheet Sf conveyed from the sheet folder 310 to the enclosing position according to an orientation of an image forming face of the folded sheet Sf. The sheet conveyance processing defines conveyance of the folding sheet Sf, that corresponds to a control mode (e.g., a type of folding, a position on a print face of the folded sheet Sf, and the like) instructed to the enclosing-sealing controller 150 from the folding controller 320 via a communication line 105. In other words, the sheet reverse device 110 performs conveyance of the folded sheet Sf downstream in the sheet conveyance direction DS, reversing of the folded sheet Sf to change places of the leading end and the trailing end of the folded sheet Sf in the sheet conveyance direction DS, and the like. Conveyance and reversing of the folded sheet Sf convey the folded sheet Sf to the enclosing device 120 or the post-processing apparatus 400.

The enclosing device 120 includes a mechanism that moves the envelope E to the enclosing position where the folded sheet Sf conveyed from the sheet reverse device 110 is inserted into the envelope E, causes the envelope E to wait at the enclosing position, and inserts the folded sheet Sf serving as the enclosure into the envelope E that waits. The enclosing device 120 further includes a mechanism that opens a flap ef illustrated in FIG. 3 so that a mouth (e.g., an opening) of the envelope E opens before the envelope E reaches the enclosing position. The enclosing device 120 further includes a mechanism used to calculate a length of the envelope E (e.g., a dimension in the enclosing direction in which the enclosure is inserted into the envelope E) and a length of the flap ef before the envelope E reaches the enclosing position. The mechanisms insert the folded sheet Sf into the envelope E in a state in which the envelope E is held at the enclosing position and the mouth of the envelope E opens. The mechanisms insert the folded sheet Sf into the envelope E that varies in type and size properly.

Figure 3:
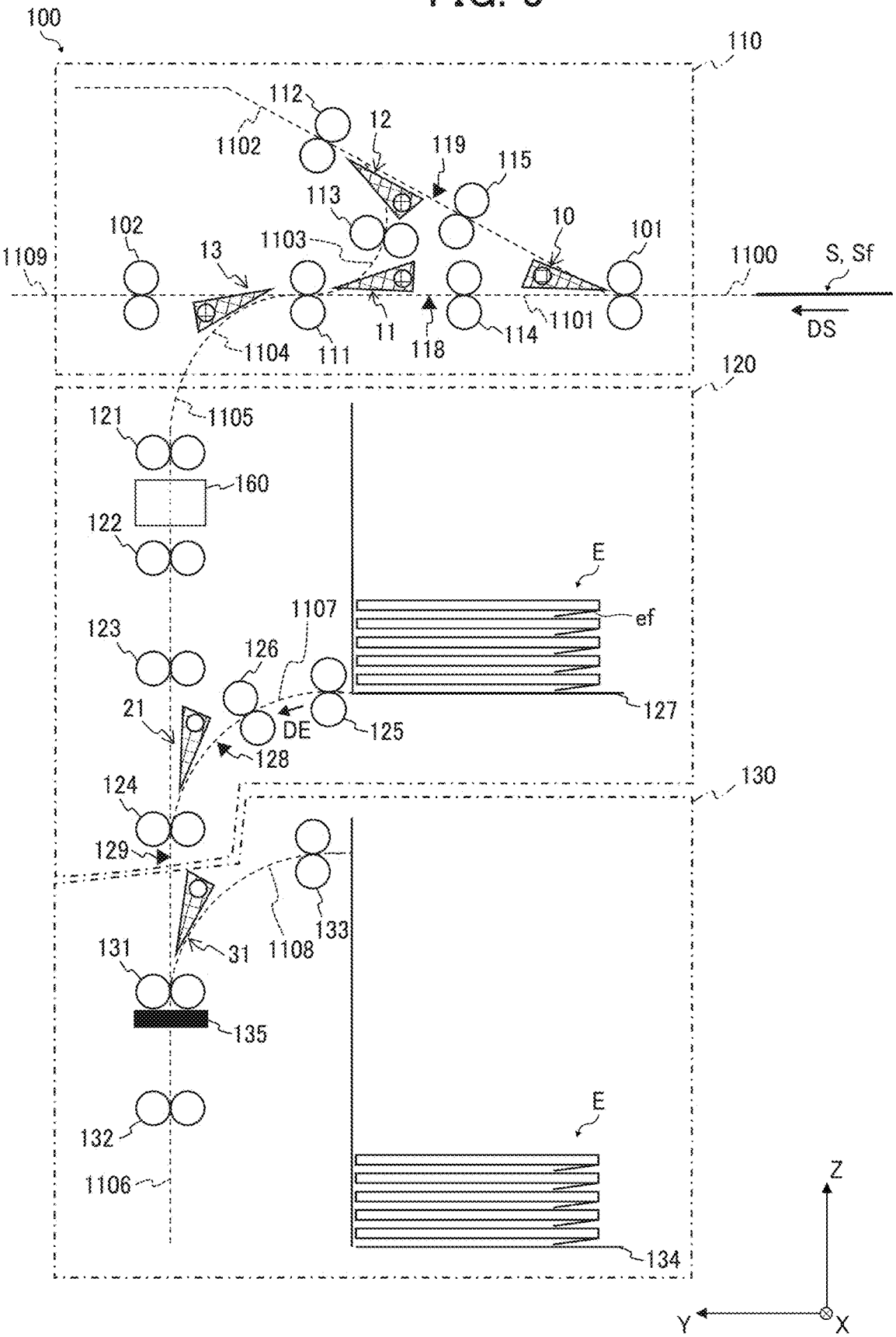
FIG. 3 is a cross-sectional view of an enclosing-sealing apparatus incorporated in the image forming system depicted in FIG. 1.

The sealing device 130 closes the flap of of the envelope E enclosed with the folded sheet Sf, and then ejects the sealed envelope E to an envelope ejection tray 134 illustrated in FIG. 3.

The enclosing-sealing controller 150 controls motion of a plurality of conveyance roller pairs that constructs the sheet reverse device 110, the enclosing device 120, and the sealing device 130 and motion of switching pawls that switch conveyance paths of the envelope E.

The enclosing-sealing controller 150 is a controller that controls conveyance of the folded sheet Sf including reversing and enclosing of the folded sheet Sf. The enclosing-sealing controller 150 serving as the controller receives enclosing target data as data relating to the folded sheet Sf from the printer controller 260 and the folding controller 320. The enclosing-sealing controller 150 controls conveyance of the folded sheet Sf based on an instruction indicated by each data included in the received, enclosing target data.

The enclosing target data is data relating to the sheet S and the folded sheet Sf serving as the enclosure. Specifically, the enclosing target data includes data used to control a leading end of the sheet S or the folded sheet Sf in the sheet conveyance direction DS when the sheet S or the folded sheet Sf enters the envelope E to be a desired end of the sheet S or the folded sheet Sf. For example, the enclosing target data further includes folding type data that specifies a type of folding applied to produce the folded sheet Sf. The enclosing target data further includes reverse data that specifies whether or not to perform reversing and conveyance described below of the folded sheet Sf as an operation instruction from the image forming apparatus 200 as one of the upstream apparatuses disposed upstream from the enclosing-sealing apparatus 100 in the sheet conveyance direction DS. For example, the enclosing target data further includes print face data that specifies the image forming face of the folded sheet Sf, that bears the image. For example, the enclosing target data further includes folder type data that specifies a type of the sheet folder 310 that performs folding.

The post-processing apparatus 400 includes a post-processing device 410 and a post-processing controller 420. The post-processing controller 420 controls the post-processing device 410 to perform predetermined post-processing on the sheet S conveyed from the upstream apparatus disposed upstream from the post-processing apparatus 400 in the sheet conveyance direction DS. The post-processing controller 420 controls the post-processing performed by the post-processing device 410 according to an operating mode sent from the printer controller 260, the folding controller 320, and the enclosing-sealing controller 150 via a communication line 403.

The printer controller 260, the folding controller 320, the enclosing-sealing controller 150, and the post-processing controller 420 are coupled with each other to communicate data needed for control via each of communication lines (e.g., the communication lines 207, 105, and 403). Thus, with linkage between controllers (e.g., the printer controller 260, the folding controller 320, the enclosing-sealing controller 150, and the post-processing controller 420), the controllers share data relating to a processing mode in which the user requests processing on the sheet S and the folded sheet Sf and a size of the sheet S and the folded sheet Sf. Accordingly, the entirety of the print system 1 shares control data based on which each of the mechanisms described above performs predetermined processing through a predetermined process at a predetermined time.

The enclosing-sealing controller 150 that performs a central control according to this embodiment includes a central processing unit (CPU) serving as an arithmetic processing unit, a read only memory (ROM) serving as a memory, and a random access memory (RAM). The enclosing-sealing controller 150 further includes an interface that outputs a control signal to each conveyance roller and receives a signal from each conveyance roller and another interface that receives an output signal from each sensor. The enclosing-sealing controller 150 controls operations of the enclosing-sealing apparatus 100 with a control program that executes control processing by using hardware resources described above. The functional blocks of the enclosing-sealing controller 150 are described below in detail.

The printer controller 260, the folding controller 320, and the post-processing controller 420, like the enclosing-sealing controller 150, also control operations of hardware mechanisms with a control program that achieves functions by using the hardware resources constructed by the CPU, the ROM, the RAM, and the like.

FIGS. 1 and 2 illustrate a construction in which the enclosing-sealing apparatus 100 is coupled with the post-processing apparatus 400 disposed downstream from the enclosing-sealing apparatus 100 in the sheet conveyance direction DS as an example of the construction of the print system 1. The post-processing apparatus 400 is typically a finisher that staples the sheets S, a stacker, a bookbinding machine, or the like. As an example of a system construction of the print system 1, the enclosing-sealing apparatus 100 may be disposed most downstream in the sheet conveyance direction DS in the print system 1.

A description is provided of a control of the print system 1 according to an embodiment of the present disclosure.

According to this embodiment, conveyance of the envelope E is controlled based on an envelope length of the envelope E and a flap length of the flap ef that are calculated by the enclosing device 120 described below.

Before the envelope E reaches the enclosing position, the enclosing-sealing controller 150, with the control program, calculates the length (e.g., the envelope length) of the envelope E and the length (e.g., the flap length) of the flap ef of the envelope E. The enclosing-sealing controller 150 notifies the envelope length and the flap length that are calculated to the folding controller 320, the post-processing controller 420, and the printer controller 260 through the folding controller 320.

According to this embodiment, the envelope length defines a distance between both ends of the envelope E, that is, a distance from a leading end to a trailing end of the envelope E in an envelope conveyance direction DE when the envelope E is supplied to an envelope conveyance path 1105 described below with reference to FIG. 3. In other words, the envelope length defines a distance from the leading end to the trailing end of the envelope E in a moving direction of the envelope E, that is, the envelope conveyance direction DE, when the envelope E is conveyed from an envelope tray 127 to the envelope conveyance path 1105 through an envelope entry path 1107 as described below. According to this embodiment, the envelope length, in the envelope conveyance direction DE defined as the moving direction of the envelope E, includes an envelope length (e.g., a first envelope length) of the envelope E conveyed in a close state in which the flap ef closes and an envelope length (e.g., a second envelope length) of the envelope E conveyed in an open state in which the flap ef opens.

The first envelope length is equivalent to a top-to-bottom dimension of the envelope E, that is, a distance from a bottom of the envelope E to a top (e.g., a folded position) of the envelope E in the close state in which the flap ef is folded and closed. The second envelope length is equivalent to a distance from the bottom of the envelope E to an end of the flap ef in the envelope conveyance direction DE in the open state in which the flap ef opens. In a description below, the envelope length indicates the first envelope length unless otherwise specified. A value obtained by subtracting the first envelope length from the second envelope length is equivalent to the length of the flap ef in the envelope conveyance direction DE, that is referred to as the flap length.

A description is provided of operations of the enclosing-sealing apparatus 100.

Referring to FIG. 3, the following describes configurations of conveyance rollers, switching pawls that switch a conveyance direction of a conveyed object, and conveyance paths provided with the conveyance rollers and the switching pawls.

The conveyance rollers, the switching pawls, and the conveyance paths construct the sheet reverse device 110, the enclosing device 120, and the sealing device 130 of the enclosing-sealing apparatus 100.

A description is provided of a construction of the sheet reverse device 110.

As illustrated in FIG. 3, the sheet reverse device 110 includes a plurality of conveyance paths that is mainly distinguished as an entry path 1100, a first conveyance path 1101, a second conveyance path 1102, a switchback conveyance path 1103, an enclosing conveyance path 1104 serving as a fourth conveyance path, and a sheet ejecting path 1109.

The entry path 1100 is provided with an entry roller pair 101. The entry path 1100 is a sheet conveyance path that receives the folded sheet Sf ejected from the upstream apparatus disposed upstream from the enclosing-sealing apparatus 100 in the sheet conveyance direction DS, for example, the folding apparatus 300. The enclosing-sealing controller 150 receives the enclosing target data as data relating to the folded sheet Sf from the controllers disposed upstream from the enclosing-sealing controller 150 in the sheet conveyance direction DS, that is, the printer controller 260 and the folding controller 320. Thus, the enclosing-sealing controller 150 controls the entry roller pair 101 to resume and interrupt rotation.

The first conveyance path 1101 is one of a plurality of conveyance paths disposed downstream from the entry roller pair 101 in the sheet conveyance direction DS and branches from the entry path 1100. The first conveyance path 1101 is provided with a first conveyance roller pair 111 serving as a first conveyor and a first intermediate conveyance roller pair 114. The first conveyance path 1101 is further provided with a first sheet detecting sensor 118 serving as a first medium sensor that detects an end (e.g., the trailing end) of the folded sheet Sf conveyed in the sheet conveyance direction DS. The first sheet detecting sensor 118 is interposed between the first intermediate conveyance roller pair 114 and the first conveyance roller pair 111.

The second conveyance path 1102 is one of the conveyance paths disposed downstream from the entry roller pair 101 in the sheet conveyance direction DS and branches from the entry path 1100 in a direction different from a direction in which the first conveyance path 1101 extends. The second conveyance path 1102 is provided with a second conveyance roller pair 112 serving as a second conveyor and a second intermediate conveyance roller pair 115. The second conveyance path 1102 is further provided with a second sheet detecting sensor 119 serving as a second medium sensor that detects the end (e.g., the trailing end) of the folded sheet Sf conveyed in the sheet conveyance direction DS. The second sheet detecting sensor 119 is interposed between the second intermediate conveyance roller pair 115 and the second conveyance roller pair 112.

The sheet reverse device 110 further includes the switchback conveyance path 1103. The switchback conveyance path 1103 bridges between the first conveyance path 1101 at a junction position thereon and the second conveyance path 1102 at a branch position thereon. The switchback conveyance path 1103 adjoins the first conveyance path 1101 at the junction position disposed upstream from the first conveyance roller pair 111 in the sheet conveyance direction DS. The switchback conveyance path 1103 branches from the second conveyance path 1102 at the branch position disposed downstream from the second intermediate conveyance roller pair 115 in the sheet conveyance direction DS. The switchback conveyance path 1103 switches back the folded sheet Sf conveyed through the second conveyance path 1102 downstream in the sheet conveyance direction DS and guides the folded sheet Sf to the first conveyance path 1101. The switchback conveyance path 1103 serving as a third conveyance path is provided with a switchback conveyance roller pair 113 serving as a third conveyor.

The sheet reverse device 110 further includes the sheet ejecting path 1109 that adjoins the first conveyance path 1101 and is disposed downstream from the first conveyance path 1101 in the sheet conveyance direction DS. The sheet ejecting path 1109 ejects the sheet S or the folded sheet Sf that has passed through the sheet reverse device 110 into the post-processing apparatus 400 disposed downstream from the sheet reverse device 110 in the sheet conveyance direction DS. The sheet ejecting path 1109 is provided with an exit roller pair 102.

If the folded sheet Sf conveyed from the folding apparatus 300 is not treated with enclosing described below, the folded sheet Sf passes through the entry path 1100, the first conveyance path 1101, and the sheet ejecting path 1109 and is ejected into the post-processing apparatus 400 disposed downstream from the sheet reverse device 110 in the sheet conveyance direction DS.

The sheet reverse device 110 further includes the enclosing conveyance path 1104 disposed downstream from the first conveyance roller pair 111 in the sheet conveyance direction DS and branched from the first conveyance path 1101. The enclosing conveyance path 1104 serves as the fourth conveyance path that guides the folded sheet Sf to an enclosing roller pair 121 that holds the envelope E into which the folded sheet Sf is inserted. As described below, the enclosing conveyance path 1104 is contiguous to the envelope conveyance path 1105.

The sheet reverse device 110 further includes a branch pawl 10 serving as a branch member disposed at a branch position where the first conveyance path 1101 and the second conveyance path 1102 branch from the entry path 1100. The folded sheet Sf is conveyed to the first conveyance path 1101 or the second conveyance path 1102 from the branch position. The branch pawl 10 switches a conveyance path between the first conveyance path 1101 and the second conveyance path 1102 based on the enclosing target data relating to the folded sheet Sf entering the entry path 1100 so that the branch pawl 10 guides the folded sheet Sf to the first conveyance path 1101 or the second conveyance path 1102.

The sheet reverse device 110 further includes a first switching pawl 11 serving as a first switch disposed at the junction position where the switchback conveyance path 1103 adjoins the first conveyance path 1101. The first switching pawl 11 pivots between a first position where the first switching pawl 11 guides the folded sheet Sf conveyed from the entry path 1100 to the first conveyance path 1101 toward the first conveyance roller pair 111 and a second position where the first switching pawl 11 guides the folded sheet Sf conveyed from the switchback conveyance path 1103 to the first conveyance path 1101.

The sheet reverse device 110 further includes a second switching pawl 12 serving as a second switch disposed at the branch position where the switchback conveyance path 1103 branches from the second conveyance path 1102. The second switching pawl 12 pivots between a first position where the second switching pawl 12 guides the folded sheet Sf conveyed from the entry path 1100 to the second conveyance path 1102 toward the second conveyance roller pair 112 and a second position where the second switching pawl 12 guides the folded sheet Sf conveyed from the second conveyance path 1102 to the switchback conveyance path 1103 so as to switch back the folded sheet Sf.

The sheet reverse device 110 further includes a third switching pawl 13 serving as a third switch disposed at a branch position where the enclosing conveyance path 1104 branches from the first conveyance path 1101. The third switching pawl 13 pivots between a first position where the third switching pawl 13 guides the folded sheet Sf conveyed through the first conveyance path 1101 to the enclosing conveyance path 1104 and a second position where the third switching pawl 13 guides the folded sheet Sf conveyed through the first conveyance path 1101 to the sheet ejecting path 1109.

The first intermediate conveyance roller pair 114 conveys the folded sheet Sf conveyed through the first conveyance path 1101 to the first conveyance roller pair 111. The first conveyance roller pair 111 conveys the conveyed, folded sheet Sf downstream in the sheet conveyance direction DS. When the third switching pawl 13 is at the first position depicted in FIG. 3, the third switching pawl 13 guides the folded sheet Sf to the enclosing conveyance path 1104. When the folded sheet Sf is conveyed for a predetermined distance after the first sheet detecting sensor 118 detects the trailing end of the folded sheet Sf conveyed from the first intermediate conveyance roller pair 114 to the first conveyance roller pair 111, the folded sheet Sf has already moved to the enclosing conveyance path 1104. Accordingly, the conveyance roller pairs of the sheet reverse device 110, that have rotated, interrupt rotation.

The second intermediate conveyance roller pair 115 conveys the folded sheet Sf conveyed through the second conveyance path 1102 to the second conveyance roller pair 112. When the folded sheet Sf is conveyed for a predetermined distance after the second sheet detecting sensor 119 detects the trailing end of the folded sheet Sf conveyed through the second conveyance path 1102 in the sheet conveyance direction DS, the second conveyance roller pair 112 interrupts forward rotation, and then starts backward rotation. Thus, the second conveyance roller pair 112 conveys the folded sheet Sf through the switchback conveyance path 1103 that switches back the folded sheet Sf. Before the second conveyance roller pair 112 rotates backward or at a time when the second conveyance roller pair 112 rotates backward, at a time when the trailing end of the folded sheet Sf in the sheet conveyance direction DS passes the second switching pawl 12, that is determined based on a detection result sent from the second sheet detecting sensor 119, the enclosing-sealing controller 150 pivots the second switching pawl 12. Thus, the second switching pawl 12 reaches the second position where the second switching pawl 12 guides the folded sheet Sf to the switchback conveyance path 1103.

As the second switching pawl 12 guides the folded sheet Sf from the second conveyance path 1102 to the switchback conveyance path 1103, the switchback conveyance roller pair 113 conveys the folded sheet Sf to the first conveyance path 1101.

A description is provided of a construction of the enclosing device 120.

As illustrated in FIG. 3, the enclosing device 120 includes the envelope conveyance path 1105 adjoining the enclosing conveyance path 1104 serving as the fourth conveyance path. The envelope conveyance path 1105 receives the sheet S or the folded sheet Sf serving as the enclosure conveyed from the sheet reverse device 110 and conveys the sheet S or the folded sheet Sf to be inserted into the envelope E. The envelope conveyance path 1105 is provided with an enclosing support 160 that is disposed at the enclosing position where the envelope E waits for the enclosure (e.g., the sheet S or the folded sheet Sf) to be inserted into the envelope E and supports the envelope E such that the enclosure is inserted into the envelope E smoothly.

A construction of the enclosing support 160 is described below in detail. The enclosing support 160 is a part of an enclosing support mechanism that operates under a conveyance control for conveying the envelope E to the enclosing position. The enclosing support 160 includes a construction that retracts the flap ef of the envelope E from the envelope conveyance path 1105 because the flap ef may disturb insertion of the enclosure into the envelope E while the enclosure is conveyed toward the enclosing position. The enclosing support 160 retracts the flap ef from the envelope conveyance path 1105 to a retracted position separated from the envelope conveyance path 1105 and holds the flap ef at the retracted position. Thus, the enclosing support 160 prevents the flap ef from disturbing insertion and enclosing of the enclosure into the envelope E. The enclosing support 160 widens the mouth of the envelope E while retaining the flap ef at the retracted position, facilitating smooth insertion of the enclosure into the envelope E. Thus, the enclosing support 160 supports enclosing of the enclosure into the envelope E.

The envelope conveyance path 1105 adjoins a sealing conveyance path 1106 in the Z-direction. In the sealing conveyance path 1106, a sealer 135 seals the envelope E enclosed with the enclosure. The envelope conveyance path 1105 adjoins the enclosing conveyance path 1104 and the sealing conveyance path 1106, constructing an envelope conveyance path.

The envelope conveyance path 1105 is provided with a first vertical conveyance roller pair 122 and a second vertical conveyance roller pair 123 that convey the envelope E to a reception position where the envelope E receives the folded sheet Sf. The enclosing roller pair 121 disposed in the envelope conveyance path 1105 holds the envelope E conveyed to the reception position where the envelope E receives the folded sheet Sf. The enclosing support 160 is interposed between the enclosing roller pair 121 and the first vertical conveyance roller pair 122.

Figure 4:
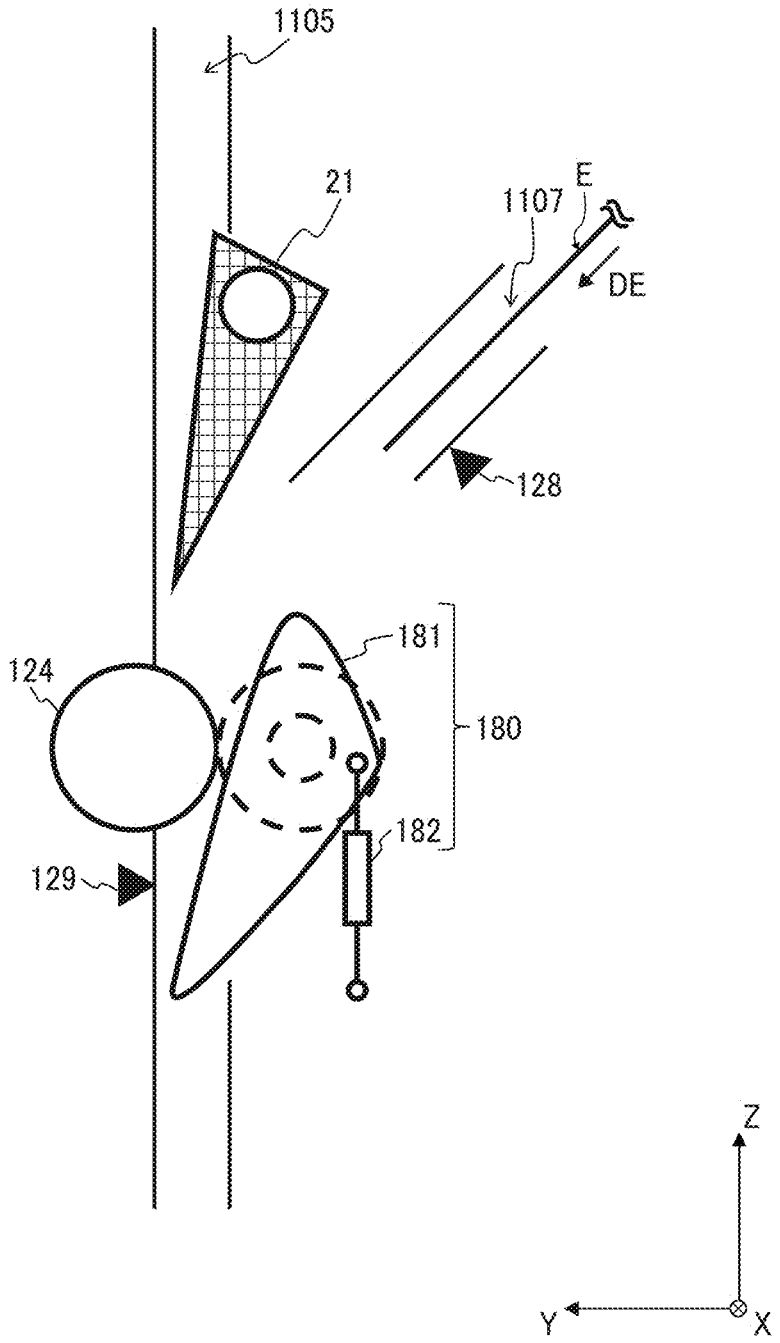
FIG. 4 is a schematic cross-sectional view of a flap opener incorporated in the enclosing-sealing apparatus depicted in FIG. 3.

A flap opening roller pair 124 is disposed at a junction position where the envelope conveyance path 1105 adjoins the sealing conveyance path 1106. As illustrated in FIG. 4, the flap opening roller pair 124 is attached with a flap opener 180 that opens the flap ef when the flap opening roller pair 124 conveys the envelope E ejected from the envelope tray 127 through the envelope entry path 1107 to a prejunctional position before a junction position where the envelope entry path 1107 adjoins the envelope conveyance path 1105. A construction of the flap opener 180 is described below in detail.

A separation sensor 128 is disposed upstream from the flap opening roller pair 124 in the envelope conveyance direction DE. The separation sensor 128 detects the first envelope length of the envelope E in the envelope conveyance direction DE in the close state in which the flap ef closes. A flap opening detecting sensor 129 is disposed downstream from the flap opening roller pair 124 in the envelope conveyance direction DE. The flap opening detecting sensor 129 detects whether or not the flap ef of the envelope E opens, that is, whether or not the flap ef is in the open state. The flap opening detecting sensor 129 detects the second envelope length of the envelope E in the envelope conveyance direction DE.

An envelope switchback switching pawl 21 is disposed at the junction position where the envelope entry path 1107 adjoins the envelope conveyance path 1105.

The envelope entry path 1107 that adjoins the envelope conveyance path 1105 is provided with an envelope separating roller pair 125, an envelope conveyance roller pair 126, and the separation sensor 128 serving as a first envelope detector. The envelope tray 127 adjoins an end of the envelope entry path 1107. The envelope entry path 1107 also constructs the envelope conveyance path together with the envelope conveyance path 1105.

As illustrated in FIG. 3, a plurality of envelopes E is placed on the envelope tray 127. Each of the envelopes E placed on the envelope tray 127 includes the bottom, that is, an opposite end being opposite to the flap ef. The bottom of the envelope E faces the envelope separating roller pair 125. Hence, the bottom of the envelope E serves as the leading end of the envelope E in the envelope conveyance direction DE when the envelope E is ejected from the envelope tray 127. Another end of the envelope E, that is provided with the flap ef, serves as the trailing end of the envelope E in the envelope conveyance direction DE.

As the envelope separating roller pair 125 picks up one envelope E from the plurality of envelopes E placed on the envelope tray 127, the envelope separating roller pair 125 and the envelope conveyance roller pair 126 convey the envelope E through the envelope entry path 1107 to a past position that is past the envelope switchback switching pawl 21. As the flap opening roller pair 124 also conveys the envelope E, when the trailing end of the envelope E in the envelope conveyance direction DE is past the envelope switchback switching pawl 21, the envelope switchback switching pawl 21 pivots to allow the envelope E to be switched back and conveyed.

For example, the envelope switchback switching pawl 21 pivots between a first position and a second position. At the first position, the envelope switchback switching pawl 21 temporarily guides the envelope E picked up from the envelope tray 127 to the sealing conveyance path 1106. At the second position, the envelope switchback switching pawl 21 guides the envelope E to the envelope conveyance path 1105 so that the envelope E is conveyed toward the sheet reverse device 110 through the envelope conveyance path 1105. The envelope switchback switching pawl 21 switches a conveyance direction of the envelope E conveyed through the envelope conveyance path 1105.

The first vertical conveyance roller pair 122 and the second vertical conveyance roller pair 123 convey the envelope E to the enclosing position as a predetermined position in the envelope conveyance path 1105 and hold the envelope E. At the enclosing position, as described below, the mouth of the envelope E (e.g., the flap ef) is situated below the enclosing roller pair 121 and above the first vertical conveyance roller pair 122 in FIG. 3.

The enclosing roller pair 121 is one type of a pair of conveyance rollers, that rotates in the enclosing direction in which the folded sheet Sf conveyed from the sheet reverse device 110 is inserted into the envelope E.

A description is provided of a construction of the sealing device 130.

As illustrated in FIG. 3, the sealing device 130 includes the sealing conveyance path 1106 provided with a third vertical conveyance roller pair 131 and a fourth vertical conveyance roller pair 132. The sealer 135 is interposed between the third vertical conveyance roller pair 131 and the fourth vertical conveyance roller pair 132. The sealer 135 closes the flap of of the envelope E enclosed with the enclosure.

The third vertical conveyance roller pair 131 and the fourth vertical conveyance roller pair 132 convey the envelope E to a predetermined position in the sealing conveyance path 1106 and hold the envelope E.

An envelope ejecting switching pawl 31 is disposed at a branch position where an envelope ejecting path 1108 branches from the sealing conveyance path 1106. An envelope ejecting roller pair 133 is disposed at an end of the envelope ejecting path 1108. The envelope ejecting roller pair 133 ejects the envelope E onto the envelope ejection tray 134. The envelope ejection tray 134 is placed with the envelope E ejected by the envelope ejecting roller pair 133.

The envelope ejecting switching pawl 31 pivots between a first position and a second position. At the first position, the envelope ejecting switching pawl 31 guides the envelope E from the flap opening roller pair 124 to the third vertical conveyance roller pair 131 through the sealing conveyance path 1106. At the second position, the envelope ejecting switching pawl 31 guides the envelope E from the sealing conveyance path 1106 to the envelope ejecting path 1108. Thus, the envelope ejecting switching pawl 31 switches a conveyance direction of the envelope E.

As described above, in the enclosing-sealing apparatus 100, the conveyance paths (e.g., the envelope conveyance path 1105 and the sealing conveyance path 1106) that convey the folded sheet Sf from the sheet reverse device 110 to the enclosing device 120 and the sealing device 130 are arranged contiguously and vertically in the Z-direction. The conveyance paths that convey the folded sheet Sf and the envelope E construct a vertical conveyance path that couples the envelope conveyance path 1105 of the enclosing device 120 with the sealing conveyance path 1106 of the sealing device 130 vertically in the Z-direction.

Referring to FIG. 4, a detailed description is provided of a construction of the flap opener 180 attached to the flap opening roller pair 124.

The flap opener 180 includes a flap scooping pawl 181 and a spring 182. The flap scooping pawl 181 is pivotally attached to a rotation shaft of one of a pair of conveyance rollers constructing the flap opening roller pair 124. The spring 182 biases the flap scooping pawl 181.

As the envelope separating roller pair 125 separates one envelope E from other envelopes E placed on the envelope tray 127 and the envelope conveyance roller pair 126 conveys the envelope E through the envelope entry path 1107, the envelope E comes into contact with the flap scooping pawl 181. Before the envelope E comes into contact with the flap scooping pawl 181, the spring 182 biases the flap scooping pawl 181 to close the envelope conveyance path 1105, blocking the envelope E conveyed from the envelope entry path 1107 toward the envelope conveyance path 1105. While the envelope E is not conveyed from the envelope entry path 1107, the flap scooping pawl 181 is at a default position where the flap scooping pawl 181 contacts a conveyance guide that constructs the envelope conveyance path 1105 and restricts pivoting of the flap scooping pawl 181 by the spring 182. As the envelope E contacts and presses against the flap scooping pawl 181, the flap scooping pawl 181 pivots against a biasing force from the spring 182, causing the envelope E to move to the envelope conveyance path 1105.

When the envelope E conveyed through the envelope entry path 1107 passes over the flap scooping pawl 181 and presses against the flap scooping pawl 181, the flap scooping pawl 181 pivots. Accordingly, a head of the flap scooping pawl 181 catches or hooks the flap ef. In a state in which the head of the flap scooping pawl 181 hooks the flap ef, the flap opening roller pair 124 moves the envelope E in the negative Z-direction, thus opening the flap ef that has been closed.

As illustrated in FIG. 4, the envelope entry path 1107 is provided with the separation sensor 128 serving as the first envelope detector disposed upstream from the flap opening roller pair 124 in the envelope conveyance direction DE. The flap opening detecting sensor 129 serving as a second envelope detector is disposed downstream from the flap opening roller pair 124 in the envelope conveyance direction DE.

A description is provided of a construction of a comparative enclosing apparatus that inserts an enclosure into an envelope automatically and successively.

The comparative enclosing apparatus includes an enclosure guide plate that encloses the enclosure into the envelope smoothly.

In addition to the enclosure guide plate, the comparative enclosing apparatus further includes a mechanism that restrains a flap of the envelope to prevent the flap from disturbing enclosing of the enclosure into the envelope. Accordingly, the comparative enclosing apparatus may be upsized and may increase manufacturing costs.

To address this circumstance of the comparative enclosing apparatus, the enclosing-sealing apparatus 100 serving as the enclosing apparatus according to the embodiments of the present disclosure conveys the envelope E to the enclosing position while the enclosing support 160 of the enclosing-sealing apparatus 100 retracts the flap ef when the enclosure is inserted into the envelope E, thus supporting smooth enclosing of the enclosure into the envelope E, as described below.

A description is provided of a construction of the enclosing support 160 according to a first embodiment of the present disclosure.

Figure 5:
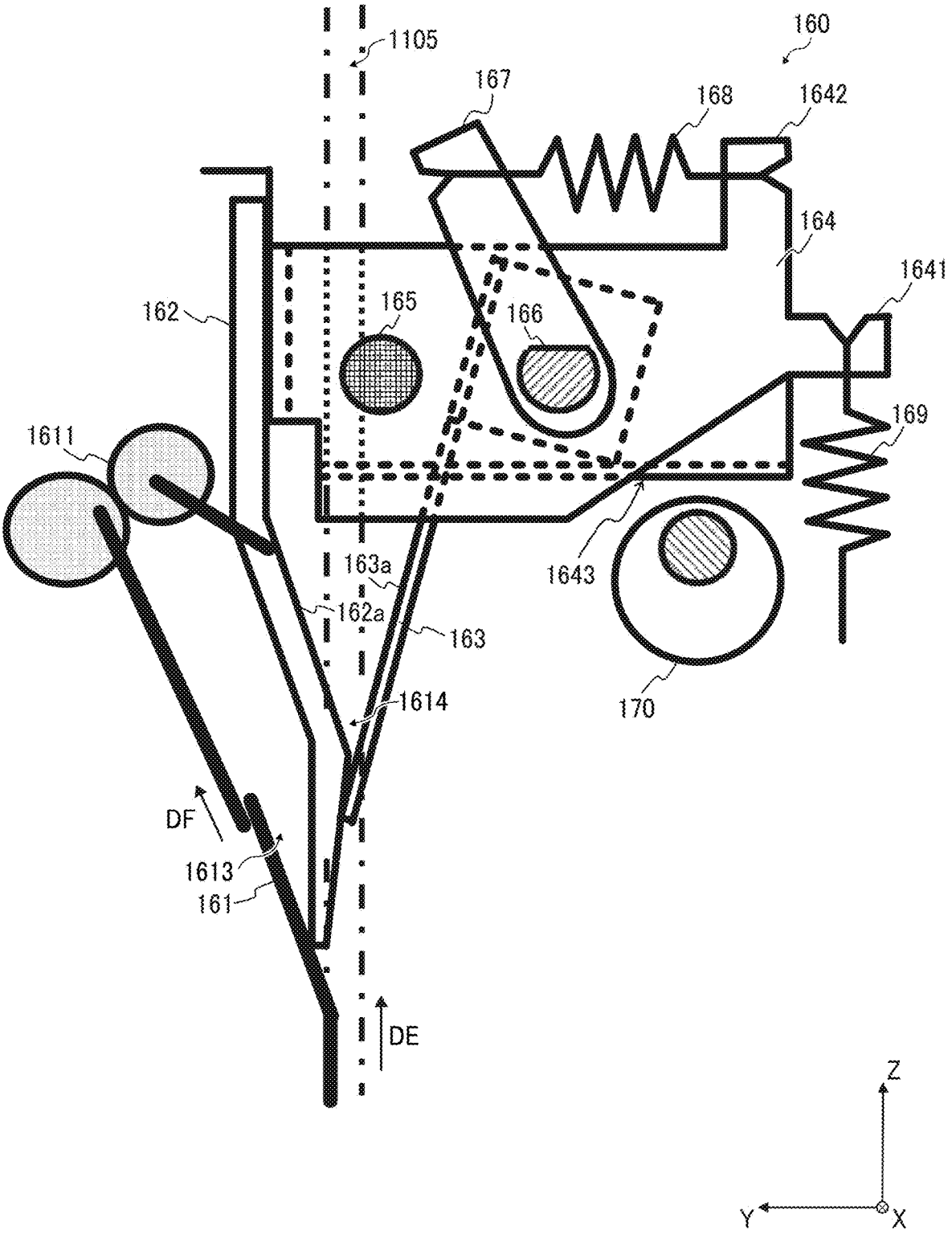
FIG. 5 is a front view of an enclosing support according to a first embodiment of the present disclosure, that is incorporated in the enclosing-sealing apparatus depicted in FIG. 3.
Figure 6:
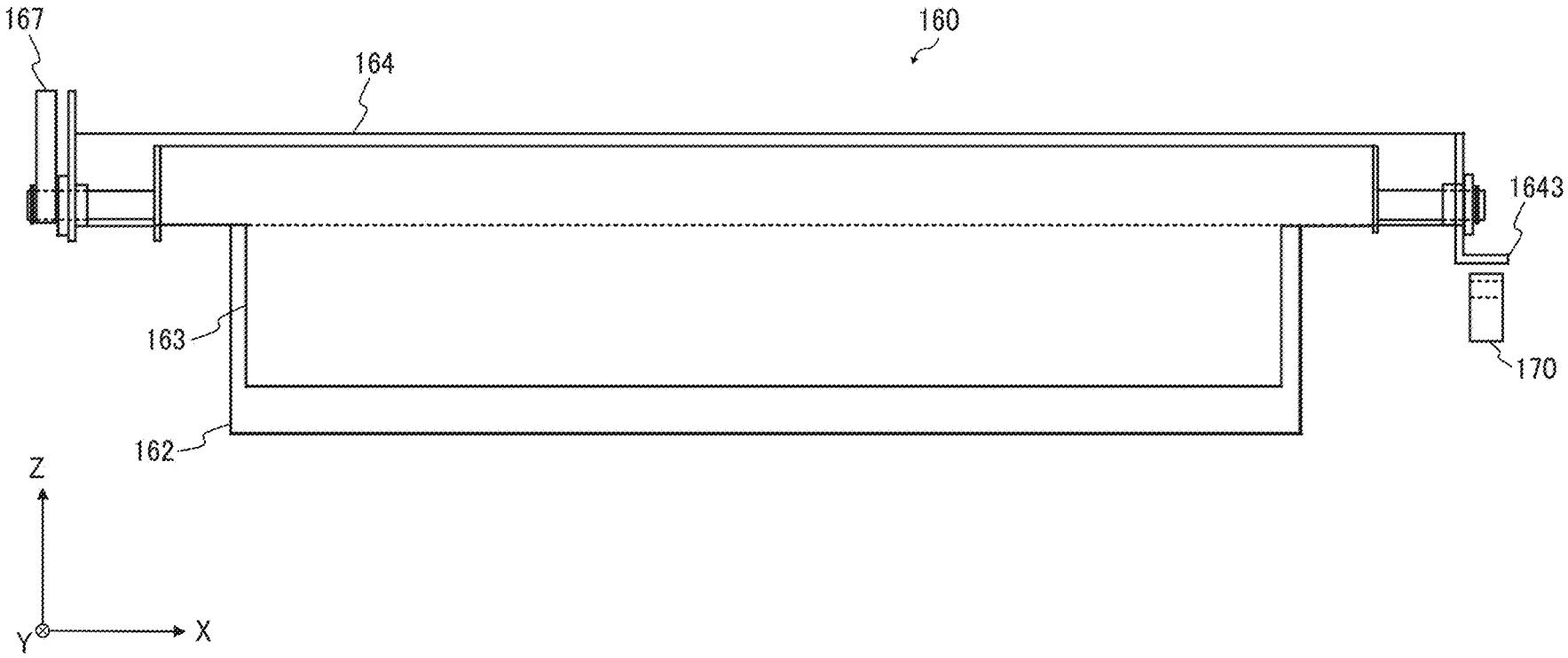
FIG. 6 is a right side view of the enclosing support according to the first embodiment depicted in FIG. 5, illustrating a schematic construction thereof.
Figure 7:
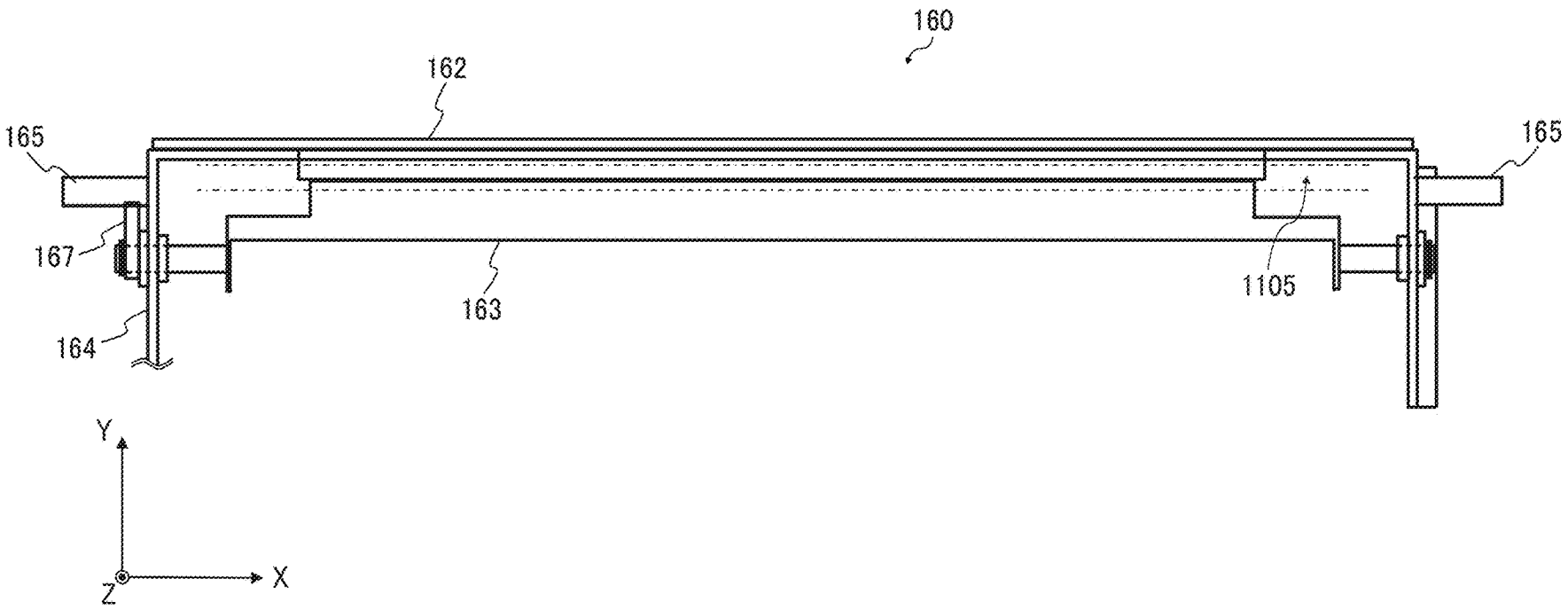
FIG. 7 is a top view of the enclosing support according to the first embodiment depicted in FIG. 5, illustrating the schematic construction thereof.

Referring to FIGS. 5, 6, and 7, a description is provided of the construction of the enclosing support 160 according to the first embodiment that is incorporated in the enclosing device 120.

FIG. 5 is a front view of the enclosing support 160. FIG. 6 is a right side view of the enclosing support 160. FIG. 7 is a top view of the enclosing support 160.

The enclosing support 160 is disposed at the predetermined position in the envelope conveyance path 1105. When the envelope E is conveyed to the enclosing position where the enclosure is inserted into the envelope E, the enclosing support 160 retracts the flap ef of the envelope E from the envelope conveyance path 1105 and holds the flap ef. As the envelope E is conveyed to the enclosing position while the enclosing support 160 holds the flap ef at the retracted position, the enclosing support 160 widens the mouth of the envelope E. That is, while the enclosure is enclosed into the envelope E, the enclosing support 160 retains the flap ef not to disturb enclosing of the enclosure into the envelope E and widens the mouth of the envelope E to facilitate smooth insertion of the enclosure into the envelope E. The predetermined position where the enclosing support 160 is disposed is a position in proximity to the enclosing position where the envelope E is held when the enclosure is inserted into the envelope E. For example, the position in proximity to the enclosing position is a position where the enclosing support 160 retracts the flap ef from the envelope conveyance path 1105 and holds the flap ef before the envelope E is conveyed to the enclosing position, and the envelope E is conveyed to the enclosing position while the enclosing support 160 continues holding the flap ef retracted from the envelope conveyance path 1105.

As illustrated in FIG. 5, the enclosing support 160 includes a flap conveyance path 1613 as a retracted path where the flap ef retracted from the envelope conveyance path 1105 is situated. The flap conveyance path 1613 branches from the envelope conveyance path 1105. The enclosing support 160 includes a flap guide plate 161 serving as a flap guide that guides the flap ef in a retracting direction. A flap holding roller pair 1611 is disposed downstream from the flap guide plate 161 in a flap conveyance direction DF. The flap holding roller pair 1611 holds the flap ef retracted from the envelope conveyance path 1105. The flap holding roller pair 1611 is a pair of rollers that nips the flap ef to retain the envelope E and prevent the envelope E from moving in the negative Z-direction in the envelope conveyance path 1105 while the enclosure is inserted into the envelope E.

When a first enclosing guide pawl spring 169 biases a first enclosing guide pawl 162, the first enclosing guide pawl 162 presses against the flap guide plate 161 serving as a guide. Thus, the flap guide plate 161 functions as a stopper. Accordingly, a contact position where the first enclosing guide pawl 162 contacts the flap guide plate 161 is the retracted position retracted from the envelope conveyance path 1105.

As the flap guide plate 161 and the first enclosing guide pawl 162 sandwich the flap ef, the enclosing support 160 is in a flap retracting state in which the enclosing support 160 retracts the flap ef from the envelope conveyance path 1105. In the flap retracting state, the enclosing roller pair 121 and the first vertical conveyance roller pair 122 hold the envelope E such that the envelope E is conveyed to the enclosing position. The enclosing support 160 holds the flap ef in a state in which the flap ef is retracted from and inclined with respect to the envelope conveyance path 1105 in a direction (e.g., the flap conveyance direction DF) different from the envelope conveyance direction DE. Accordingly, the envelope E is slightly bent toward the flap guide plate 161. The mouth of the envelope E is stretched in a direction in which the flap ef is inclined. Consequently, the mouth of the envelope E widens slightly.

The enclosing support 160 includes the first enclosing guide pawl 162 serving as a flap conveyance direction switching pawl. The first enclosing guide pawl 162 is mounted on a side face of an enclosing guide stay 164. The first enclosing guide pawl 162 is a plate having a longitudinal dimension in a width direction of the envelope E. The first enclosing guide pawl 162 is rectangular in a side view.

As the enclosing guide stay 164 pivots, the first enclosing guide pawl 162 pivots, pressing the flap ef against the flap guide plate 161 and retracting the flap ef to the flap conveyance path 1613.

The enclosing support 160 further includes a second enclosing guide pawl 163 serving as a switching biasing pawl. The enclosing guide stay 164 pivotally holds the second enclosing guide pawl 163 through a second enclosing guide pawl shaft 166 that is rotatable. A second enclosing guide pawl spring 168 biases the second enclosing guide pawl 163 against the first enclosing guide pawl 162. In a default state for enclosing, a front end of the second enclosing guide pawl 163 contacts the first enclosing guide pawl 162. When the envelope E reaches a predetermined position illustrated in FIG. 16, the front end of the second enclosing guide pawl 163 moves to a default position where the second enclosing guide pawl 163 bridges across and blocks the envelope conveyance path 1105 contiguous to the enclosing conveyance path 1104 serving as an enclosing path. As described below, the first enclosing guide pawl 162 and the second enclosing guide pawl 163 guide the enclosure to the mouth of the envelope E. As the enclosure moves and pushes away the second enclosing guide pawl 163, the second enclosing guide pawl 163 pivots in a direction opposite to a biasing direction of the second enclosing guide pawl spring 168.

The enclosing support 160 includes the enclosing guide stay 164. A frame of the enclosing-sealing apparatus 100 pivotally supports the enclosing guide stay 164 through a first enclosing guide pawl shaft 165. A first spring mount end 1641 is mounted on a side face of the enclosing guide stay 164, that is opposite to the side face mounting the first enclosing guide pawl 162. One end of the first enclosing guide pawl spring 169 is anchored to the first spring mount end 1641. A second spring mount end 1642 is mounted on an end of the side face of the enclosing guide stay 164, that mounts the first spring mount end 1641, in the positive Z-direction. One end of the second enclosing guide pawl spring 168 is anchored to the second spring mount end 1642.

The enclosing support 160 includes the first enclosing guide pawl shaft 165. The first enclosing guide pawl shaft 165 is secured to the enclosing guide stay 164 by caulking. The first enclosing guide pawl shaft 165 rotatably engages the frame of the enclosing-sealing apparatus 100 through a bearing or the like. The enclosing guide stay 164 pivots about the first enclosing guide pawl shaft 165 in a pivot direction. Simultaneously, the first enclosing guide pawl 162 also pivots in the identical pivot direction.

The enclosing support 160 includes the second enclosing guide pawl shaft 166. The second enclosing guide pawl shaft 166 is secured to the second enclosing guide pawl 163 by caulking. The second enclosing guide pawl shaft 166 rotatably engages the enclosing guide stay 164 through a bearing. The second enclosing guide pawl 163 pivots about the second enclosing guide pawl shaft 166.

The enclosing support 160 further includes a second enclosing guide pawl arm 167. The second enclosing guide pawl arm 167 engages the second enclosing guide pawl shaft 166 such that the second enclosing guide pawl arm 167 does not rotate. The second enclosing guide pawl spring 168 is anchored to the second enclosing guide pawl arm 167. The second enclosing guide pawl spring 168 biases and pulls the second enclosing guide pawl arm 167 toward the second spring mount end 1642. A biasing force of the second enclosing guide pawl spring 168 pivots the second enclosing guide pawl 163 through the second enclosing guide pawl shaft 166. The second enclosing guide pawl 163 comes into contact with the first enclosing guide pawl 162 and presses the first enclosing guide pawl 162 in a pivot direction.

The enclosing support 160 includes the second enclosing guide pawl spring 168 serving as a second biasing member. The second enclosing guide pawl spring 168 is interposed between the second enclosing guide pawl arm 167 and the enclosing guide stay 164. The second enclosing guide pawl spring 168 biases the second enclosing guide pawl arm 167 in a pulling direction. Accordingly, the second enclosing guide pawl spring 168 biases the second enclosing guide pawl 163 to pivot about the second enclosing guide pawl shaft 166 clockwise in FIG. 5, pressing the second enclosing guide pawl 163 against the first enclosing guide pawl 162.

The enclosing support 160 includes the first enclosing guide pawl spring 169 serving as a first biasing member. The first enclosing guide pawl spring 169 is interposed between the enclosing guide stay 164 and a frame of the enclosing device 120. The first enclosing guide pawl spring 169 biases the enclosing guide stay 164 in a pulling direction. Accordingly, the first enclosing guide pawl spring 169 biases the first enclosing guide pawl 162 to pivot about the first enclosing guide pawl shaft 165 clockwise in FIG. 5, pressing the first enclosing guide pawl 162 against the flap guide plate 161. Alternatively, instead of the first enclosing guide pawl spring 169, the enclosing support 160 may employ a first biasing member that presses the first enclosing guide pawl 162 against the flap guide plate 161. Thus, the first enclosing guide pawl spring 169 is one example of the first biasing member.

The enclosing support 160 further includes a driving cam 170. The driving cam 170 is an eccentric cam or the like that rotates about a rotation shaft. An outer circumferential face of the driving cam 170 at a particular rotation angle contacts and lifts a lower face of the enclosing guide stay 164. The outer circumferential face of the driving cam 170 at another rotation angle separates from the lower face of the enclosing guide stay 164.

As the driving cam 170 rotates to the particular rotation angle and lifts a bottom face 1643 of the enclosing guide stay 164, the enclosing guide stay 164 pivots about the first enclosing guide pawl shaft 165 against a biasing force of the first enclosing guide pawl spring 169. When the driving cam 170 lifts the enclosing guide stay 164, the first enclosing guide pawl 162 separates from the flap guide plate 161.

When the driving cam 170 is not at the particular rotation angle and the outer circumferential face of the driving cam 170 separates from the bottom face 1643 of the enclosing guide stay 164, the enclosing guide stay 164 pivots about the first enclosing guide pawl shaft 165 by the biasing force of the first enclosing guide pawl spring 169.

When the driving cam 170 does not lift the enclosing guide stay 164, the second enclosing guide pawl 163 pivots in the pivot direction of the enclosing guide stay 164, pressing the first enclosing guide pawl 162 by the biasing force of the first enclosing guide pawl spring 169. The second enclosing guide pawl 163 brings the first enclosing guide pawl 162 into contact with the flap guide plate 161, pressing the first enclosing guide pawl 162 against the flap guide plate 161.

As the first enclosing guide pawl 162 and the second enclosing guide pawl 163 enter the mouth of the envelope E, the first enclosing guide pawl 162 and the second enclosing guide pawl 163 widen the mouth of the envelope E, which faces the enclosure that moves toward the envelope E. For example, as illustrated in FIG. 5, the first enclosing guide pawl 162 and the second enclosing guide pawl 163 include slopes 162*a* and 163*a*, respectively, that face the envelope conveyance path 1105 and are inclined with respect to the envelope conveyance path 1105. The two slopes 162*a* and 163*a* define a taper 1614 that tapers in the negative Z-direction. For example, the enclosing support 160 includes the taper 1614 that is tapered and oriented upstream in the envelope conveyance direction DE in which the envelope E is conveyed to the enclosing position. As the taper 1614 enters the mouth of the envelope E conveyed through the envelope conveyance path 1105 in the positive Z-direction, the taper 1614 widens the mouth of the envelope E, facilitating smooth enclosing of the enclosure into the envelope E.

As illustrated in FIG. 7, each of the first enclosing guide pawl 162 and the second enclosing guide pawl 163 is an elongate member in a width direction of the envelope conveyance path 1105 serving as a conveyance path through which the envelope E is conveyed. A dimension of each of the first enclosing guide pawl 162 and the second enclosing guide pawl 163 in a width direction thereof is greater than a width of the envelope conveyance path 1105. For example, each of the first enclosing guide pawl 162 and the second enclosing guide pawl 163 is made of the elongate member that has a width greater than a width of the envelope E and does not have side walls.

Referring to FIGS. 8 to 10, 11A, 11B, 11C, 11D, and 12 to 28, a description is provided of an example of a series of processes for enclosing and sealing, that is performed by the enclosing-sealing apparatus 100.

In the drawings, reference numerals and the like are assigned to elements used in the description of the series of processes for enclosing and sealing.

Figure 8:
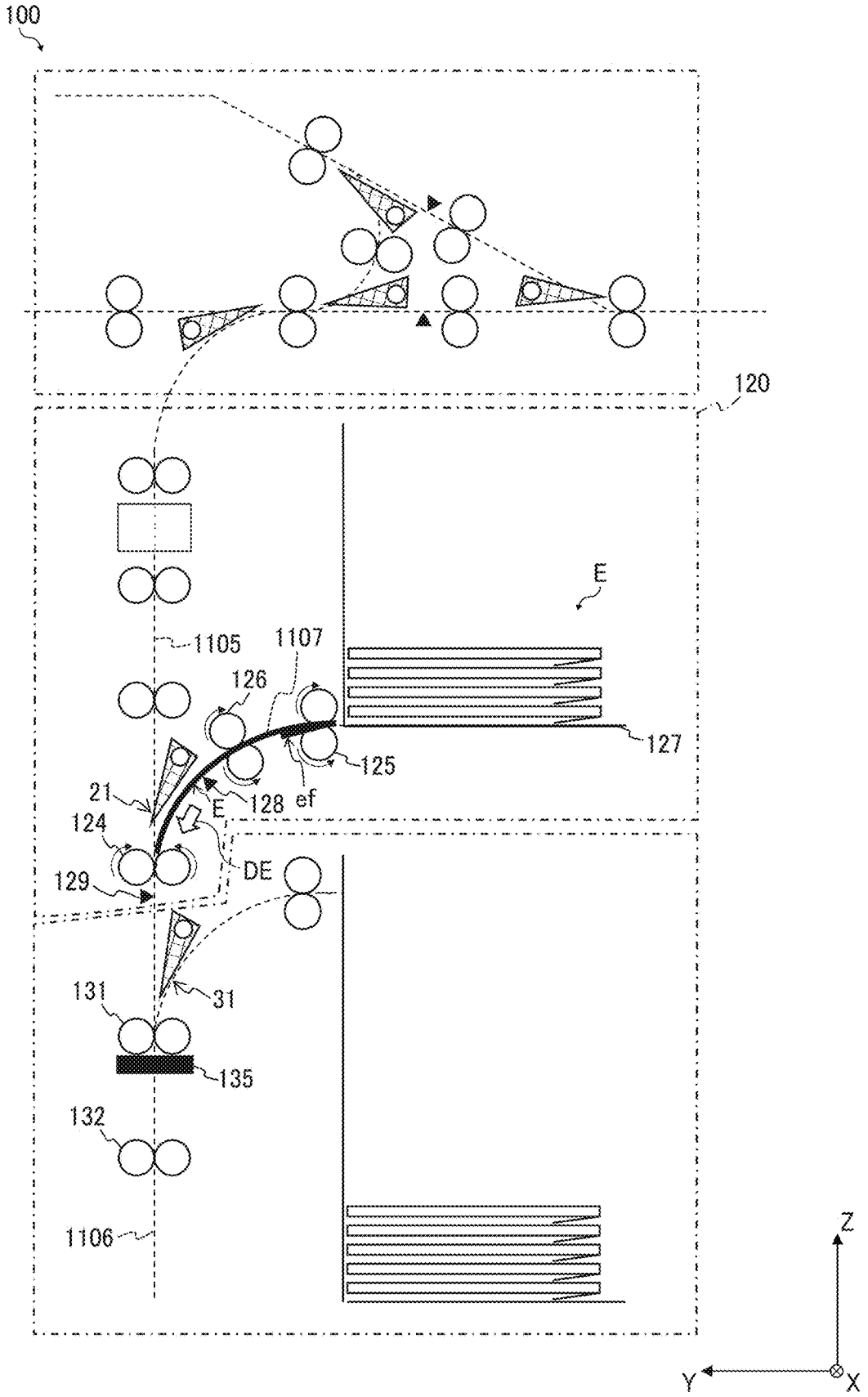
FIG. 8 is a cross-sectional view of the enclosing-sealing apparatus depicted in FIG. 3, illustrating one process for enclosing performed by the enclosing-sealing apparatus.

As illustrated in FIG. 8, as the envelope separating roller pair 125 rotates, the envelope separating roller pair 125 picks up and separates one envelope E from the plurality of envelopes E placed on the envelope tray 127 and feeds the separated envelope E to the envelope entry path 1107. The envelope conveyance roller pair 126 disposed in the envelope entry path 1107 conveys the separated envelope E to the flap opening roller pair 124.

The separation sensor 128 detects the leading end and the trailing end of the envelope E in the envelope conveyance direction DE. The enclosing-sealing controller 150 calculates the envelope length of the envelope E based on a detection result sent from the separation sensor 128 as described below.

When the envelope E is conveyed through the envelope entry path 1107, the envelope switchback switching pawl 21 is oriented in a direction in which the envelope switchback switching pawl 21 guides the envelope E from the envelope entry path 1107 to the envelope conveyance path 1105, as illustrated in FIG. 8. The envelope ejecting switching pawl 31 is oriented in a direction in which the envelope ejecting switching pawl 31 guides the envelope E from the envelope conveyance path 1105 to the sealing conveyance path 1106, as illustrated in FIG. 8.

The flap opening roller pair 124, the third vertical conveyance roller pair 131, and the fourth vertical conveyance roller pair 132 rotate in a direction to convey the envelope E in the negative Z-direction. Thus, the envelope E moves from the envelope entry path 1107 to the sealing conveyance path 1106 through the envelope conveyance path 1105.

Figure 9:
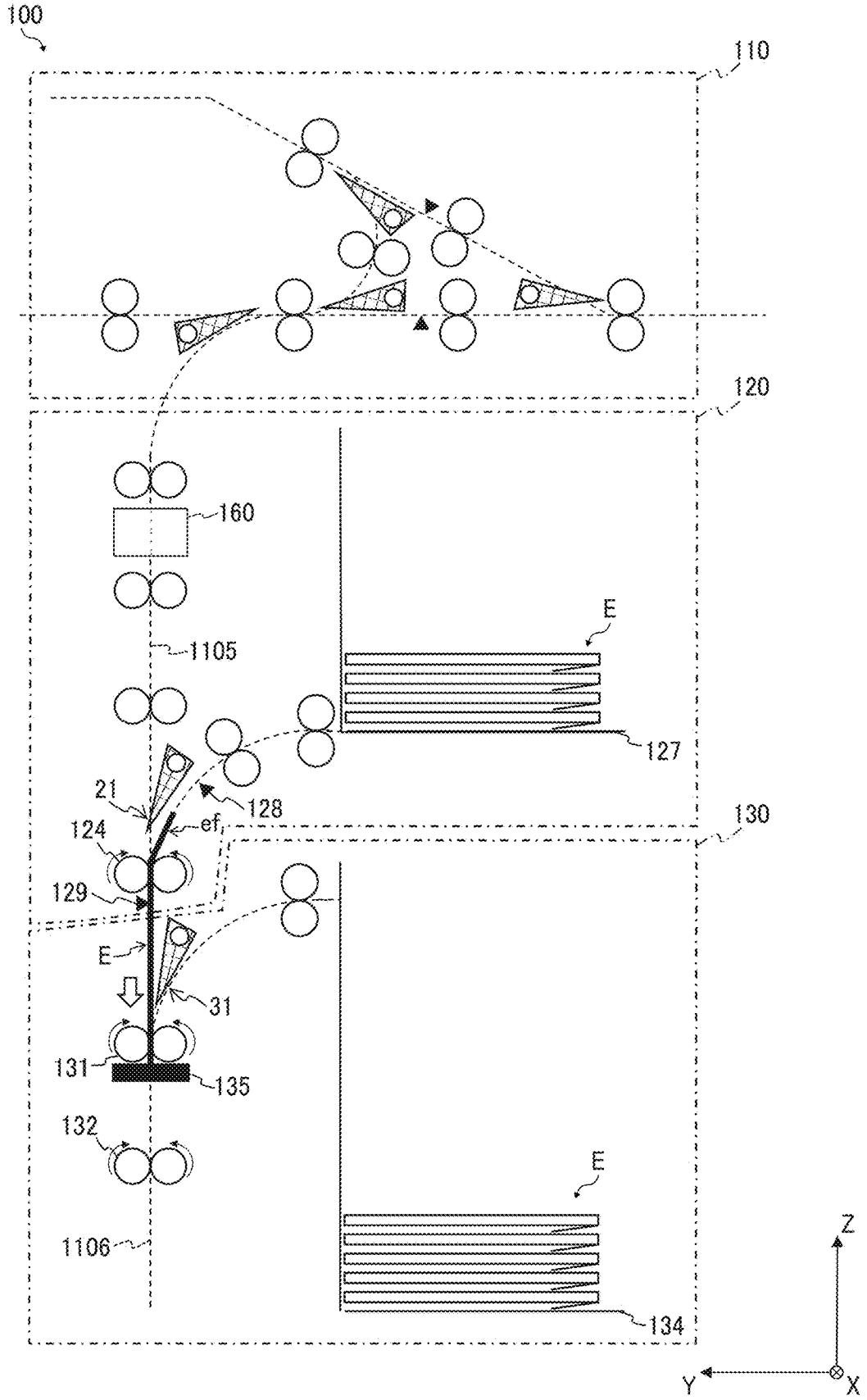
FIG. 9 is a cross-sectional view of the enclosing-sealing apparatus depicted in FIG. 3, illustrating another process for enclosing performed by the enclosing-sealing apparatus.

Subsequently, as illustrated in FIG. 9, while the envelope E passes through the flap opening roller pair 124, the flap ef of the envelope E opens. The flap opening roller pair 124, the third vertical conveyance roller pair 131, and the fourth vertical conveyance roller pair 132 continue rotating.

Figure 10:
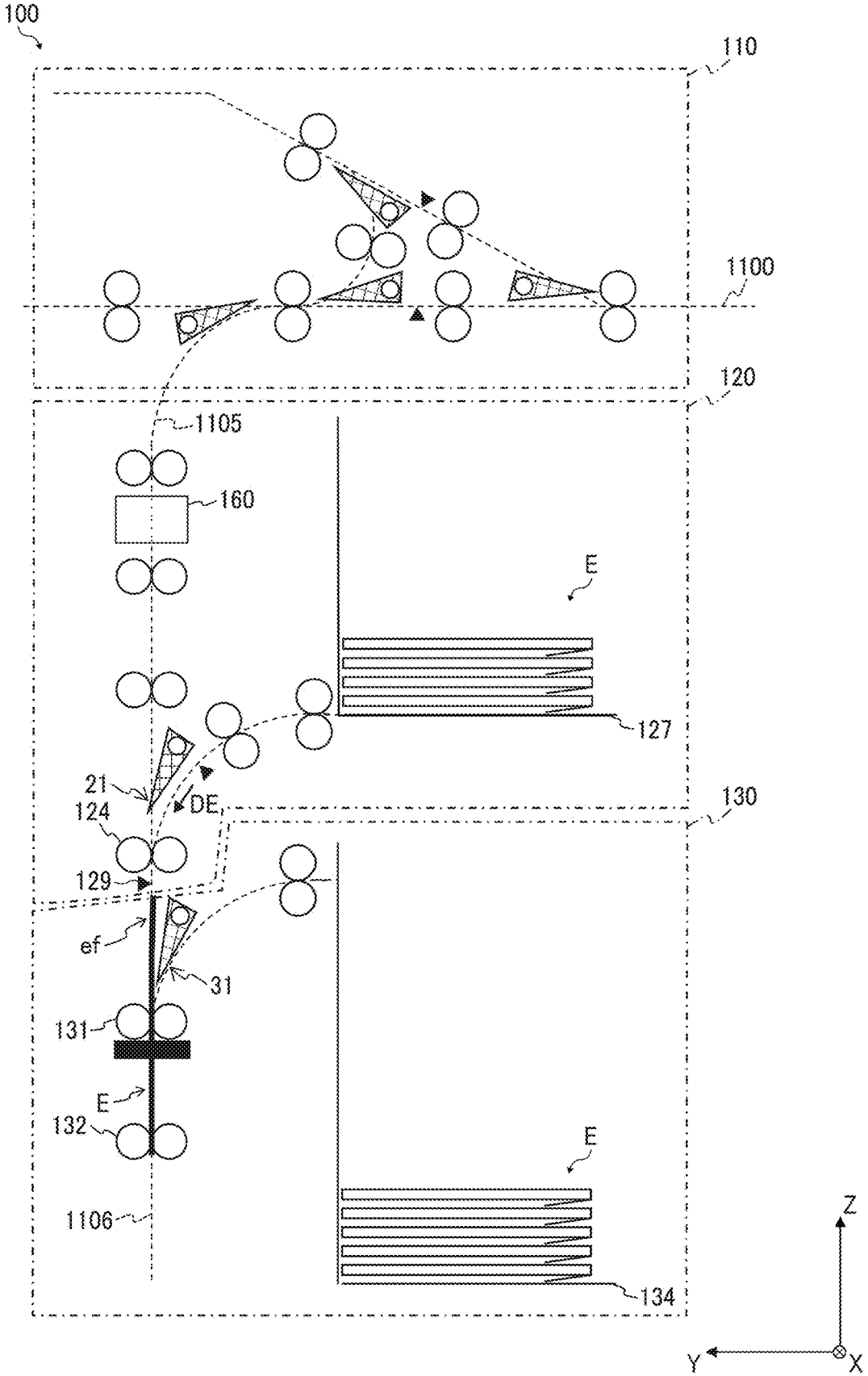
FIG. 10 is a cross-sectional view of the enclosing-sealing apparatus depicted in FIG. 3, illustrating yet another process for enclosing performed by the enclosing-sealing apparatus.

Thereafter, as illustrated in FIG. 10, when the end (e.g., a trailing end) of the flap ef in the envelope conveyance direction DE passes the flap opening detecting sensor 129, the flap opening roller pair 124, the third vertical conveyance roller pair 131, and the fourth vertical conveyance roller pair 132 interrupt rotation and are ready to switch back and convey the envelope E through the envelope conveyance path 1105.

Referring to FIGS. 11A, 11B, 11C, and 11D, a description is provided of an overview of operations of the flap opener 180 and calculation of the envelope length of the envelope E in conveyance of the envelope E depicted in FIGS. 8, 9, and 10.

Figure 11A:
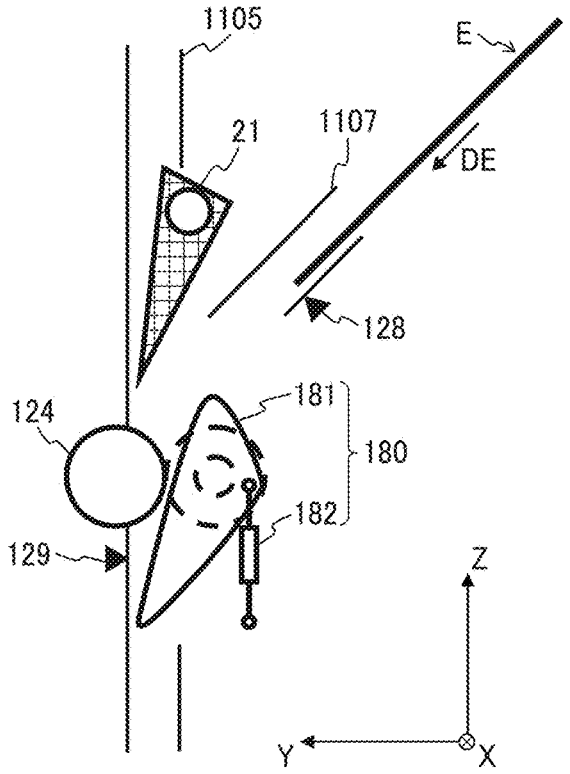
FIG. 11A is a cross-sectional view of the flap opener depicted in FIG. 4, illustrating a motion thereof during enclosing performed by the enclosing-sealing apparatus.

As illustrated in FIG. 11A, the separation sensor 128 detects the leading end of the envelope E conveyed toward the flap opening roller pair 124 in the envelope conveyance direction DE before the envelope E reaches a nip formed between two rollers constructing the flap opening roller pair 124.

Figure 11B:
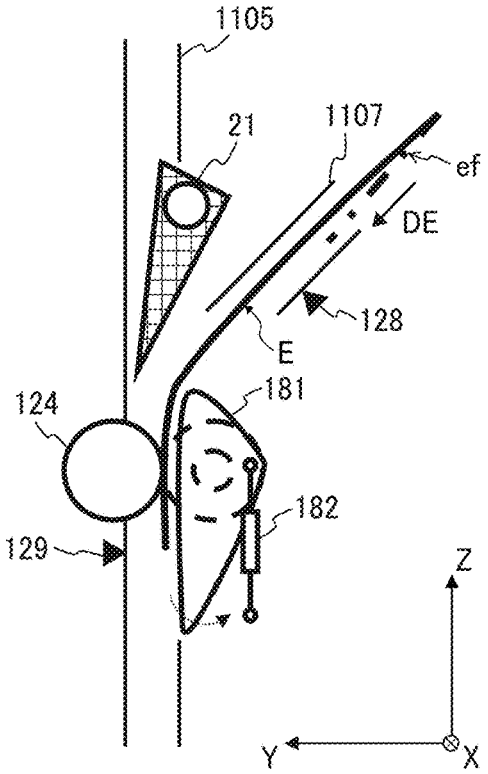
FIG. 11B is a cross-sectional view of the flap opener depicted in FIG. 11A, illustrating another motion thereof.

Subsequently, as illustrated in FIG. 11B, as the leading end of the envelope E in the envelope conveyance direction DE passes the nip of the flap opening roller pair 124 and moves in the negative Z-direction, the leading end of the envelope E in the envelope conveyance direction DE comes into contact with and presses against the flap scooping pawl 181 situated at the default position where the flap scooping pawl 181 blocks the envelope conveyance path 1105. The flap scooping pawl 181 pressed by the leading end of the envelope E in the envelope conveyance direction DE pivots, causing the envelope E to move through the envelope conveyance path 1105. Thus, the envelope E reaches the envelope conveyance path 1105.

Figure 11C:
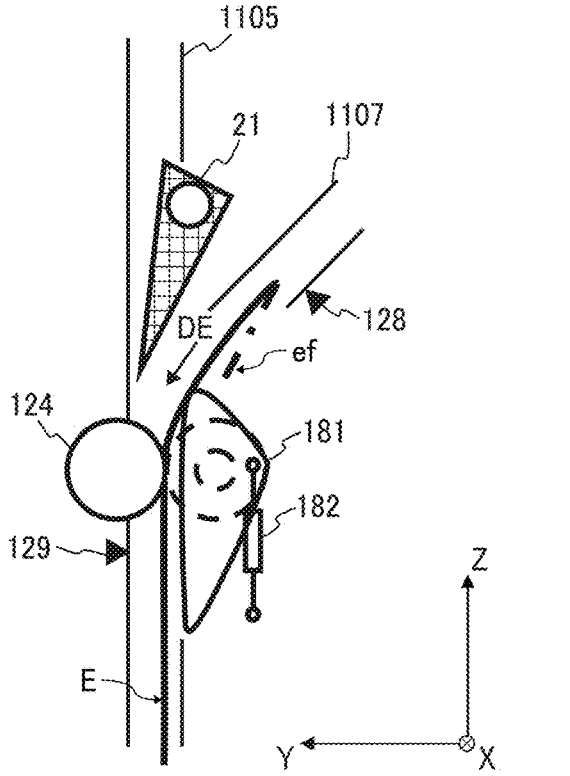
FIG. 11C is a cross-sectional view of the flap opener depicted in FIG. 11A, illustrating yet another motion thereof.

Before an entirety of the envelope E reaches the envelope conveyance path 1105, the separation sensor 128 also detects the trailing end of the envelope E in the envelope conveyance direction DE while the envelope E passes over the separation sensor 128, as illustrated in FIG. 11C. Accordingly, based on a time period that elapses after the separation sensor 128 detects the leading end of the envelope E until the separation sensor 128 detects the trailing end of the envelope E in the envelope conveyance direction DE (e.g., a time difference between a time at which the leading end of the envelope E is detected and a time at which the trailing end of the envelope E is detected), and a conveyance speed at which the envelope E is conveyed, a number of rotations of the envelope conveyance roller pair 126 depicted in FIG. 3, or the like, the enclosing-sealing controller 150 calculates the first envelope length as the envelope length of the envelope E in the close state in which the flap ef closes.

As the leading end of the envelope E in the envelope conveyance direction DE presses against and pivots the flap scooping pawl 181, a part of the flap scooping pawl 181, that is, the head of the flap scooping pawl 181, presses and lifts the envelope E conveyed through the envelope entry path 1107 slightly. Accordingly, the envelope E is bent slightly in the envelope entry path 1107. Consequently, the flap ef of the envelope E opens slightly. As the flap opening roller pair 124 farther conveys the envelope E in the open state in which the flap ef opens slightly, the end of the flap ef in the envelope conveyance direction DE engages the head of the flap scooping pawl 181.

Figure 11D:
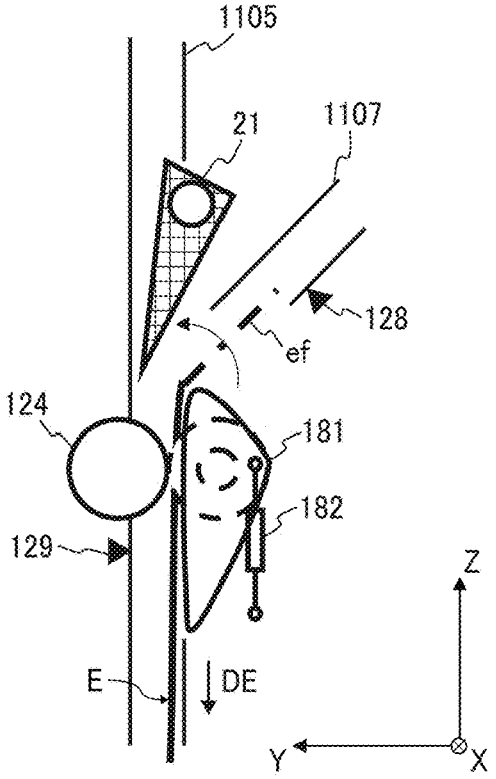
FIG. 11D is a cross-sectional view of the flap opener depicted in FIG. 11A, illustrating yet another motion thereof.

As the flap opening roller pair 124 conveys the envelope E even farther, as illustrated in FIG. 11D, the end of the flap ef in the envelope conveyance direction DE contacts the head of the flap scooping pawl 181. The flap ef pivots and opens as the envelope E is conveyed. The flap opening roller pair 124 farther conveys the envelope E in the envelope conveyance direction DE in the open state in which the flap ef opens. Subsequently, the envelope E illustrated in FIG. 11D moves to a position illustrated in FIG. 10.

Figure 12:
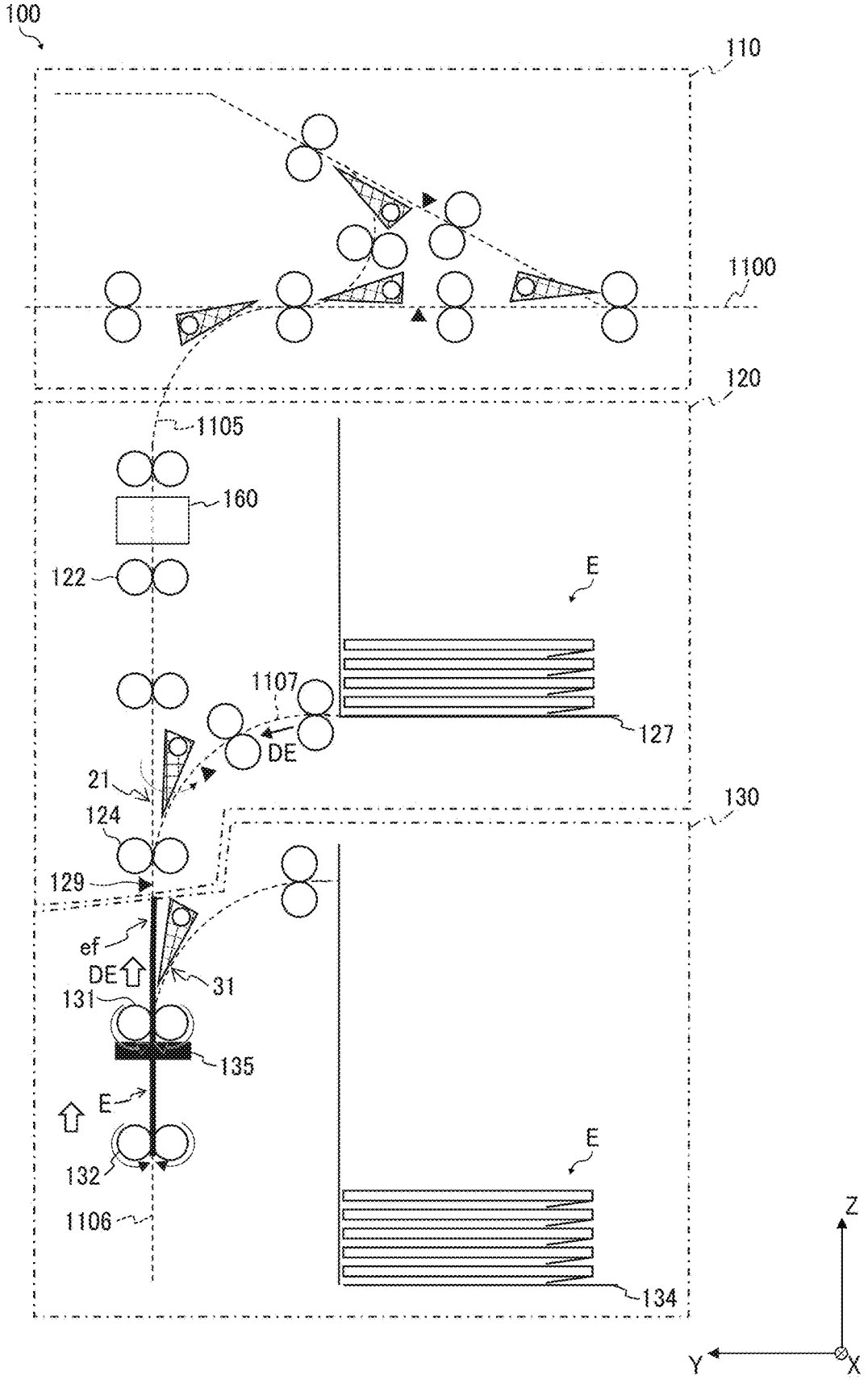
FIG. 12 is a cross-sectional view of the enclosing-sealing apparatus depicted in FIG. 3, illustrating yet another process for enclosing performed by the enclosing-sealing apparatus.

Subsequently to FIG. 10, as illustrated in FIG. 12, after the flap ef of the envelope E opens and the flap ef is past the flap opening roller pair 124, the third vertical conveyance roller pair 131 and the fourth vertical conveyance roller pair 132 rotate backward, thus conveying the envelope E through the sealing conveyance path 1106 and the envelope conveyance path 1105 in the positive Z-direction. Thus, the envelope E is conveyed with switchback conveyance. Before switchback conveyance of the envelope E starts or simultaneously with switchback conveyance, the envelope switchback switching pawl 21 pivots in a direction illustrated with an arrow in FIG. 12. Accordingly, the envelope switchback switching pawl 21 allows the envelope E to be conveyed upward in FIG. 12 through the envelope conveyance path 1105.

Subsequently, the envelope E depicted in FIG. 12 is conveyed with switchback conveyance to the enclosing position as the predetermined position in the enclosing device 120. Before the envelope E reaches the enclosing position, the flap opening detecting sensor 129 detects the end (e.g., the trailing end when the envelope E is conveyed in the envelope conveyance direction DE through the envelope entry path 1107 as illustrated in FIG. 8) of the opened flap ef of the envelope E in the envelope conveyance direction DE while the envelope E is switched back and conveyed in the envelope conveyance direction DE. Subsequently, while the envelope E is conveyed with switchback conveyance, the flap opening detecting sensor 129 detects the bottom of the envelope E, that is, the leading end of the envelope E when the envelope E is conveyed in the envelope conveyance direction DE through the envelope entry path 1107 as illustrated in FIG. 8. While the envelope E is conveyed with switchback conveyance, the end of the flap ef is the leading end of the envelope E in the envelope conveyance direction DE. However, for consistency, also in a description below, the end of the flap ef is mentioned as the trailing end of the envelope E or the flap ef in the envelope conveyance direction DE regardless of the moving direction (e.g., the conveyance direction) of the envelope E during switchback conveyance. Similarly, the bottom of the envelope E is mentioned as the leading end of the envelope E in the envelope conveyance direction DE.

Accordingly, before the flap ef reaches the first vertical conveyance roller pair 122, the flap opening detecting sensor 129 detects the end of the flap ef (e.g., the trailing end of the envelope E) and the bottom (e.g., the leading end) of the envelope E in the envelope conveyance direction DE. According to a detection result sent from the flap opening detecting sensor 129, based on a time period that elapses after the flap opening detecting sensor 129 detects the trailing end of the envelope E (e.g., the end of the flap ef) in the envelope conveyance direction DE until the flap opening detecting sensor 129 detects the leading end of the envelope E (e.g., the bottom of the envelope E) in the envelope conveyance direction DE, and a conveyance speed at which the envelope E is conveyed or a number of rotations of the third vertical conveyance roller pair 131 and the fourth vertical conveyance roller pair 132, the enclosing-sealing controller 150 also calculates the second envelope length as the envelope length of the envelope E in the open state in which the flap ef opens.

The enclosing-sealing controller 150 subtracts the envelope length (e.g., the first envelope length) of the envelope E in the close state in which the flap ef closes from the envelope length (e.g., the second envelope length) of the envelope E in the open state in which the flap ef opens, thus calculating the length of the flap ef (e.g., the flap length).

Figure 13:
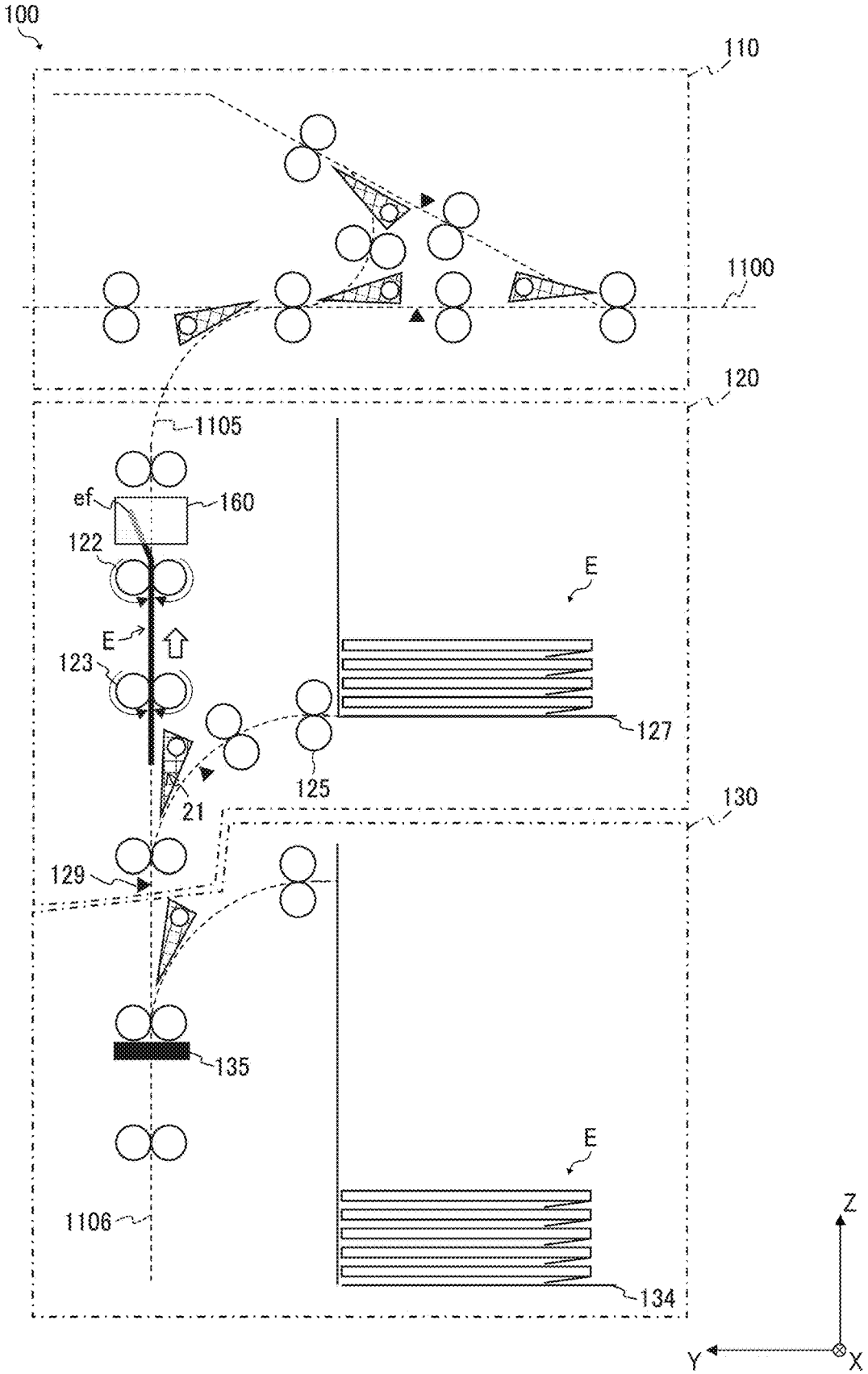
FIG. 13 is a cross-sectional view of the enclosing-sealing apparatus depicted in FIG. 3, illustrating yet another process for enclosing performed by the enclosing-sealing apparatus.

Subsequently, as illustrated in FIG. 13, the second vertical conveyance roller pair 123 and the first vertical conveyance roller pair 122 convey the envelope E to the enclosing position determined based on the flap length. When the flap ef reaches a past position where the flap ef is past the first vertical conveyance roller pair 122, that is, the enclosing position determined based on the flap length, the second vertical conveyance roller pair 123 and the first vertical conveyance roller pair 122 interrupt rotation. Thus, the envelope E starts waiting for the enclosure to be inserted into the envelope E.

In a control in which the enclosing-sealing controller 150 controls each conveyance roller pair to convey the envelope E to a standby position where the envelope E starts waiting for the enclosure to be inserted into the envelope E, after the envelope separating roller pair 125 picks up the envelope E, the enclosing-sealing controller 150 calculates a conveyance amount of the envelope E based on a rotation amount (e.g., a number of rotations) of each conveyance roller pair. The enclosing-sealing controller 150 determines a position of the envelope E in the envelope conveyance path 1105 based on the conveyance amount of the envelope E and a length of each conveyance path.

Referring to FIGS. 14 to 20, a description is provided of enclosing support operations of the enclosing support 160 until the first vertical conveyance roller pair 122 holds the envelope E with the opened flap ef such that the envelope E is ready to receive the enclosure as illustrated in FIG. 13.

Figure 14:
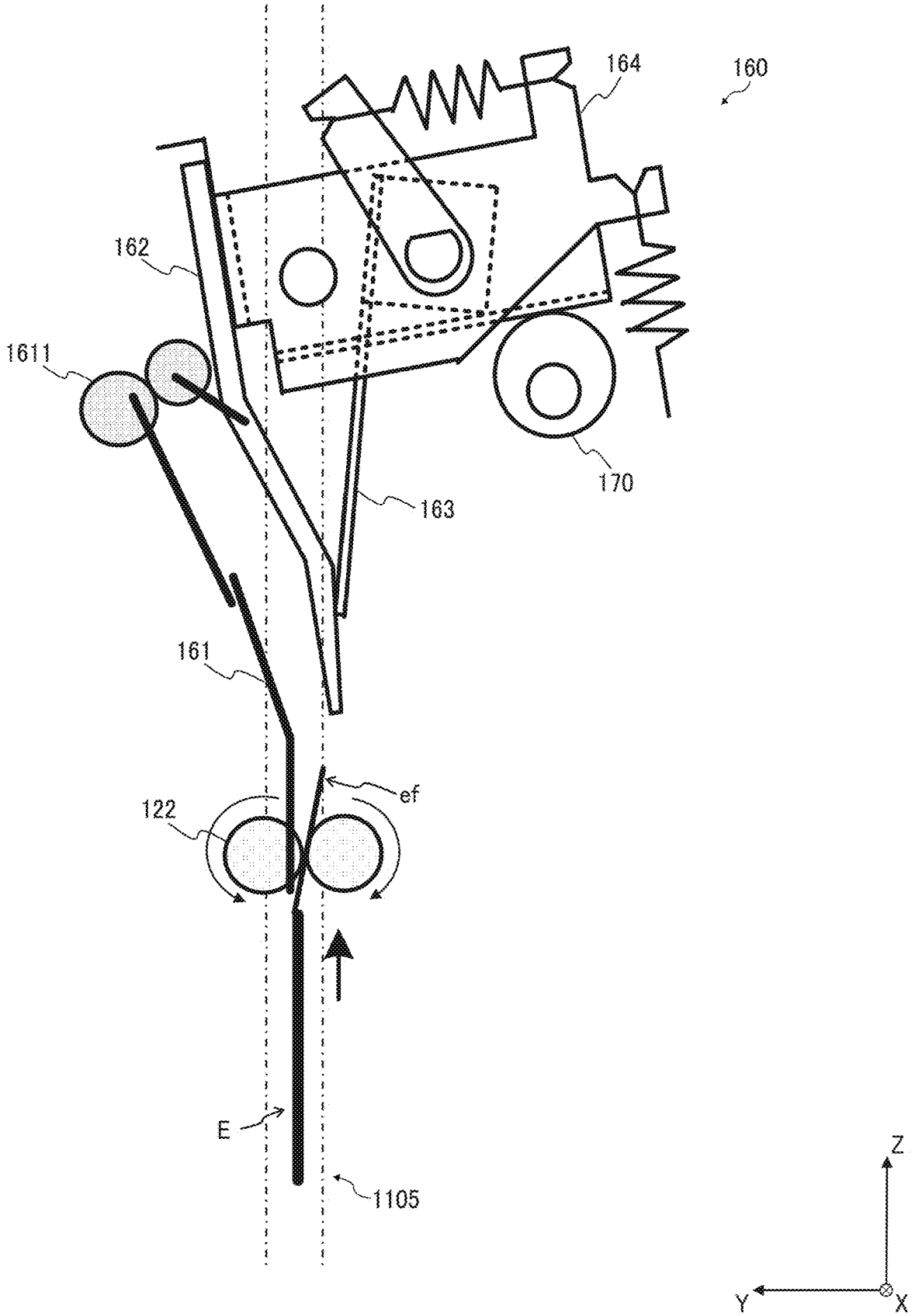
FIG. 14 is a cross-sectional view of the enclosing support according to the first embodiment depicted in FIG. 5, illustrating a motion thereof.

FIG. 14 illustrates the envelope E that is conveyed through the envelope conveyance path 1105 in the positive Z-direction and reaches the first vertical conveyance roller pair 122. The driving cam 170 lifts the enclosing guide stay 164. A front end of the first enclosing guide pawl 162 separates from the flap guide plate 161.

Figure 15:
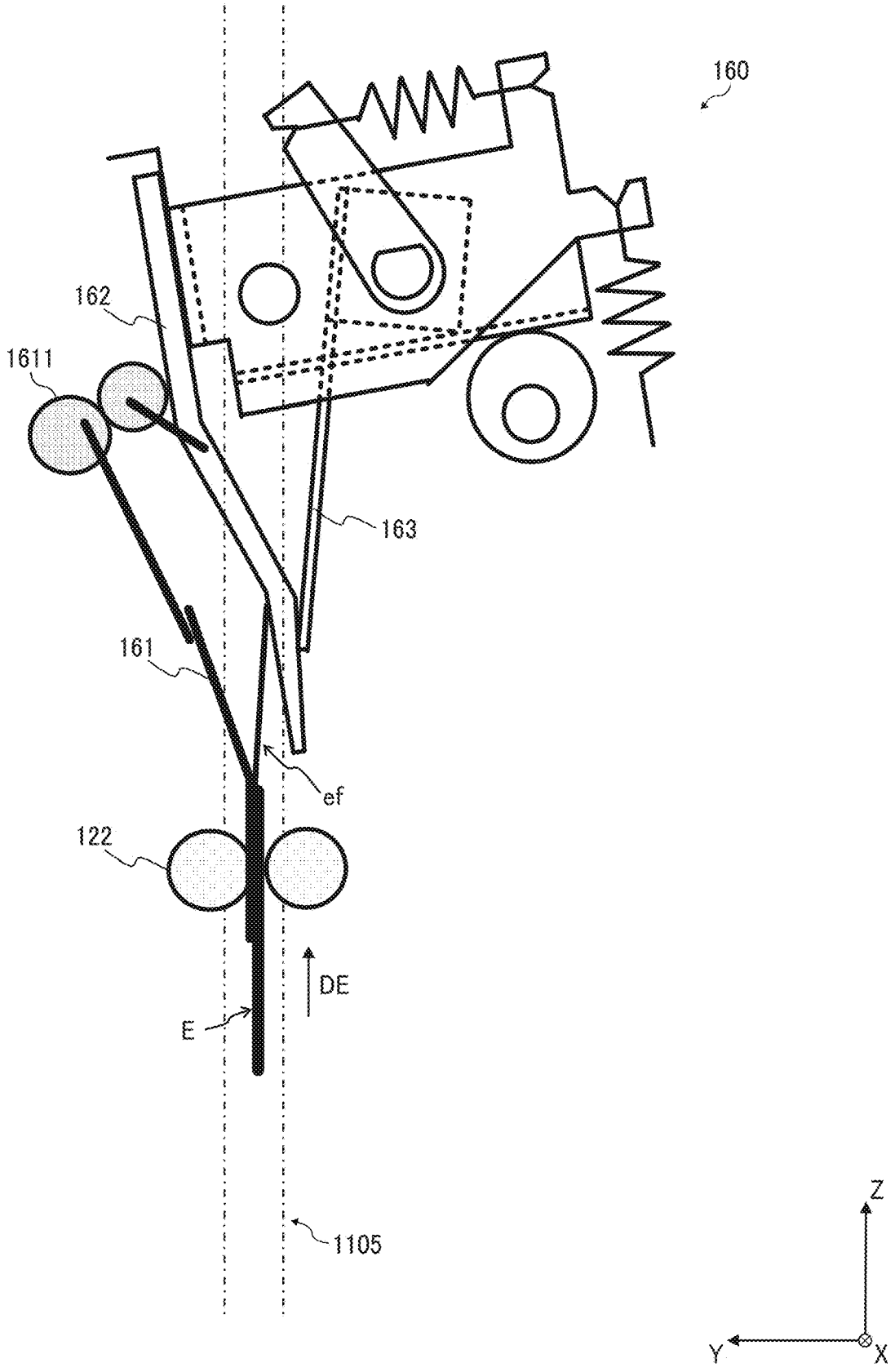
FIG. 15 is a cross-sectional view of the enclosing support according to the first embodiment depicted in FIG. 5, illustrating another motion thereof.

Subsequently, as illustrated in FIG. 15, when the envelope E is conveyed and the flap ef of the envelope E reaches a past position that is past the front end of the first enclosing guide pawl 162 in the positive Z-direction, that is, when the leading end of the flap ef reaches a predetermined position that is past the front end of the first enclosing guide pawl 162 in the envelope conveyance direction DE, the enclosing-sealing controller 150 interrupts conveyance of the envelope E. The enclosing-sealing controller 150 controls each conveyance roller pair to interrupt rotation and conveyance of the envelope E based on the flap length that has already been calculated and a rotation amount (e.g., a number of rotations) of each conveyance roller pair that has rotated to convey the envelope E through the envelope conveyance path 1105. For example, the enclosing-sealing controller 150 controls each conveyance roller pair to interrupt rotation based on a conveyance speed of the envelope E and a distance for which the envelope E moves until the envelope E reaches a halt position, that is calculated based on the flap length.

Figure 16:
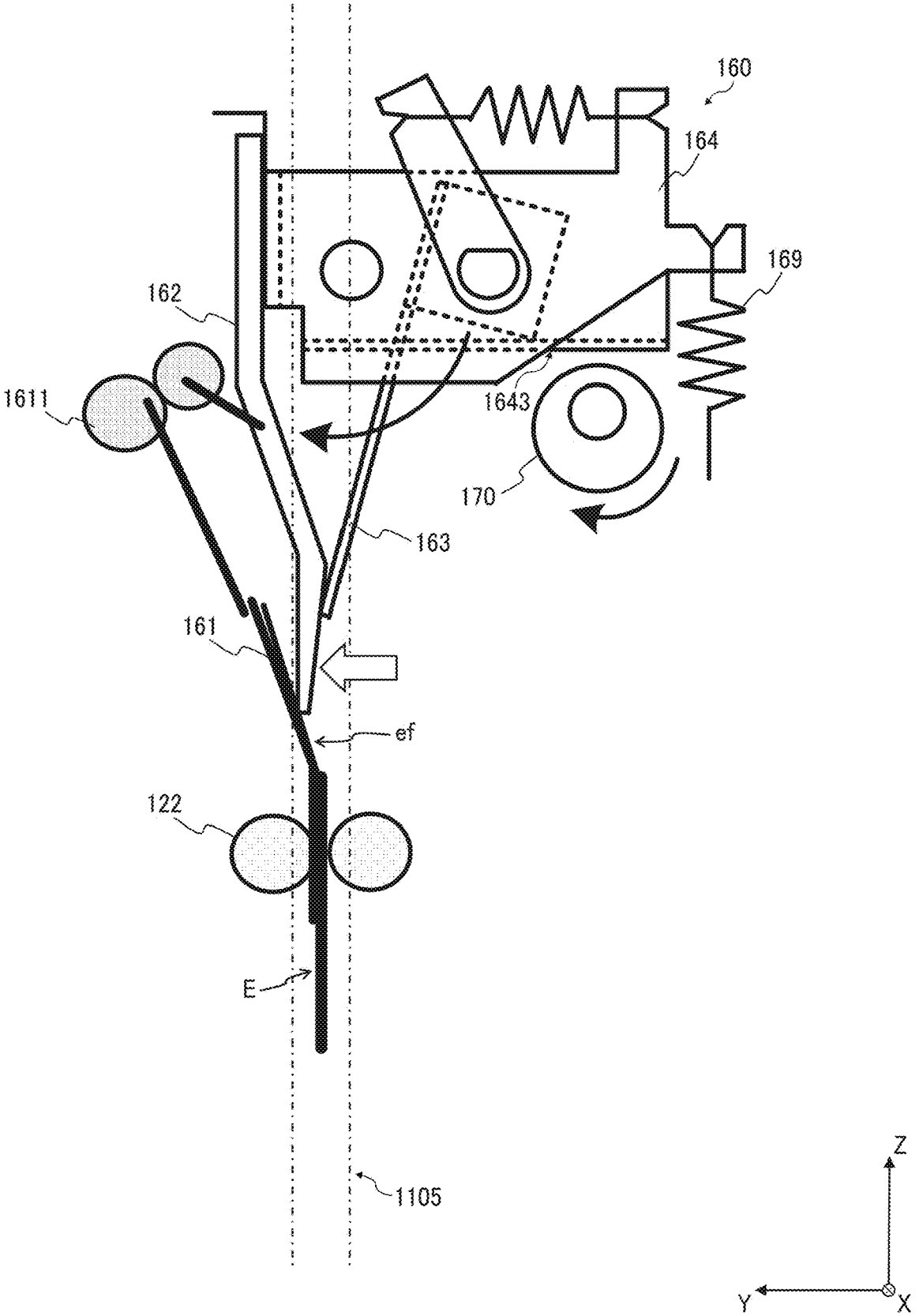
FIG. 16 is a cross-sectional view of the enclosing support according to the first embodiment depicted in FIG. 5, illustrating yet another motion thereof.

Subsequently, as illustrated in FIG. 16, the driving cam 170 rotates by a particular rotation angle. Accordingly, the outer circumferential face of the driving cam 170 separates from the bottom face 1643 of the enclosing guide stay 164. Consequently, the biasing force of the first enclosing guide pawl spring 169 pivots the enclosing guide stay 164. The enclosing guide stay 164 presses the front end of the first enclosing guide pawl 162 against the flap guide plate 161. The front end of the first enclosing guide pawl 162 and the flap guide plate 161 sandwich the flap ef.

For example, when the envelope E reaches the predetermined position where the flap ef overlaps the front end of the first enclosing guide pawl 162, the first enclosing guide pawl 162 orients the flap ef to the flap guide plate 161.

Figure 17:
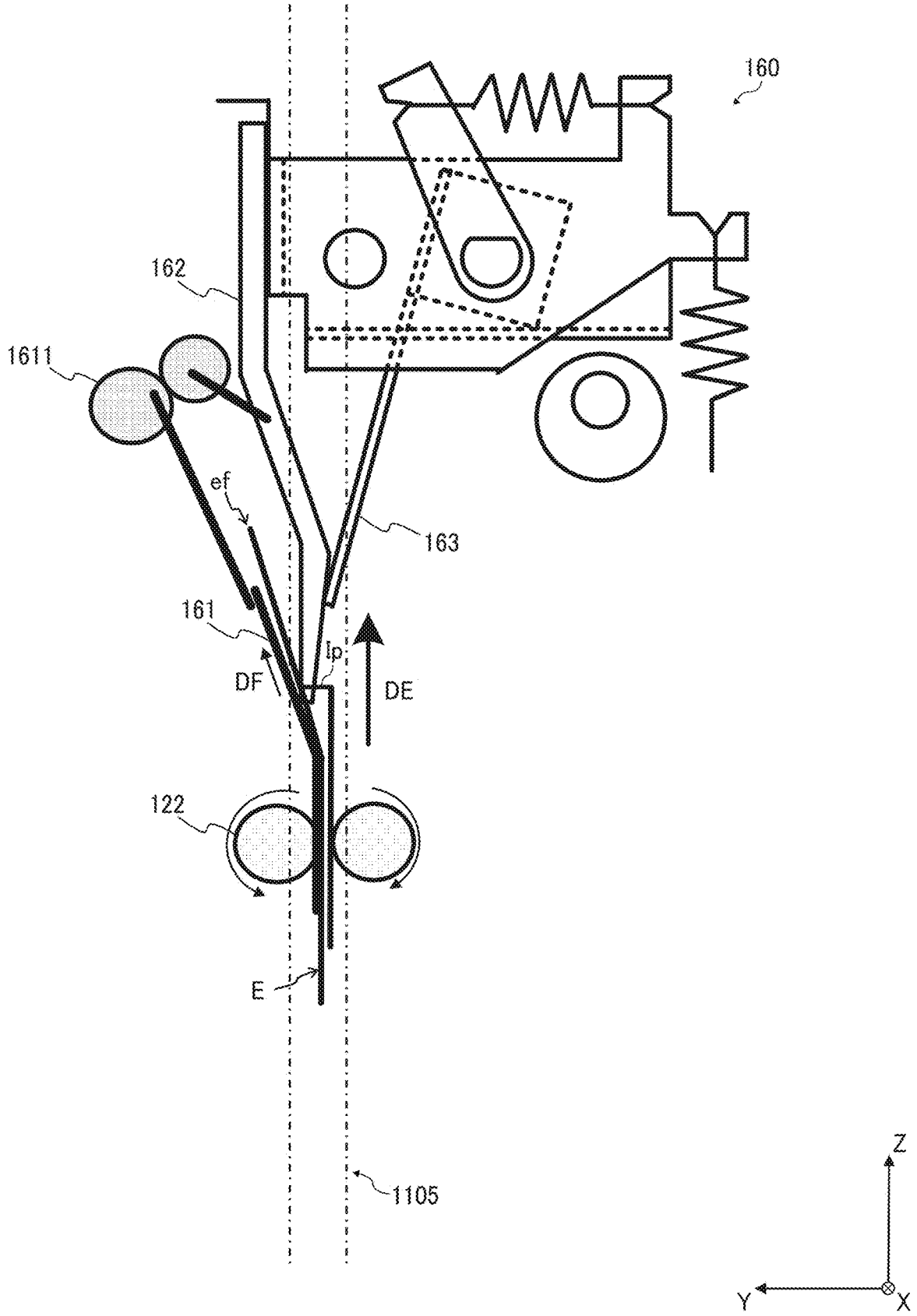
FIG. 17 is a cross-sectional view of the enclosing support according to the first embodiment depicted in FIG. 5, illustrating yet another motion thereof.

Subsequently, as illustrated in FIG. 17, the first vertical conveyance roller pair 122 and the like resume rotation, conveying the envelope E in the positive Z-direction. The first vertical conveyance roller pair 122 conveys the envelope E against a biasing force from the first enclosing guide pawl 162. The front end of the first enclosing guide pawl 162 enters a mouth Ip (e.g., an opening) of the envelope E. The first vertical conveyance roller pair 122 conveys the envelope E while the first enclosing guide pawl 162 presses the flap ef against the flap guide plate 161. Hence, the flap ef is conveyed in the flap conveyance direction DF different from the envelope conveyance direction DE in which the mouth Ip of the envelope E is conveyed. As a result, as the flap ef is conveyed, the envelope E deforms slightly, widening the mouth Ip. The first enclosing guide pawl 162 enters the widened mouth Ip of the envelope E.

Figure 18:
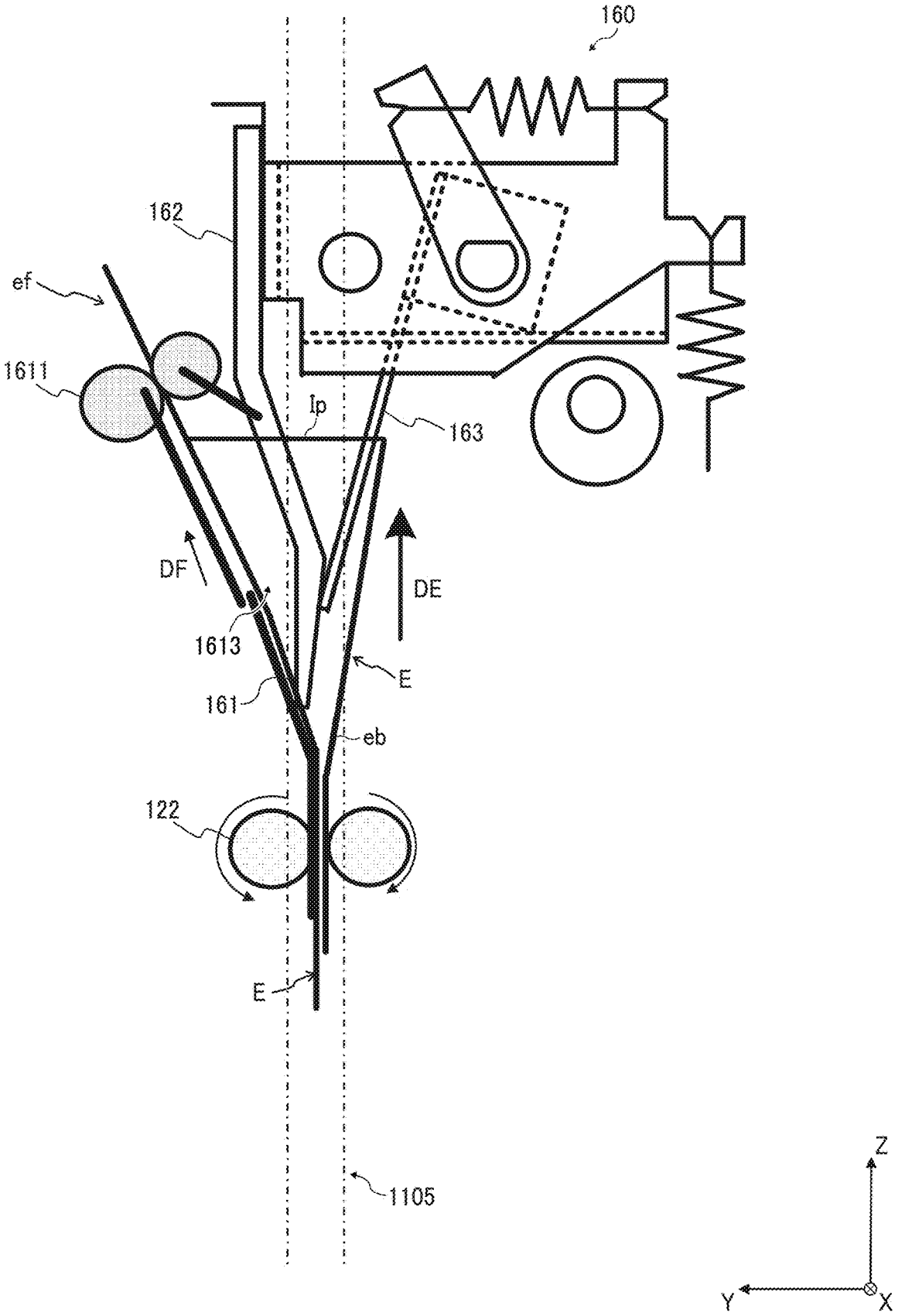
FIG. 18 is a cross-sectional view of the enclosing support according to the first embodiment depicted in FIG. 5, illustrating yet another motion thereof.

Subsequently, as illustrated in FIG. 18, as the first vertical conveyance roller pair 122 rotates and conveys the envelope E in the positive Z-direction farther, the first enclosing guide pawl 162 is inserted deep into the envelope E. When the envelope E reaches the enclosing position, the first vertical conveyance roller pair 122 interrupts rotation, interrupting conveyance of the envelope E.

The first enclosing guide pawl 162 and the second enclosing guide pawl 163 biased against the first enclosing guide pawl 162 are situated inside the envelope E. The flap ef is conveyed through the flap conveyance path 1613 defined by the flap guide plate 161 to a holding position where the flap holding roller pair 1611 holds the flap ef. A body eb of the envelope E is conveyed through the envelope conveyance path 1105 in the envelope conveyance direction DE different from the flap conveyance direction DF in which the flap ef is conveyed through the flap conveyance path 1613. As a result, the mouth Ip of the envelope E widens along an outer slope of the second enclosing guide pawl 163 to an outside of the envelope conveyance path 1105.

The envelope conveyance path 1105 illustrated successively from FIG. 14 to FIG. 18 is conceptually illustrated as a space where the envelope E is conveyed. For example, a width and the like of the envelope conveyance path 1105 depicted in FIGS. 14 to 18 do not indicate a dimension of the envelope conveyance path 1105 precisely. The envelope E and the flap ef thereof move in the space inside the envelope conveyance path 1105. The envelope E does not break a wall of the envelope conveyance path 1105 and does not move to the outside of the envelope conveyance path 1105.

While the envelope E moves from a position illustrated in FIG. 17 to a position illustrated in FIG. 18, the mouth Ip of the envelope E passes the front end of the second enclosing guide pawl 163. Hence, the front end of the second enclosing guide pawl 163 has a structure that does not catch or hook the mouth Ip of the envelope E. For example, the front end of the second enclosing guide pawl 163 overlaps a body of the first enclosing guide pawl 162. Alternatively, in order to prevent the second enclosing guide pawl 163 from catching or hooking the mouth Ip of the envelope E, a scooping rib or the like may be mounted on the first enclosing guide pawl 162 and may contact the front end of the second enclosing guide pawl 163. Thus, the mouth Ip of the envelope E evades the front end of the second enclosing guide pawl 163.

A description is provided of a continuation of the series of processes for enclosing and sealing.

Figure 19:
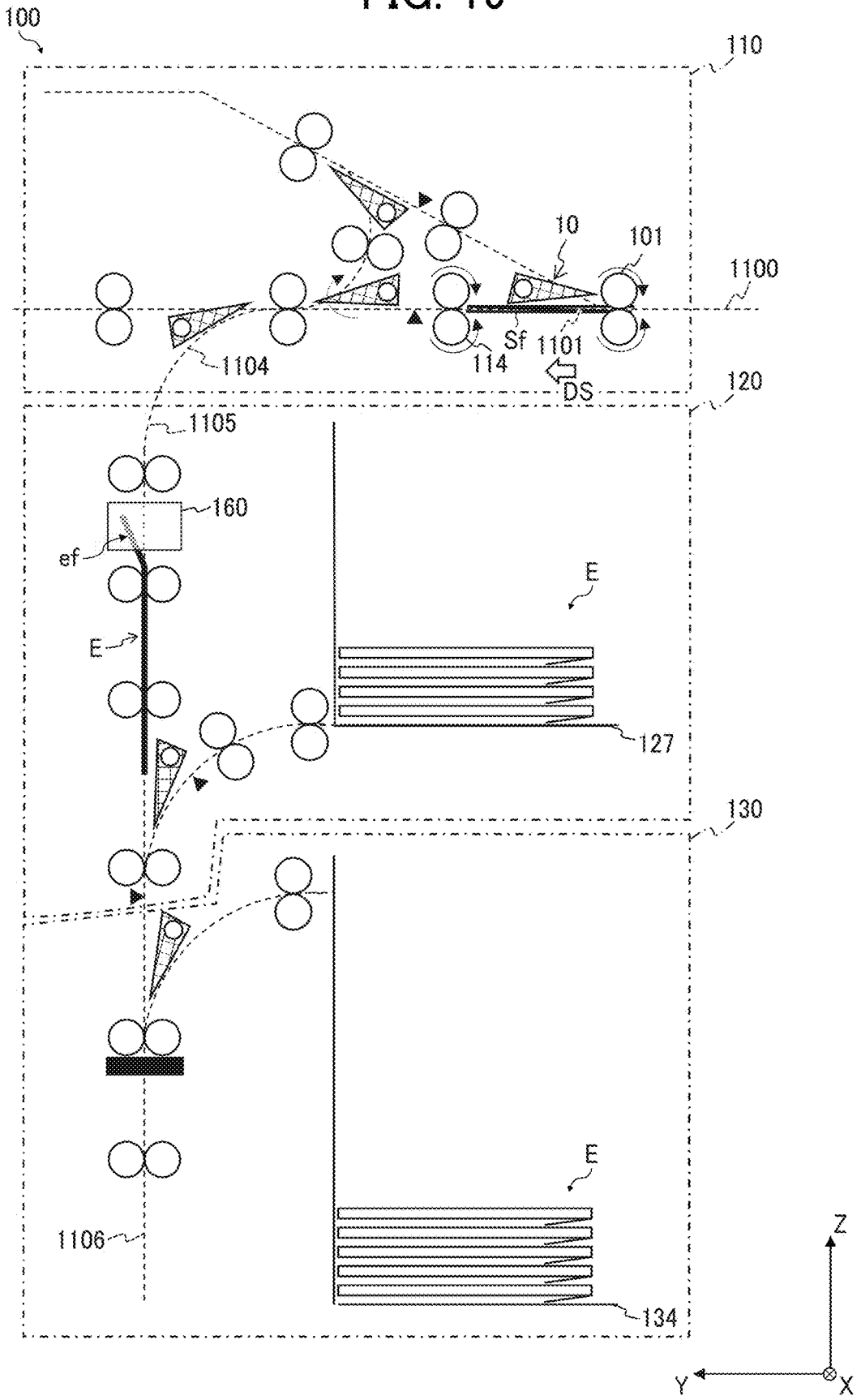
FIG. 19 is a cross-sectional view of the enclosing-sealing apparatus depicted in FIG. 3, illustrating yet another process for enclosing performed by the enclosing-sealing apparatus.

FIG. 18 illustrates the envelope E in an enclosing standby state in which the envelope E reaches the enclosing position and waits for the enclosure to be inserted into the envelope E. FIG. 19 illustrates the envelope E situated at the standby position in the enclosing standby state. As illustrated in FIG. 19, while the envelope E is in the enclosing standby state at the enclosing position, that is, the standby position, the entry roller pair 101 of the enclosing-sealing apparatus 100 receives the folded sheet Sf ejected from the upstream apparatus (e.g., the folding apparatus 300) disposed upstream from the enclosing-sealing apparatus 100 in the sheet conveyance direction DS. The entry roller pair 101 conveys the folded sheet Sf to the first conveyance path 1101.

Figure 20:
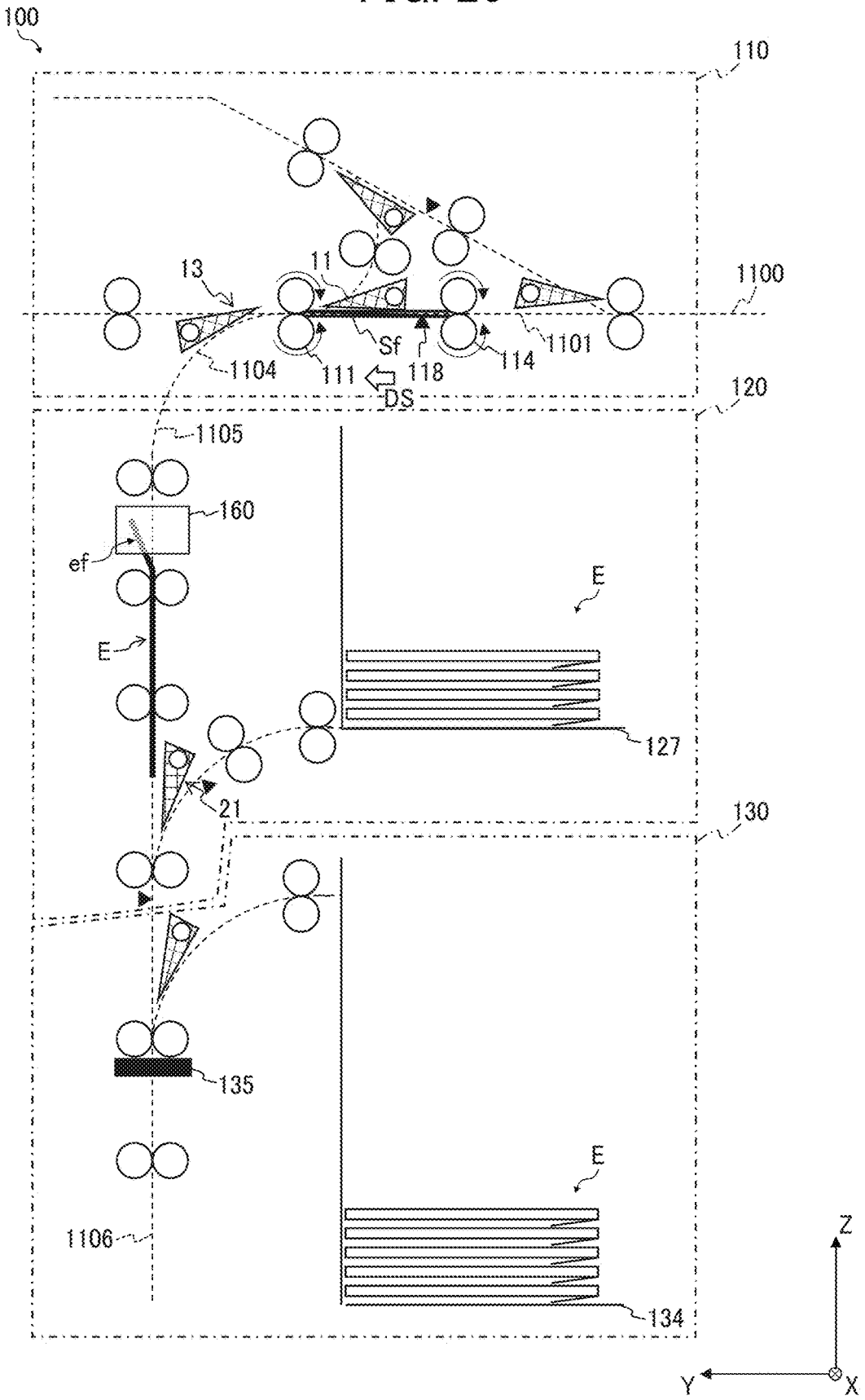
FIG. 20 is a cross-sectional view of the enclosing-sealing apparatus depicted in FIG. 3, illustrating yet another process for enclosing performed by the enclosing-sealing apparatus.

Subsequently, as illustrated in FIG. 20, the first intermediate conveyance roller pair 114 and the first conveyance roller pair 111 convey the folded sheet Sf downstream in the sheet conveyance direction DS. The first switching pawl 11 and the third switching pawl 13 are positioned as illustrated in FIG. 20, guiding the folded sheet Sf from the first conveyance path 1101 to the enclosing conveyance path 1104.

Figure 21:
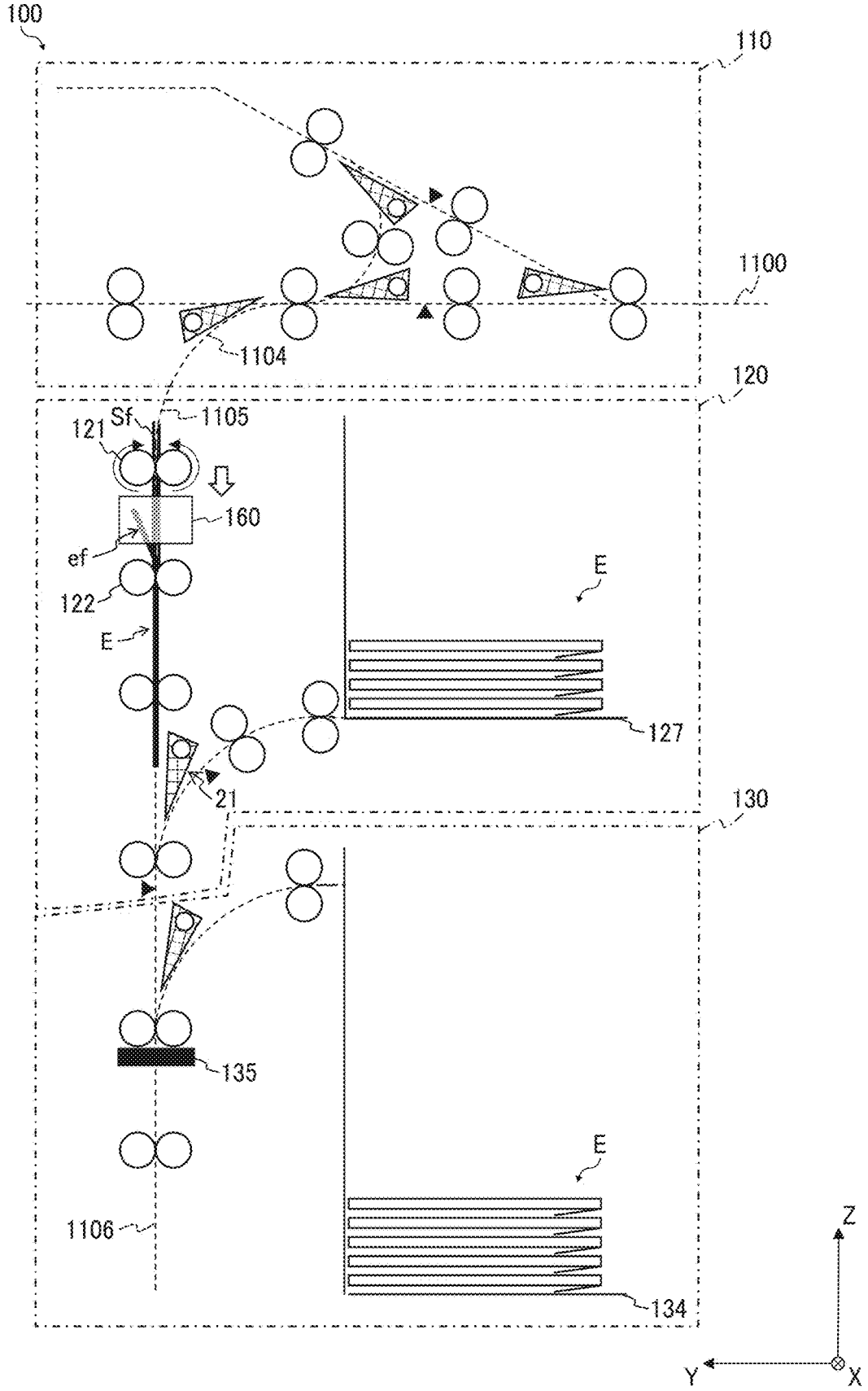
FIG. 21 is a cross-sectional view of the enclosing-sealing apparatus depicted in FIG. 3, illustrating yet another process for enclosing performed by the enclosing-sealing apparatus.

Thereafter, as illustrated in FIG. 21, the enclosing roller pair 121 conveys the folded sheet Sf conveyed from the enclosing conveyance path 1104 to the envelope conveyance path 1105 farther in the negative Z-direction. As a result, the first vertical conveyance roller pair 122 and the like hold the folded sheet Sf at the predetermined enclosing position in the envelope conveyance path 1105. The folded sheet Sf is inserted into the envelope E in the enclosing standby state.

Figure 22:
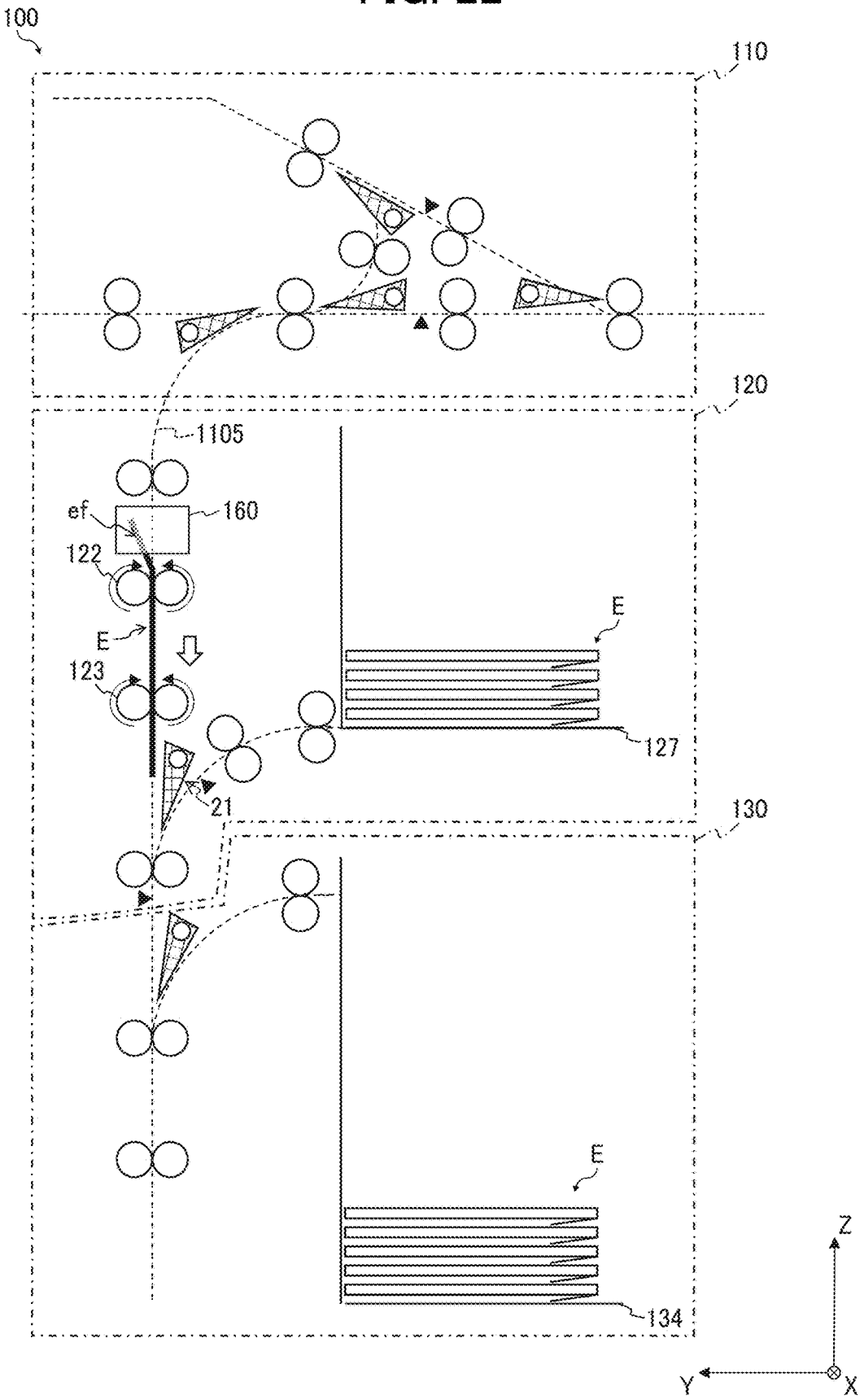
FIG. 22 is a cross-sectional view of the enclosing-sealing apparatus depicted in FIG. 3, illustrating yet another process for enclosing performed by the enclosing-sealing apparatus.
Figure 25:
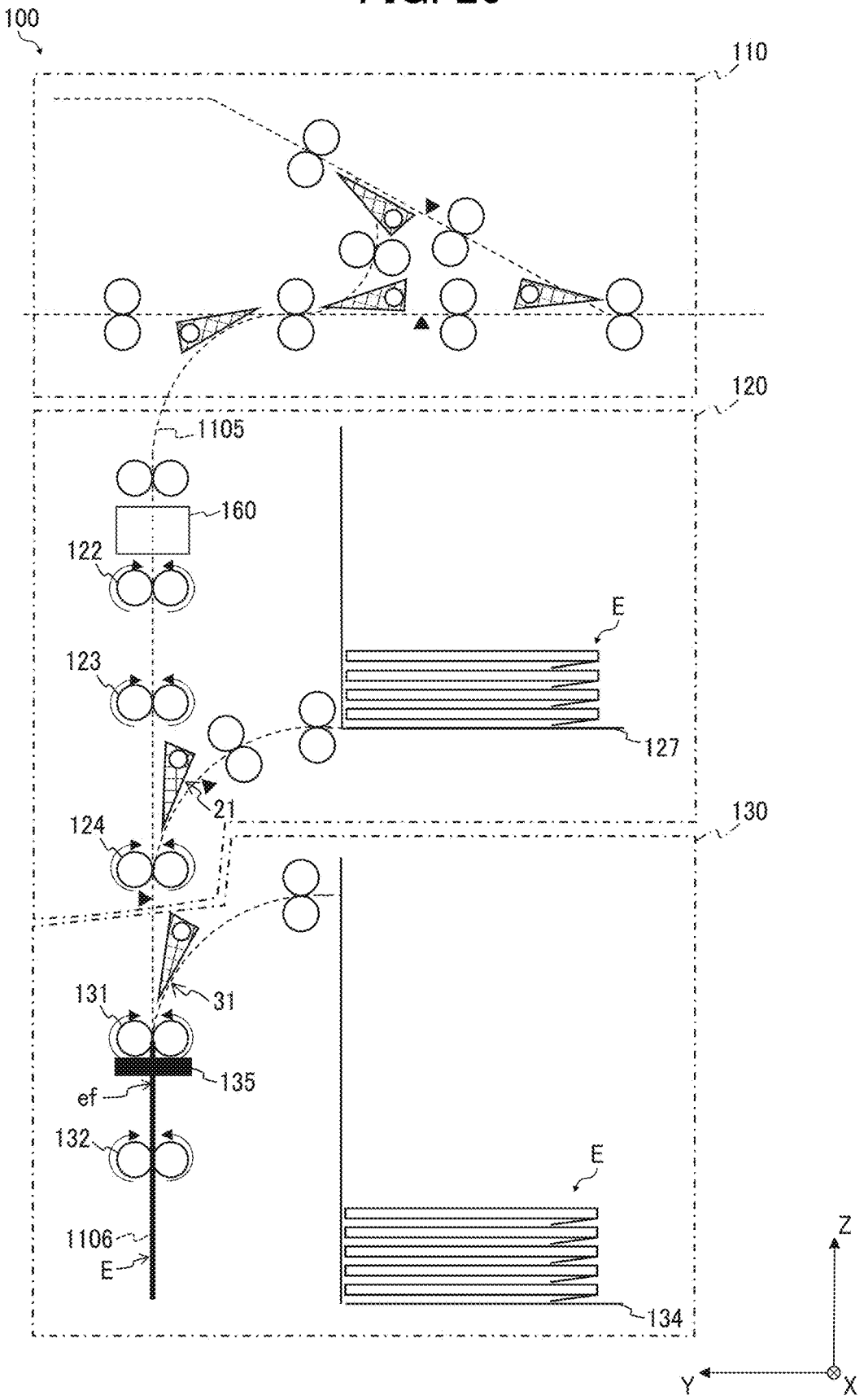
FIG. 25 is a cross-sectional view of the enclosing-sealing apparatus depicted in FIG. 3, illustrating yet another process for enclosing performed by the enclosing-sealing apparatus.

Thereafter, as illustrated in FIG. 22, the first vertical conveyance roller pair 122 and the second vertical conveyance roller pair 123 rotate, conveying the envelope E downward to the fourth vertical conveyance roller pair 132 as illustrated in FIG. 25. The envelope E enclosed with the folded sheet Sf is conveyed to a past position where the flap ef is past the envelope ejecting switching pawl 31.

A description is provided of a continuation of the enclosing support operations of the enclosing support 160.

Figure 23:
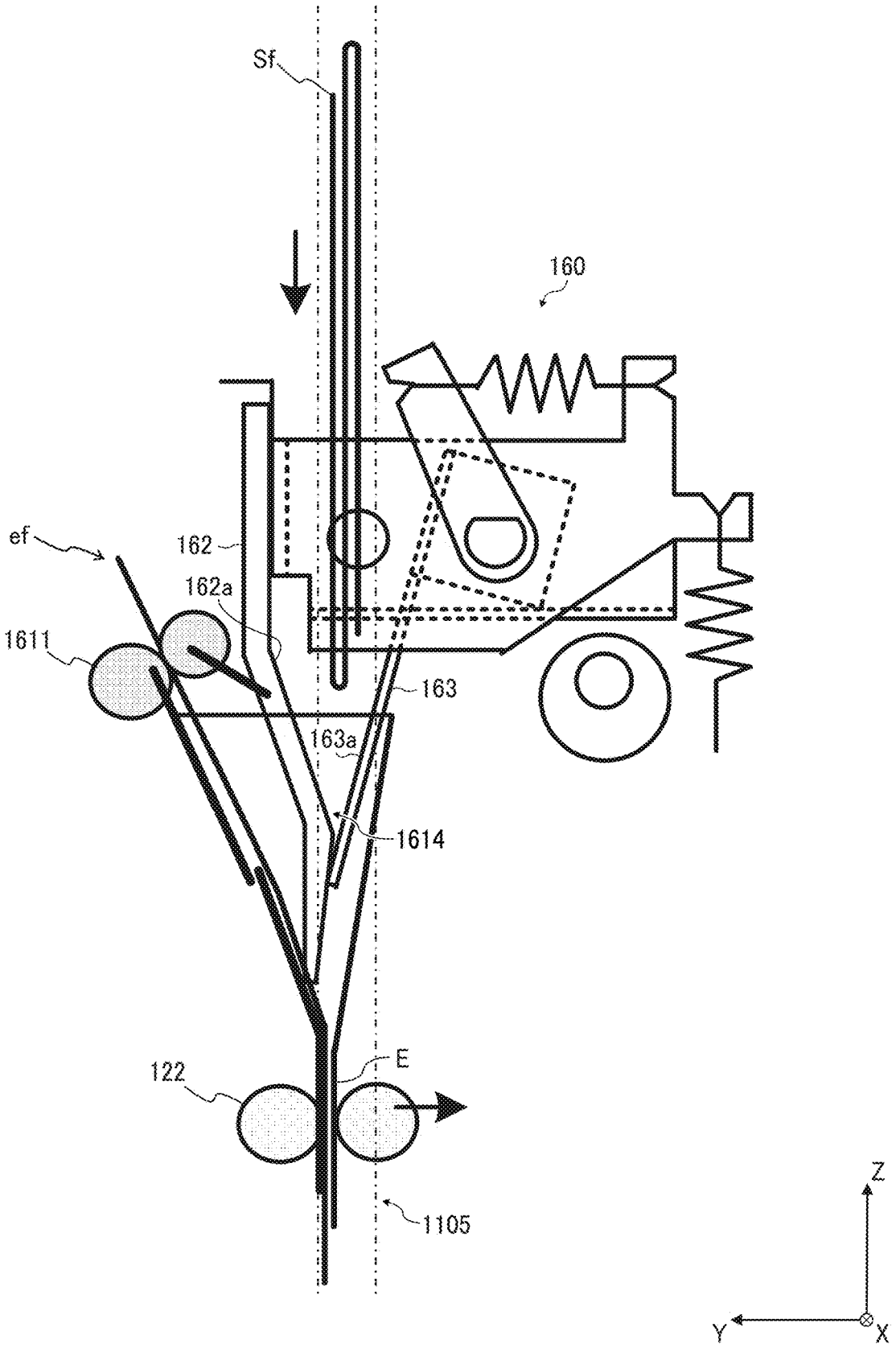
FIG. 23 is a cross-sectional view of the enclosing support according to the first embodiment depicted in FIG. 5, illustrating yet another motion thereof.
Figure 24:
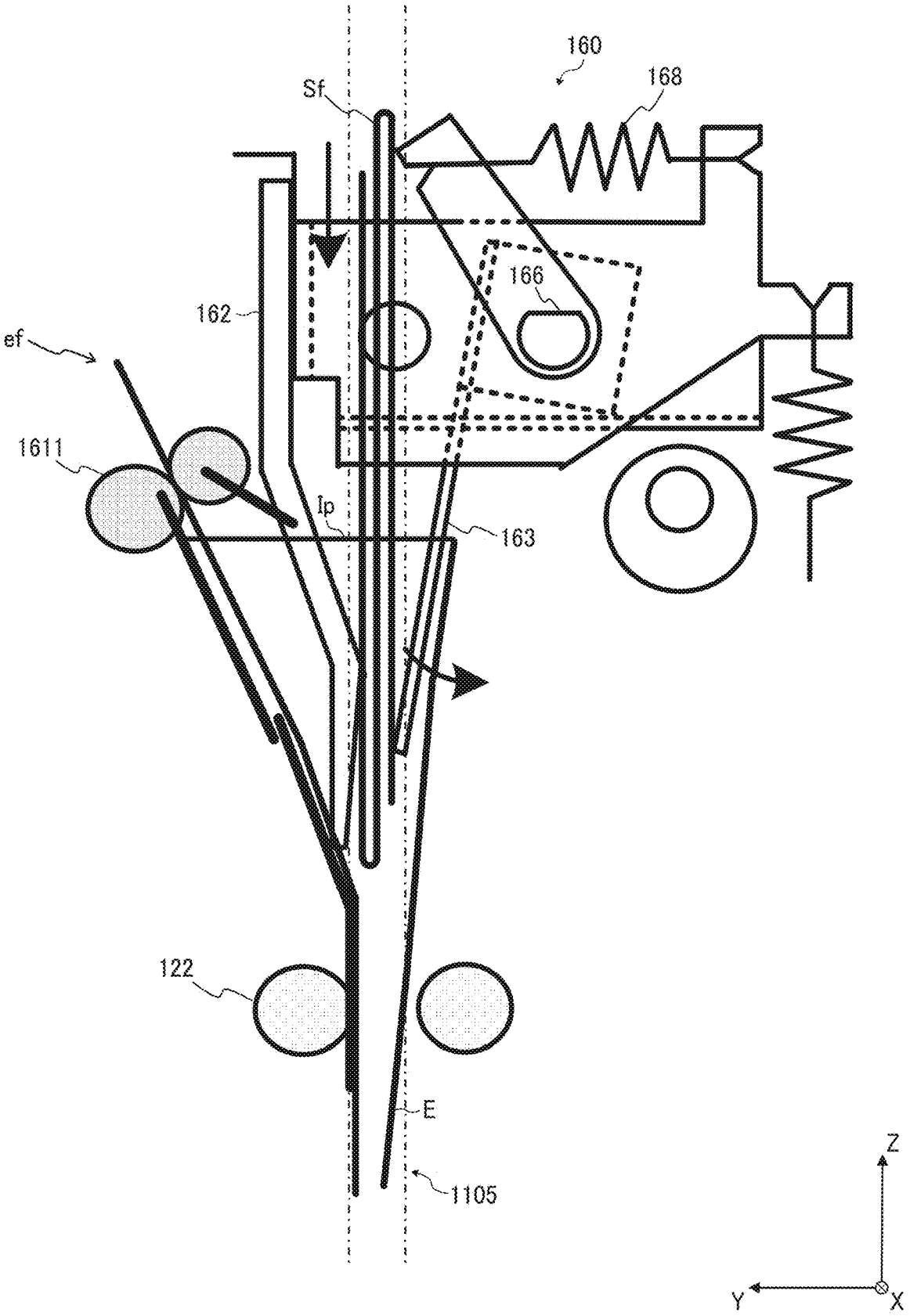
FIG. 24 is a cross-sectional view of the enclosing support according to the first embodiment depicted in FIG. 5, illustrating yet another motion thereof.

Referring to FIGS. 23 and 24, a description is provided of the enclosing support operations of the enclosing support 160 that holds the envelope E with the opened flap ef and encloses the enclosure into the envelope E as illustrated in FIGS. 19 to 22.

The folded sheet Sf serving as the enclosure conveyed from the enclosing conveyance path 1104 toward the envelope E in the enclosing standby state moves through a gap between the first enclosing guide pawl 162 and the second enclosing guide pawl 163. The first enclosing guide pawl 162 and the second enclosing guide pawl 163 include inner slopes, that is, the slopes 162*a* and 163*a*, respectively, which define the taper 1614 that is oriented to an inside of the envelope E waiting in the envelope conveyance path 1105. Accordingly, the first enclosing guide pawl 162 and the second enclosing guide pawl 163 guide and move the folded sheet Sf to the inside of the envelope E.

One of two rollers constructing the first vertical conveyance roller pair 122 separates from another roller and retracts to a position where the roller does not disturb insertion of the folded sheet Sf into the envelope E. Even if the first vertical conveyance roller pair 122 does not sandwich the envelope E to allow the folded sheet Sf to enter the envelope E, the flap holding roller pair 1611 sandwiches the flap ef. Hence, the flap holding roller pair 1611 continues holding the envelope E at the enclosing position.

Subsequently, as illustrated in FIG. 24, as the folded sheet Sf is conveyed into the envelope E, the folded sheet Sf presses the second enclosing guide pawl 163 to pivot about the second enclosing guide pawl shaft 166 and move from a conveyance route of the folded sheet Sf. Accordingly, the folded sheet Sf is conveyed into the envelope E through the mouth Ip of the envelope E sequentially.

The second enclosing guide pawl spring 168 biases the second enclosing guide pawl 163 against the first enclosing guide pawl 162. The folded sheet Sf is conveyed against the biasing force from the second enclosing guide pawl spring 168. Thereafter, a separate member conveys the folded sheet Sf deep into the envelope E, enclosing the folded sheet Sf in the envelope E.

A description is provided of a continuation of the series of processes for enclosing and sealing.

As illustrated in FIG. 24, after the folded sheet Sf is conveyed inside the envelope E, as illustrated in FIG. 25, the sealer 135 interposed between the third vertical conveyance roller pair 131 and the fourth vertical conveyance roller pair 132 closes the flap ef, sealing the envelope E.

Figure 26:
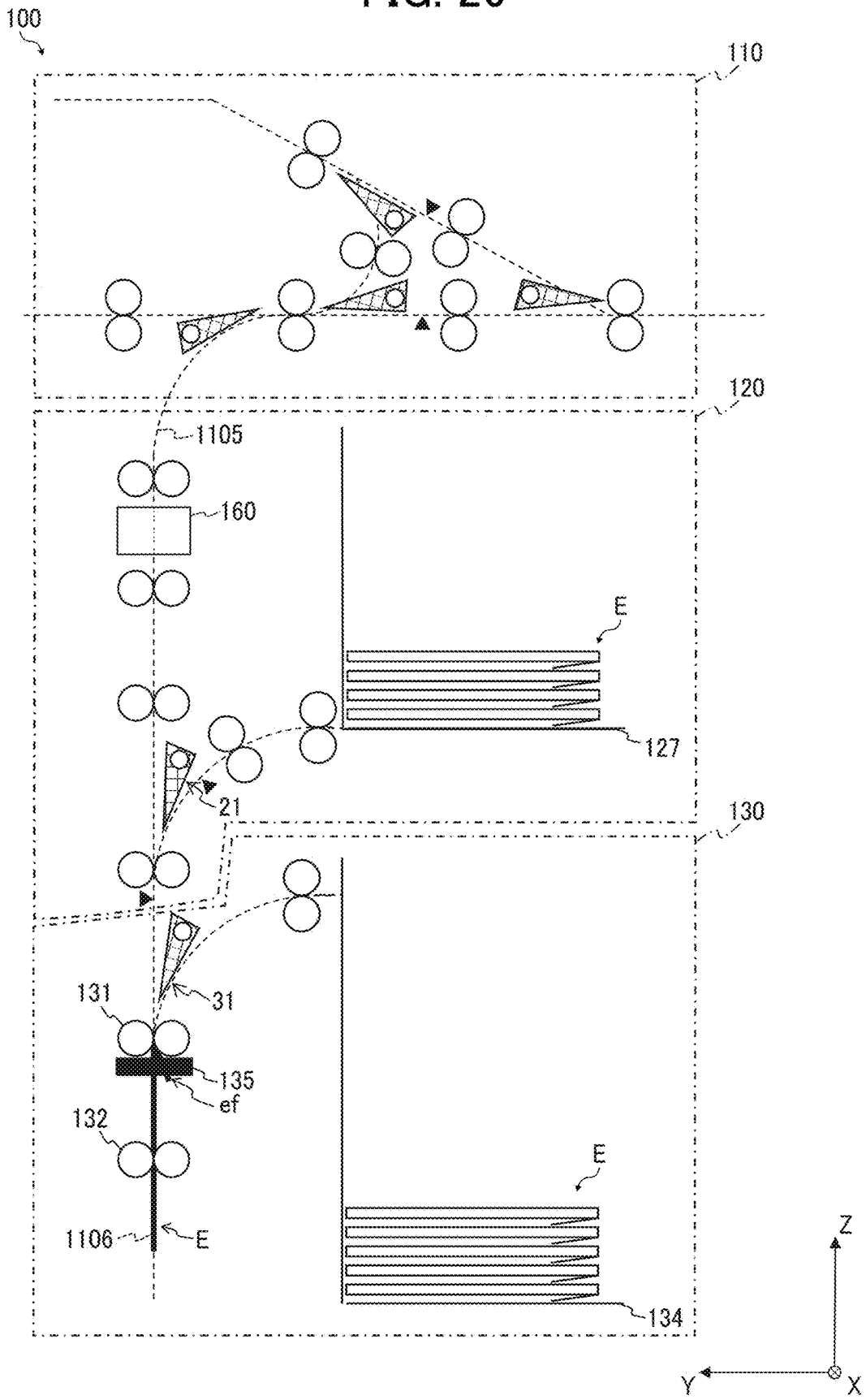
FIG. 26 is a cross-sectional view of the enclosing-sealing apparatus depicted in FIG. 3, illustrating yet another process for enclosing performed by the enclosing-sealing apparatus.
Figure 27:
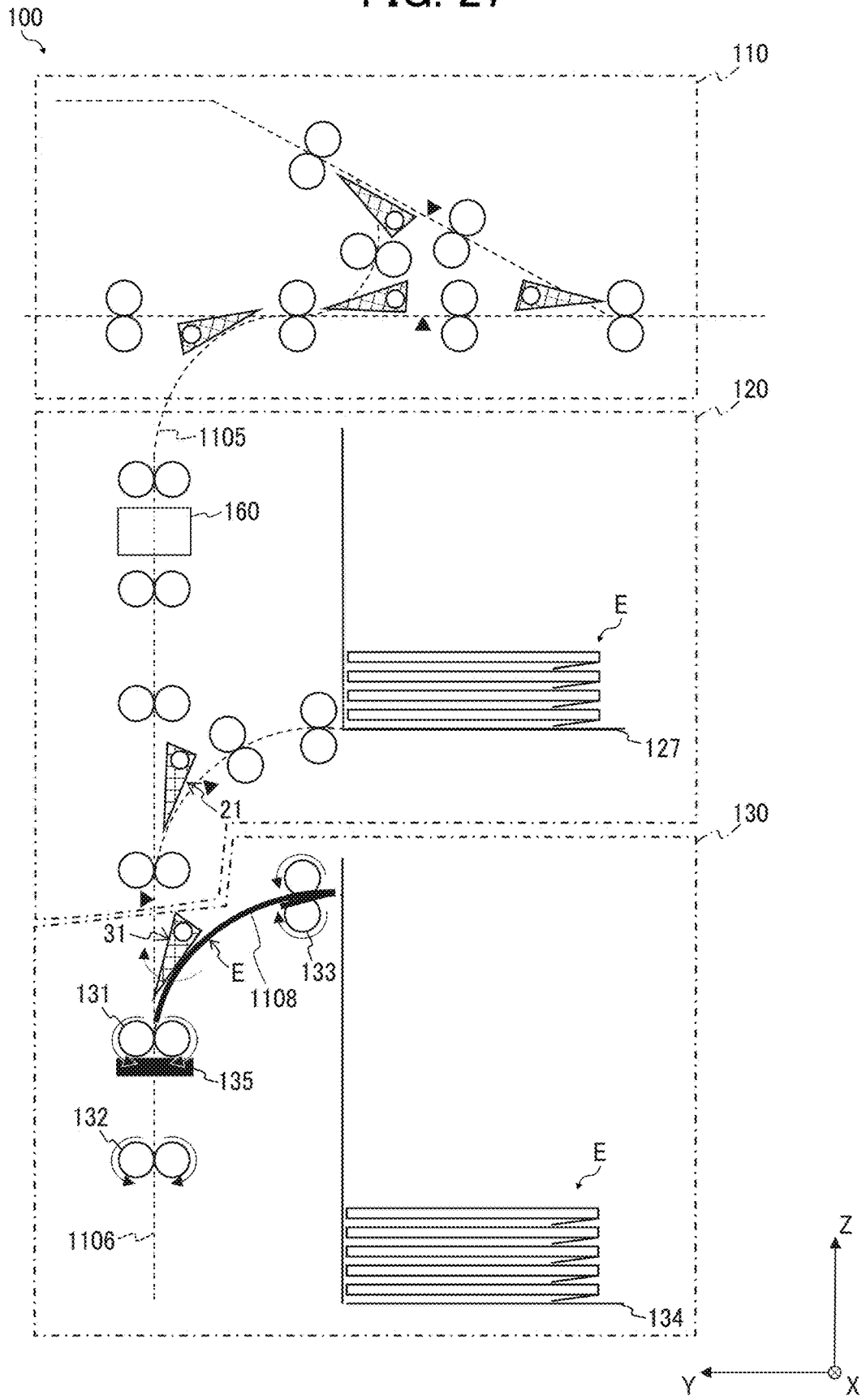
FIG. 27 is a cross-sectional view of the enclosing-sealing apparatus depicted in FIG. 3, illustrating yet another process for enclosing performed by the enclosing-sealing apparatus.

Thereafter, as illustrated in FIG. 26, the third vertical conveyance roller pair 131 and the fourth vertical conveyance roller pair 132 rotate backward, switching back and conveying the sealed envelope E. Before the third vertical conveyance roller pair 131 and the fourth vertical conveyance roller pair 132 rotate backward, the envelope ejecting switching pawl 31 pivots to a position illustrated in FIG. 27. Accordingly, the third vertical conveyance roller pair 131 and the fourth vertical conveyance roller pair 132 convey the envelope E enclosed with the folded sheet Sf from the sealing conveyance path 1106 to the envelope ejecting path 1108.

Figure 28:
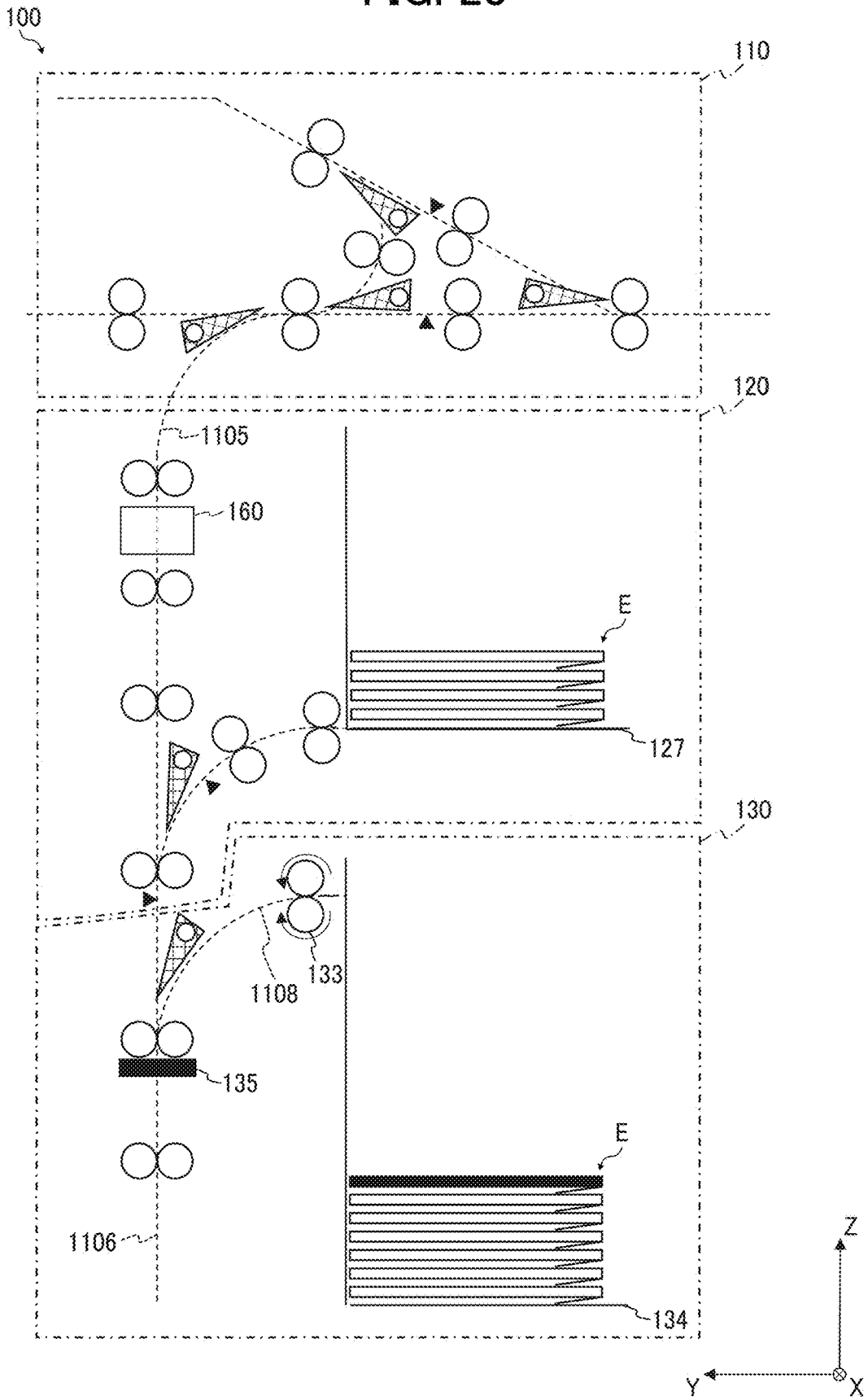
FIG. 28 is a cross-sectional view of the enclosing-sealing apparatus depicted in FIG. 3, illustrating yet another process for enclosing performed by the enclosing-sealing apparatus.

As a result, as illustrated in FIG. 28, the envelope ejecting roller pair 133 ejects the sealed envelope E onto the envelope ejection tray 134.

A description is provided of a dimensional relation between each of the first enclosing guide pawl 162 and the second enclosing guide pawl 163 and the envelope E.

A description is provided of sizes of the envelope E, which are available in the enclosing support 160.

Figure 29A:
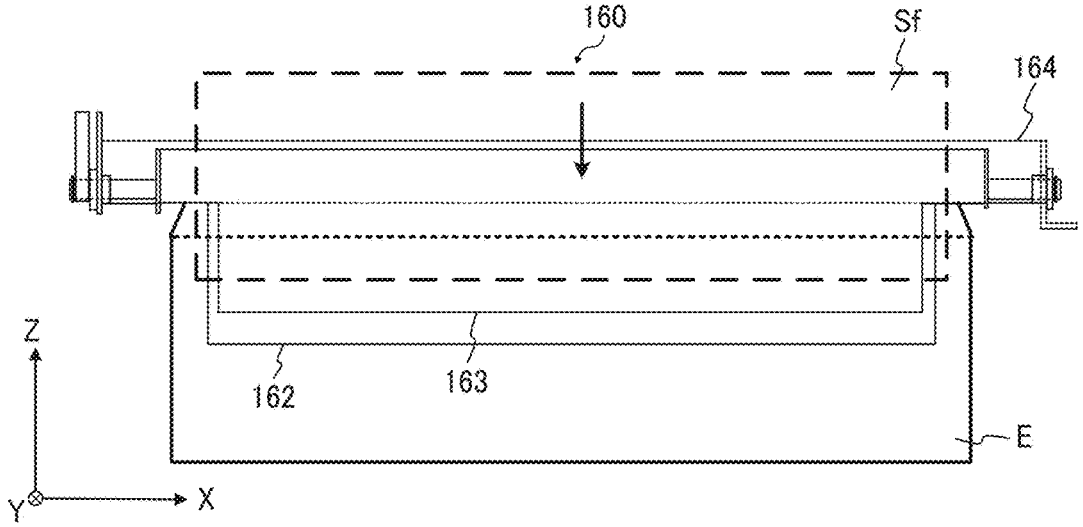
FIG. 29A is a diagram of the enclosing support depicted in FIG. 6, illustrating a dimensional relation between an envelope and the enclosing support.
Figure 29B:
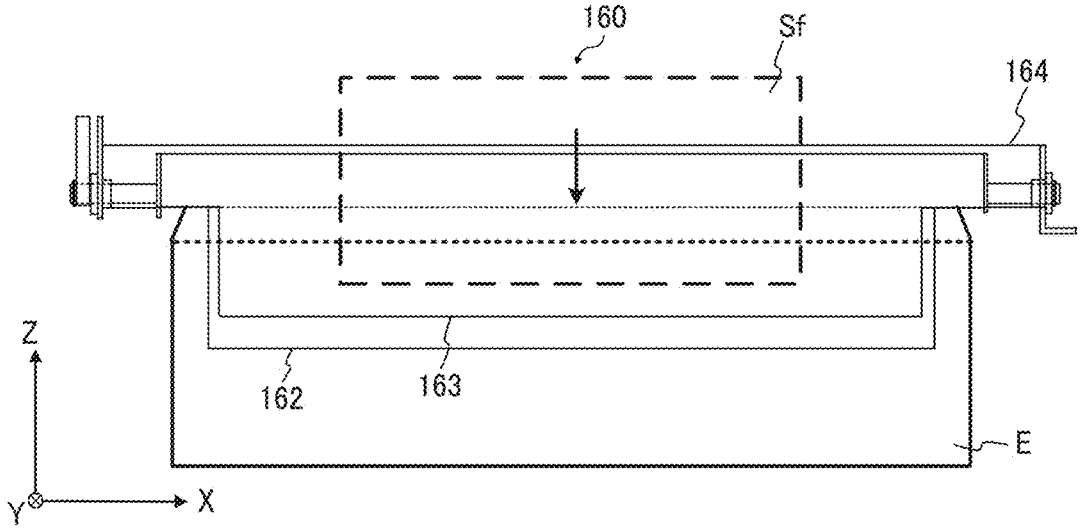
FIG. 29B is a diagram of the enclosing support depicted in FIG. 6, illustrating another dimensional relation between the envelope and the enclosing support.
Figure 29C:
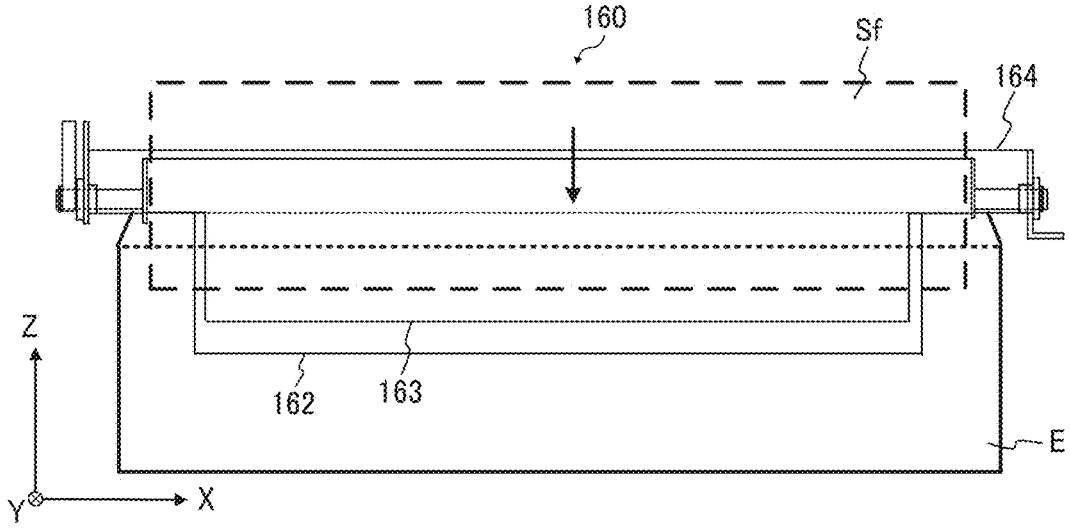
FIG. 29C is a diagram of the enclosing support depicted in FIG. 6, illustrating yet another dimensional relation between the envelope and the enclosing support.

FIGS. 29A, 29B, and 29C illustrate the envelope E of a plurality of sizes (e.g., widths) with a side view of the enclosing support 160 depicted in FIG. 6.

As illustrated in FIGS. 29A and 29C, each of the first enclosing guide pawl 162 and the second enclosing guide pawl 163 does not have the side walls that are disposed at both lateral ends of each of the first enclosing guide pawl 162 and the second enclosing guide pawl 163, respectively, in an axial direction of a rotation shaft (e.g., the first enclosing guide pawl shaft 165 and the second enclosing guide pawl shaft 166) thereof and restrict the envelope E in the axial direction of the first enclosing guide pawl 162 and the second enclosing guide pawl 163. Accordingly, even if a width of the envelope E or the folded sheet Sf is greater than a dimension (e.g., a width) of each of the first enclosing guide pawl 162 and the second enclosing guide pawl 163 in the axial direction thereof, the enclosing support 160 supports enclosing of the folded sheet Sf into the envelope E. For example, the dimension of each of the first enclosing guide pawl 162 and the second enclosing guide pawl 163 in the axial direction thereof does not restrict the width of each of the envelope E and the folded sheet Sf for which the enclosing support 160 supports enclosing.

As illustrated in FIG. 29B, a width of the folded sheet Sf is smaller than a width of each of the first enclosing guide pawl 162 and the second enclosing guide pawl 163 in a longitudinal direction thereof. Even with the folded sheet Sf depicted in FIG. 29B, the first enclosing guide pawl 162 and the second enclosing guide pawl 163 guide the folded sheet Sf serving as the enclosure in the enclosing direction. Accordingly, the folded sheet Sf does not protrude beyond the envelope E in the width direction thereof and is inserted into the envelope E.

As described above, the enclosing support 160 according to this embodiment includes the two pawls, that is, the first enclosing guide pawl 162 and the second enclosing guide pawl 163, each of which does not have the side walls. Even if the first enclosing guide pawl 162 and the second enclosing guide pawl 163 do not move in the longitudinal direction thereof, the first enclosing guide pawl 162 and the second enclosing guide pawl 163 guide the enclosure (e.g., the folded sheet Sf) into the envelope E. Additionally, the first enclosing guide pawl 162 and the second enclosing guide pawl 163 widen the mouth Ip of the envelope E, facilitating smooth enclosing with various combinations of the enclosure having various dimensions and the envelope E having various dimensions.

Figure 30:
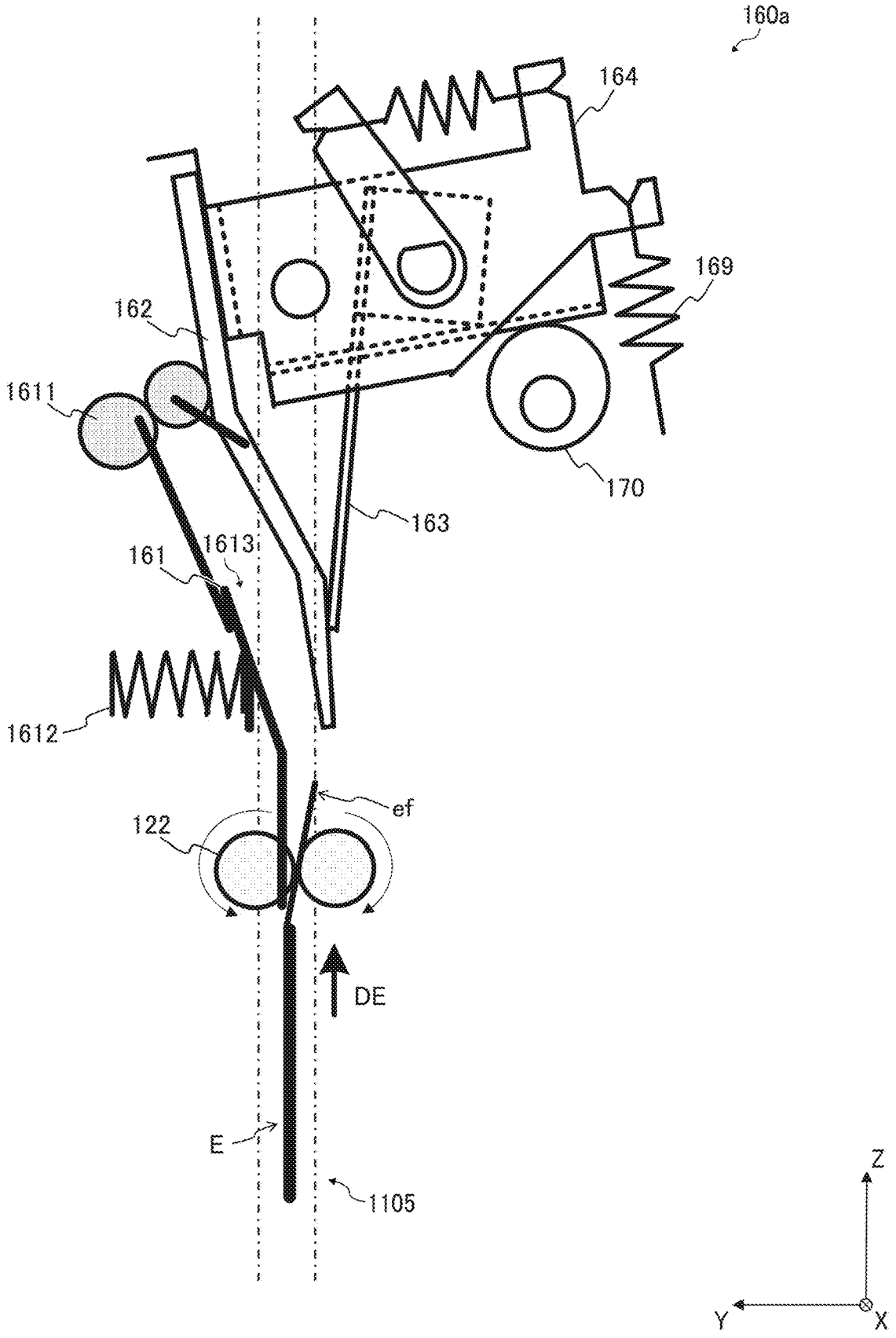
FIG. 30 is a cross-sectional view of an enclosing support according to a second embodiment of the present disclosure, that is installable in the enclosing-sealing apparatus depicted in FIG. 3, illustrating a motion of the enclosing support.
Figure 31:
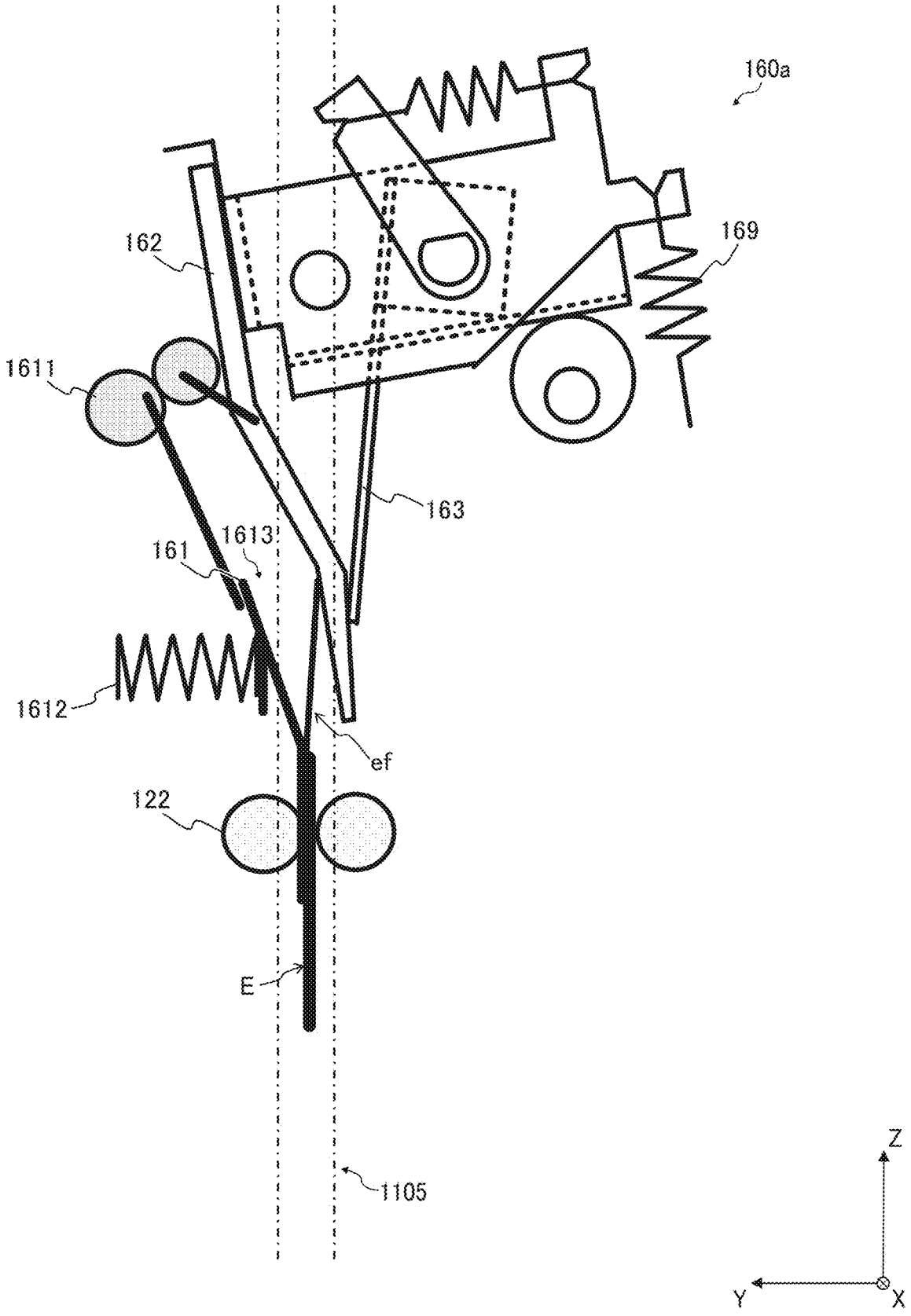
FIG. 31 is a cross-sectional view of the enclosing support according to the second embodiment depicted in FIG. 30, illustrating another motion thereof.
Figure 32:
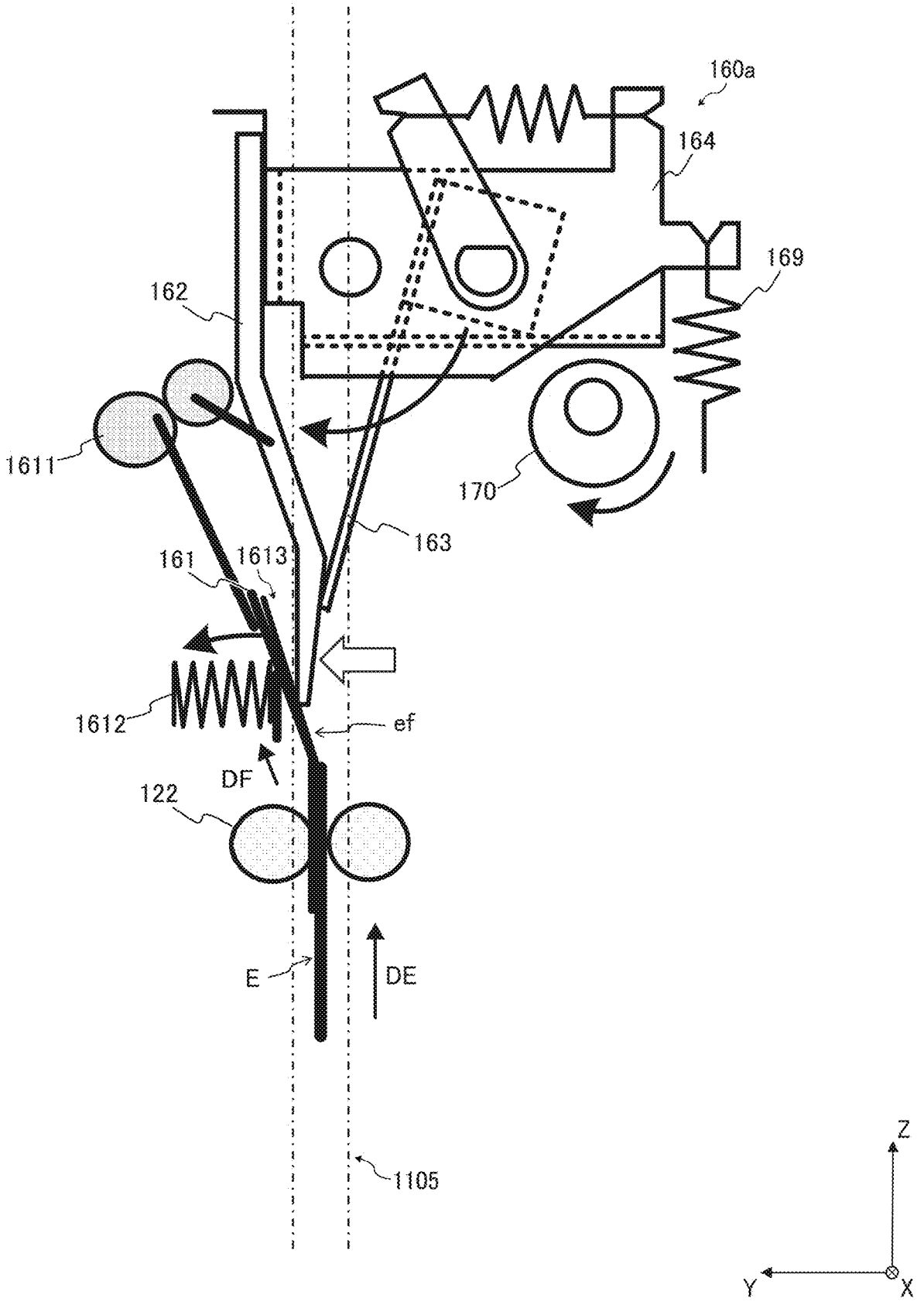
FIG. 32 is a cross-sectional view of the enclosing support according to the second embodiment depicted in FIG. 30, illustrating yet another motion thereof.

Referring to FIGS. 30 to 32, a description is provided of a construction of an enclosing support 160*a* according to a second embodiment of the present disclosure. The enclosing support 160*a* according to the second embodiment includes a guide plate spring 1612 serving as a second biasing member that biases the flap guide plate 161 to press against the first enclosing guide pawl 162.

In the enclosing support 160*a*, biasing forces applied in opposed directions, respectively, that is, a biasing force from the guide plate spring 1612 and the biasing force from the first enclosing guide pawl spring 169, cause the flap guide plate 161 and the first enclosing guide pawl 162 to sandwich the flap ef. Accordingly, the enclosing support 160*a* conveys the flap ef precisely through the flap conveyance path 1613 branched from the envelope conveyance path 1105 and extended to the flap holding roller pair 1611 so as to enclose the enclosure into the envelope E.

Figure 33:
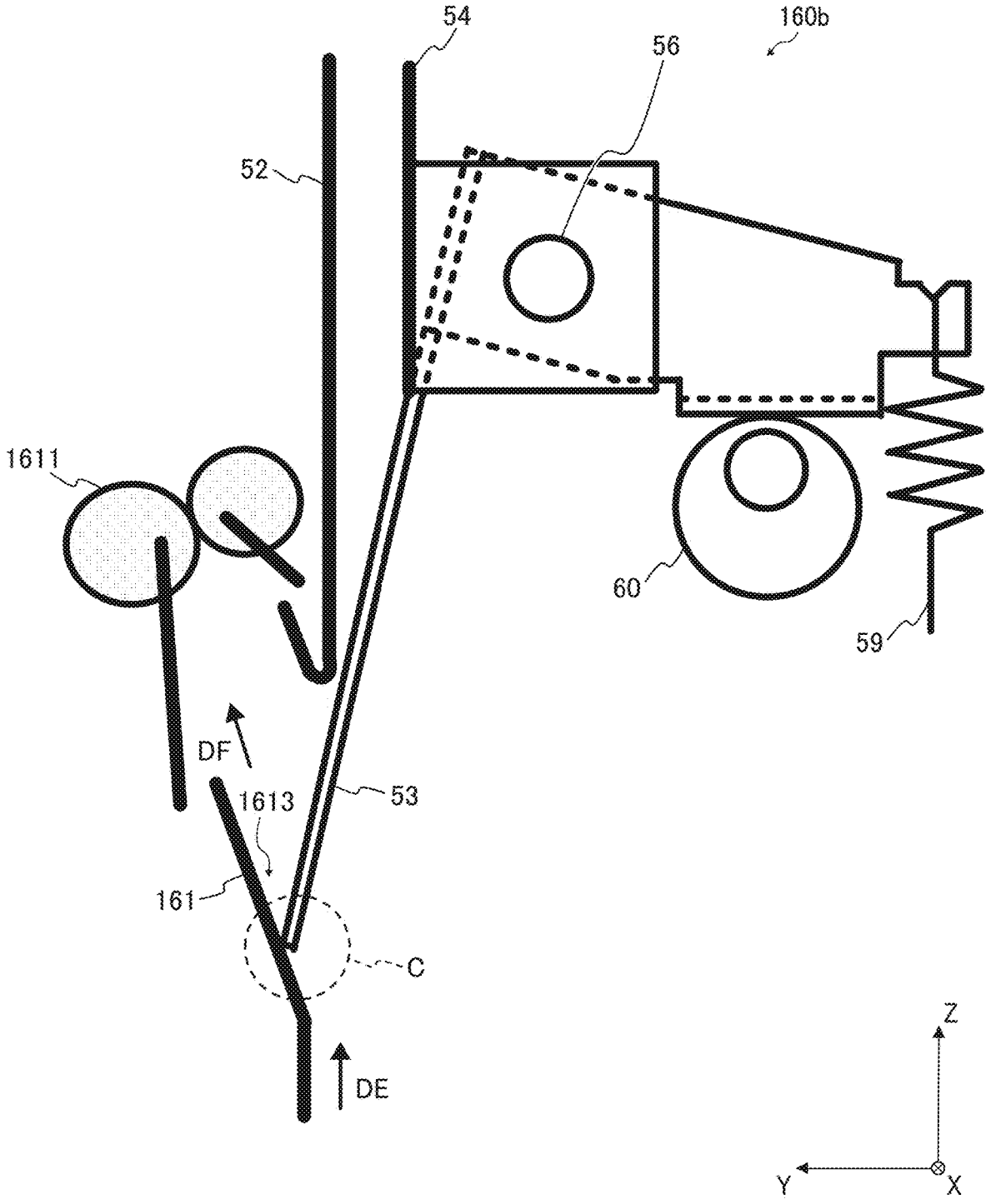
FIG. 33 is a front view of an enclosing support according to a third embodiment of the present disclosure, that is installable in the enclosing-sealing apparatus depicted in FIG. 3.

Referring to FIGS. 33 to 35, a description is provided of a construction of an enclosing support 160*b* according to a third embodiment of the present disclosure.

Figure 34A:
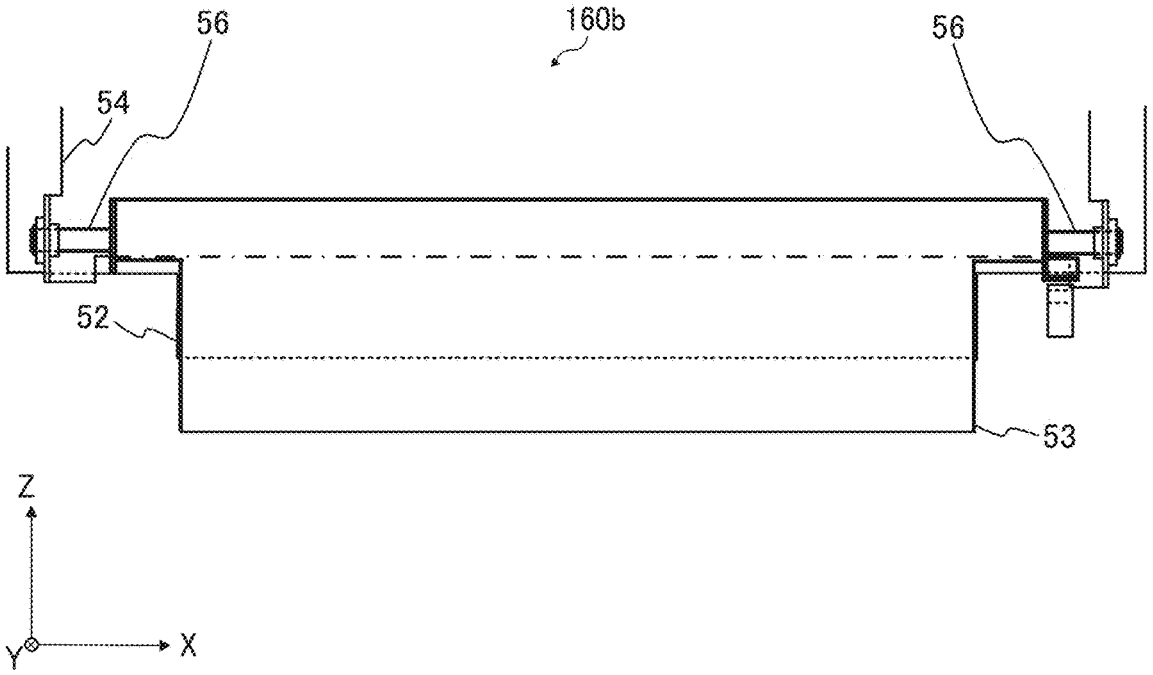
FIG. 34A is a right side view of the enclosing support according to the third embodiment depicted in FIG. 33, illustrating a schematic construction thereof.
Figure 34B:
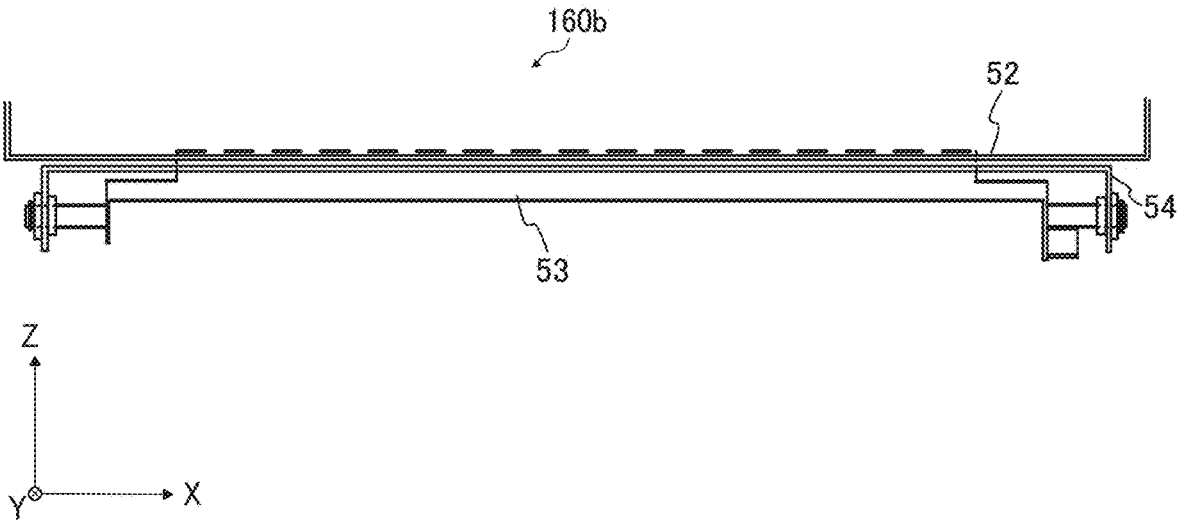
FIG. 34B is a top view of the enclosing support according to the third embodiment depicted in FIG. 34A.
Figure 35A:
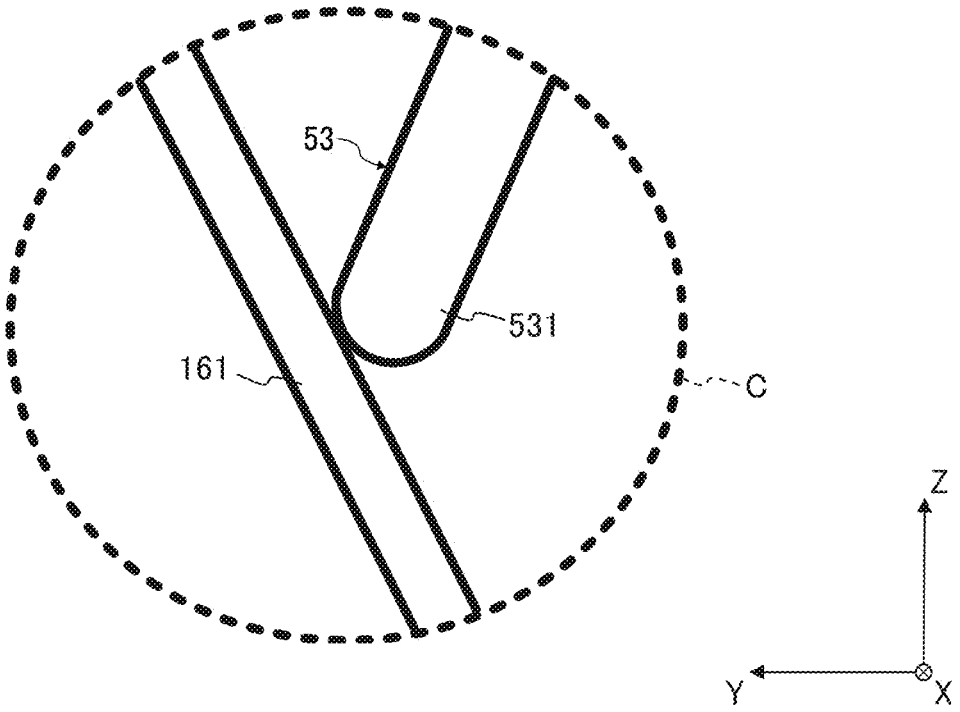
FIG. 35A is an enlarged view of a part of the enclosing support according to the third embodiment depicted in FIG. 33.
Figure 35B:
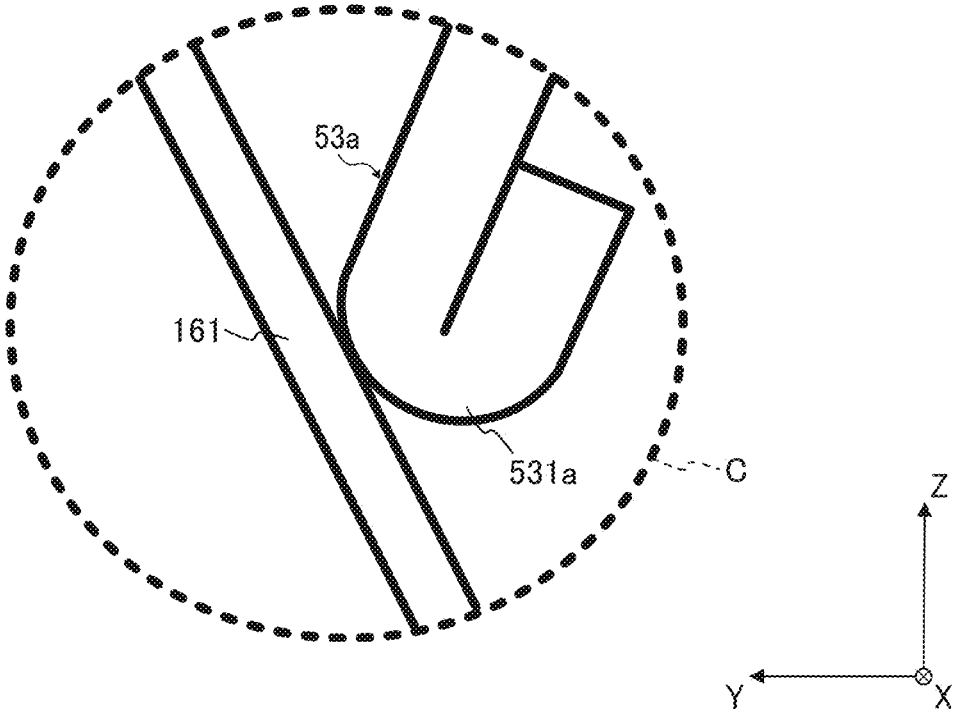
FIG. 35B is an enlarged view of a part of the enclosing support according to the third embodiment depicted in FIG. 33, illustrating a variation of a third enclosing guide pawl incorporated in the enclosing support.

The enclosing support 160*b* according to the third embodiment includes a third enclosing guide pawl 53 serving as an enclosing guide pawl that presses the flap ef against the flap guide plate 161 described above and retracts the flap ef from the envelope conveyance path 1105 when the enclosure is inserted into the envelope E. FIG. 33 is a front view of the enclosing support 160*b*. FIG. 34A is a right side view of the enclosing support 160*b*. FIG. 34B is a top view of the enclosing support 160*b*. FIG. 35A is an enlarged view of a part C of the enclosing support 160*b* depicted in FIG. 33, illustrating the third enclosing guide pawl 53. FIG. 35B is an enlarged view of the part C of the enclosing support 160*b* depicted in FIG. 33, illustrating a third enclosing guide pawl 53*a* as a variation of the third enclosing guide pawl 53 depicted in FIG. 35A.

Like the enclosing supports 160 and 160*a* described above, the enclosing support 160*b* is also disposed at the predetermined position in the envelope conveyance path 1105. The predetermined position where the enclosing support 160*b* is disposed is the position in proximity to the enclosing position where the envelope E is held when the enclosure is inserted into the envelope E. For example, the position in proximity to the enclosing position is the position where the enclosing support 160*b* retracts the flap ef from the envelope conveyance path 1105 and holds the flap ef before the envelope E is conveyed to the enclosing position, and the envelope E is conveyed to the enclosing position while the enclosing support 160*b* continues holding the flap ef retracted from the envelope conveyance path 1105.

When the envelope E is conveyed to the enclosing position where the enclosure is inserted into the envelope E, the enclosing support 160*b*, with a single pawl (e.g., the third enclosing guide pawl 53), retracts the flap ef of the envelope E from the envelope conveyance path 1105. The third enclosing guide pawl 53 continues pressing against a guide (e.g., the flap guide plate 161) disposed opposite the third enclosing guide pawl 53. The flap guide plate 161 and the third enclosing guide pawl 53 pressed against the flap guide plate 161 sandwich the flap ef, retaining a state in which the flap ef does not disturb insertion of the enclosure into the envelope E. As the envelope E is conveyed to the enclosing position while the enclosing support 160*b* holds the flap ef at the retracted position, the enclosing support 160*b* widens the mouth Ip of the envelope E.

That is, while the enclosure is enclosed into the envelope E, the enclosing support 160*b* retains the flap ef not to disturb enclosing of the enclosure into the envelope E and widens the mouth Ip of the envelope E to facilitate smooth insertion of the enclosure into the envelope E.

As illustrated in FIG. 33, the enclosing support 160*b* includes the flap conveyance path 1613 as the retracted path where the flap ef retracted from the envelope conveyance path 1105 is situated. The flap conveyance path 1613 branches from the envelope conveyance path 1105. The enclosing support 160*b* includes the flap guide plate 161 serving as the guide or the flap guide that guides the flap ef in the retracting direction. FIG. 33 omits illustration of the envelope conveyance path 1105.

The flap holding roller pair 1611 is disposed downstream from the flap guide plate 161 in the flap conveyance direction DF. The flap holding roller pair 1611 holds the flap ef retracted from the envelope conveyance path 1105. The flap holding roller pair 1611 is a pair of rollers that nips or sandwiches the flap ef.

When a third enclosing guide pawl spring 59 biases the third enclosing guide pawl 53, the third enclosing guide pawl 53 presses against the flap guide plate 161 serving as the guide. Thus, the flap guide plate 161 functions as the stopper. Accordingly, a contact position where the third enclosing guide pawl 53 contacts the flap guide plate 161 is the retracted position retracted from the envelope conveyance path 1105.

As the flap guide plate 161 and the third enclosing guide pawl 53 sandwich the flap ef, the enclosing support 160*b* is in a flap retracting state in which the enclosing support 160*b* retracts the flap ef from the envelope conveyance path 1105. In the flap retracting state, the enclosing roller pair 121 and the first vertical conveyance roller pair 122 depicted in FIG. 3 hold the envelope E such that the envelope E is conveyed to the enclosing position. The enclosing support 160*b* holds the flap ef in a state in which the flap ef is retracted from and inclined with respect to the envelope conveyance path 1105 in a direction (e.g., the flap conveyance direction DF) different from the envelope conveyance direction DE.

Accordingly, the envelope E is slightly bent toward the flap guide plate 161. The mouth Ip of the envelope E is stretched in a direction in which the flap ef is inclined. Consequently, the mouth Ip of the envelope E widens slightly.

The enclosing support 160*b* further includes an enclosing guide pawl opposed guide plate 52 serving as an enclosing guide. The enclosing guide pawl opposed guide plate 52 is a stationary member that constructs or defines a part of the envelope conveyance path 1105. An enclosing guide pawl securing guide plate 54 is disposed opposite the enclosing guide pawl opposed guide plate 52. The enclosing guide pawl securing guide plate 54 serves as an enclosing guide that constructs a part of the envelope conveyance path 1105. The enclosing guide pawl securing guide plate 54 holds an enclosing guide pawl shaft 56 serving as a rotation shaft about which the third enclosing guide pawl 53 pivots. The enclosing guide pawl shaft 56 pivotally supports the third enclosing guide pawl 53. The third enclosing guide pawl spring 59 biases a front end 531 depicted in FIG. 35A of the third enclosing guide pawl 53 against the flap guide plate 161. A driving cam 60 moves the third enclosing guide pawl 53 between the retracted position and a biased position.

The enclosing guide pawl shaft 56 is attached to the third enclosing guide pawl 53 by caulking and rotatably engages the enclosing guide pawl securing guide plate 54 through a bearing.

The third enclosing guide pawl spring 59 is interposed and assembled between the third enclosing guide pawl 53 and the frame of the enclosing device 120. The third enclosing guide pawl spring 59 biases the third enclosing guide pawl 53 in a pulling direction. The third enclosing guide pawl spring 59 biases the third enclosing guide pawl 53 to pivot about the enclosing guide pawl shaft 56 clockwise in FIG. 33, pressing the front end 531 of the third enclosing guide pawl 53 against the flap guide plate 161.

The driving cam 60 is an eccentric cam that rotates about a rotation shaft. The driving cam 60 pivots to switch a position of the third enclosing guide pawl 53 between the retracted position and the biased position.

Referring to FIGS. 35A and 35B, a description is provided of a shape of the front end 531 of the third enclosing guide pawl 53.

As illustrated in FIG. 35A, in order to prevent the front end 531 from damaging the flap ef, the front end 531 that contacts the flap guide plate 161 is round and is not sharp. For example, the front end 531 has a round face that contacts the flap guide plate 161. FIG. 35B illustrates the third enclosing guide pawl 53*a* including a front end 531*a* that is bent in a thickness direction of the third enclosing guide pawl 53*a*. The front end 531*a* that presses the flap ef against the flap guide plate 161 is round.

A description is provided of a dimensional relation between each of the enclosing guide pawl opposed guide plate 52 and the third enclosing guide pawl 53 and the envelope E.

A description is provided of sizes of the envelope E, which are available in the enclosing support 160*b*.

Figure 36A:
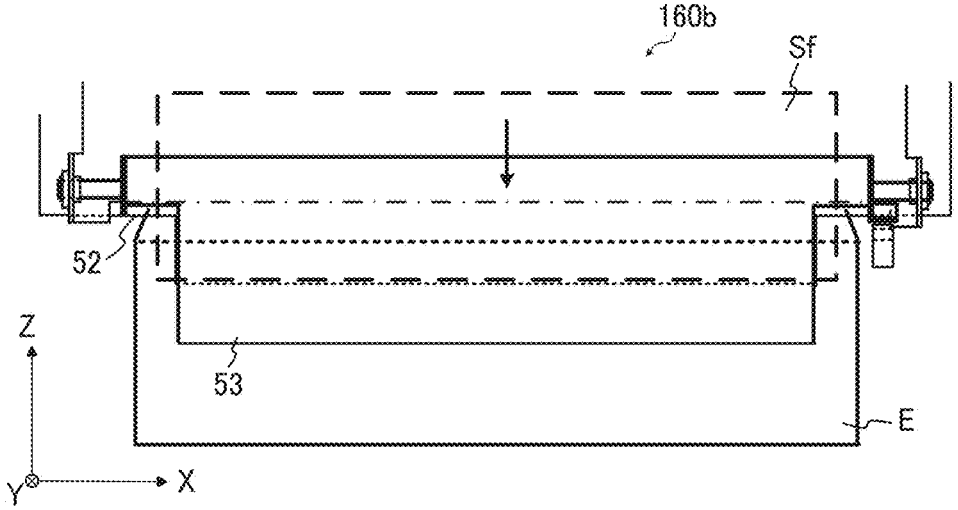
FIG. 36A is a diagram of the enclosing support according to the third embodiment depicted in FIG. 34A, illustrating a dimensional relation between an envelope and the enclosing support.
Figure 36B:
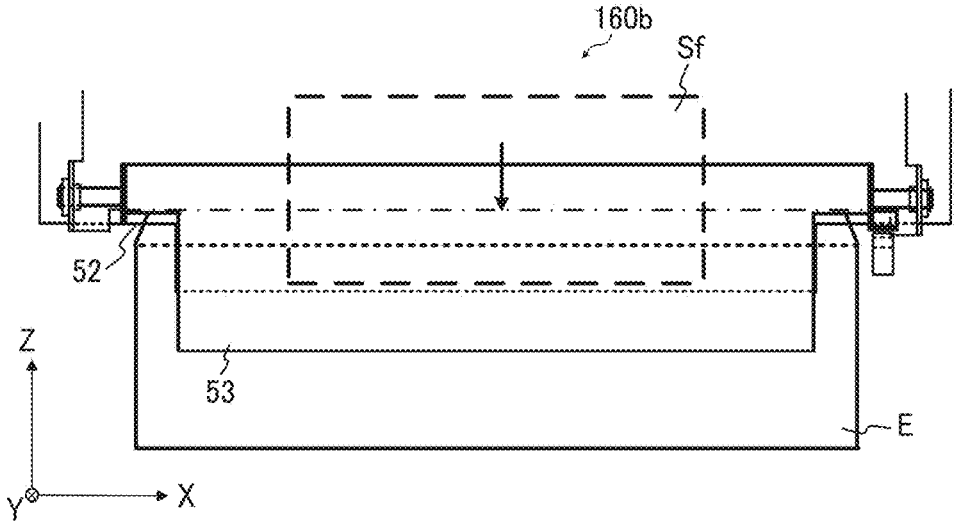
FIG. 36B is a diagram of the enclosing support according to the third embodiment depicted in FIG. 34A, illustrating another dimensional relation between the envelope and the enclosing support.
Figure 36C:
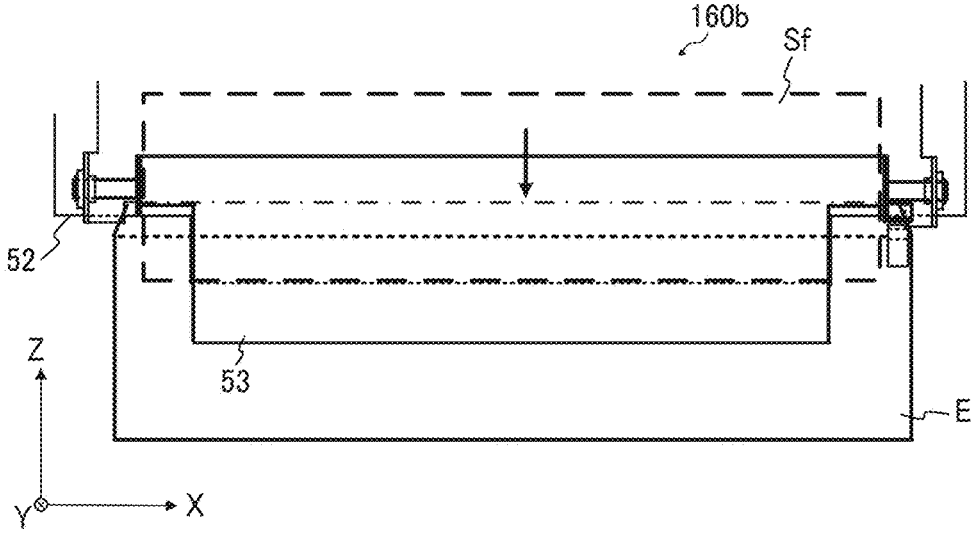
FIG. 36C is a diagram of the enclosing support according to the third embodiment depicted in FIG. 34A, illustrating yet another dimensional relation between the envelope and the enclosing support.

FIGS. 36A, 36B, and 36C illustrate the envelope E of a plurality of sizes (e.g., widths) with a side view of the enclosing support 160*b* depicted in FIG. 34A.

As illustrated in FIGS. 36A and 36C, each of the enclosing guide pawl opposed guide plate 52 and the third enclosing guide pawl 53 does not have side walls that are disposed at both lateral ends of each of the enclosing guide pawl opposed guide plate 52 and the third enclosing guide pawl 53, respectively, in an axial direction of the enclosing guide pawl shaft 56 about which the third enclosing guide pawl 53 pivots, and restrict the envelope E in the axial direction of the enclosing guide pawl shaft 56. The enclosing support 160*b* includes the enclosing guide pawl opposed guide plate 52 and the third enclosing guide pawl 53 that enter the mouth Ip of the envelope E conveyed to the enclosing position, thus widening the mouth Ip of the envelope E to an open amount with which the enclosure is inserted into the envelope E. Since each of the enclosing guide pawl opposed guide plate 52 and the third enclosing guide pawl 53 does not have the side walls, even if a width of the envelope E or the folded sheet Sf is greater than a dimension (e.g., a length) of each of the enclosing guide pawl opposed guide plate 52 and the third enclosing guide pawl 53 in a longitudinal direction thereof, the enclosing support 160*b* supports enclosing of the folded sheet Sf into the envelope E. For example, the dimension of each of the enclosing guide pawl opposed guide plate 52 and the third enclosing guide pawl 53 in the longitudinal direction thereof does not restrict the width of each of the envelope E and the folded sheet Sf for which the enclosing support 160*b* supports enclosing.

As illustrated in FIG. 36B, the width of the envelope E may be smaller than the length of each of the enclosing guide pawl opposed guide plate 52 and the third enclosing guide pawl 53 in the longitudinal direction thereof. In this case also, the enclosing guide pawl opposed guide plate 52 and the third enclosing guide pawl 53 guide the folded sheet Sf serving as the enclosure in the enclosing direction. Accordingly, the folded sheet Sf does not protrude beyond the envelope E in the width direction thereof and is inserted into the envelope E.

As described above, the enclosing support 160*b* according to the third embodiment includes the enclosing guide pawl opposed guide plate 52 and the third enclosing guide pawl 53 each of which does not have the side walls. Hence, even if the enclosing guide pawl opposed guide plate 52 and the third enclosing guide pawl 53 do not move in the longitudinal direction thereof, the enclosing guide pawl opposed guide plate 52 and the third enclosing guide pawl 53 guide the enclosure (e.g., the folded sheet Sf) into the envelope E.

Additionally, the enclosing guide pawl opposed guide plate 52 and the third enclosing guide pawl 53 widen the mouth Ip of the envelope E, facilitating smooth enclosing with various combinations of the enclosure having various dimensions and the envelope E having various dimensions.

A description is provided of enclosing support operations performed by the enclosing support 160*b* according to the third embodiment of the present disclosure.

With reference to FIGS. 37 to 44, a description is provided of an example of a series of processes for enclosing, that is performed by the enclosing support 160*b*.

In the drawings, reference numerals and the like are assigned to elements used in the description of the series of processes for enclosing.

Like the series of processes for enclosing and sealing according to the first embodiment, the second vertical conveyance roller pair 123 and the first vertical conveyance roller pair 122 convey the envelope E to the enclosing position determined based on the flap length. When the flap ef reaches the past position where the flap ef is past the first vertical conveyance roller pair 122, that is, the enclosing position determined based on the flap length, the second vertical conveyance roller pair 123 and the first vertical conveyance roller pair 122 interrupt rotation, placing the envelope E in the enclosing standby state as illustrated in FIG. 13.

Figure 37:
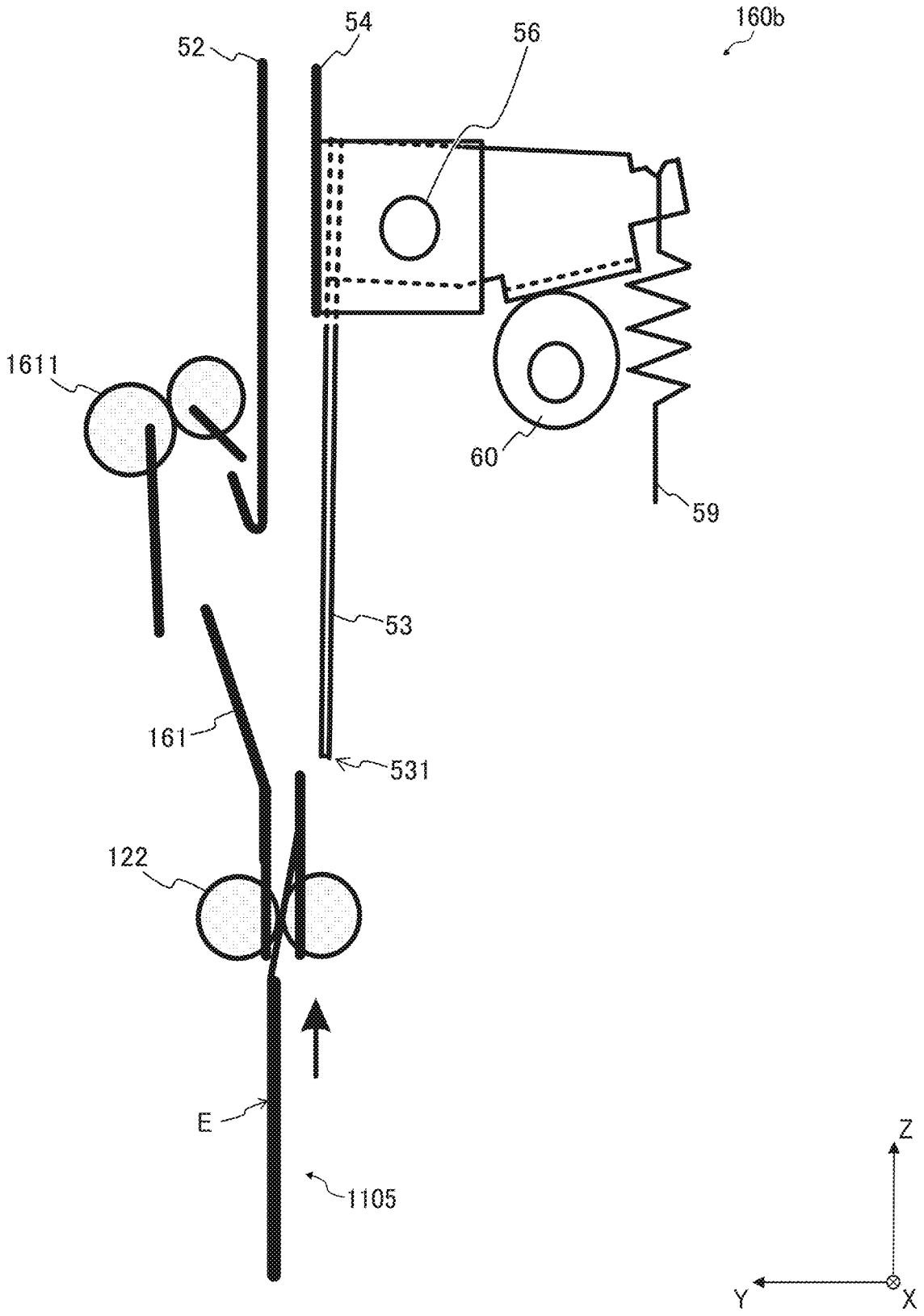
FIG. 37 is a diagram of the enclosing support according to the third embodiment depicted in FIG. 33, illustrating a motion thereof.

A description is provided of a series of processes before the enclosing standby state. FIG. 37 illustrates the envelope E that is conveyed through the envelope conveyance path 1105 in the positive Z-direction and reaches the first vertical conveyance roller pair 122.

The driving cam 60 lifts the third enclosing guide pawl 53. As a result, the front end 531 of the third enclosing guide pawl 53 separates from the flap guide plate 161.

Figure 38:
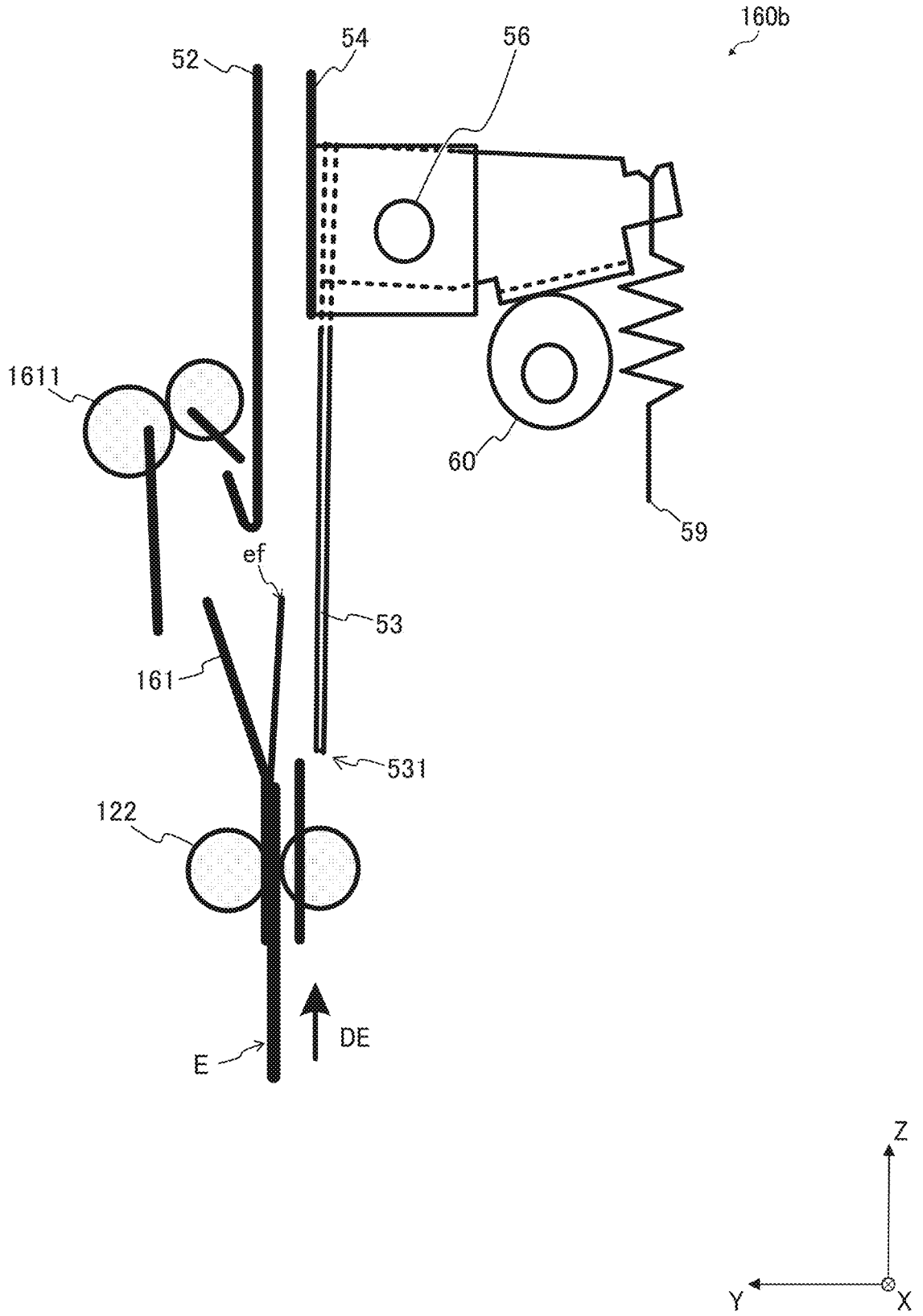
FIG. 38 is a diagram of the enclosing support according to the third embodiment depicted in FIG. 33, illustrating another motion thereof.

Subsequently, as illustrated in FIG. 38, when the envelope E is conveyed and the flap ef of the envelope E reaches a past position that is past the front end 531 of the third enclosing guide pawl 53 in the positive Z-direction, that is, when the leading end of the flap ef reaches the past position that is past the front end 531 of the third enclosing guide pawl 53 in the envelope conveyance direction DE, the enclosing-sealing controller 150 interrupts conveyance of the envelope E. Thus, a position of the envelope E when conveyance of the envelope E is interrupted is equivalent to the predetermined position. Like the first embodiment, the enclosing-sealing controller 150 controls each conveyance roller pair to interrupt conveyance of the envelope E based on the flap length that has already been calculated and the rotation amount (e.g., the number of rotations) of each conveyance roller pair that has rotated to convey the envelope E through the envelope conveyance path 1105. For example, the enclosing-sealing controller 150 controls each conveyance roller pair to interrupt rotation based on the conveyance speed of the envelope E and the distance for which the envelope E moves until the envelope E reaches the halt position, that is calculated based on the flap length.

Figure 39:
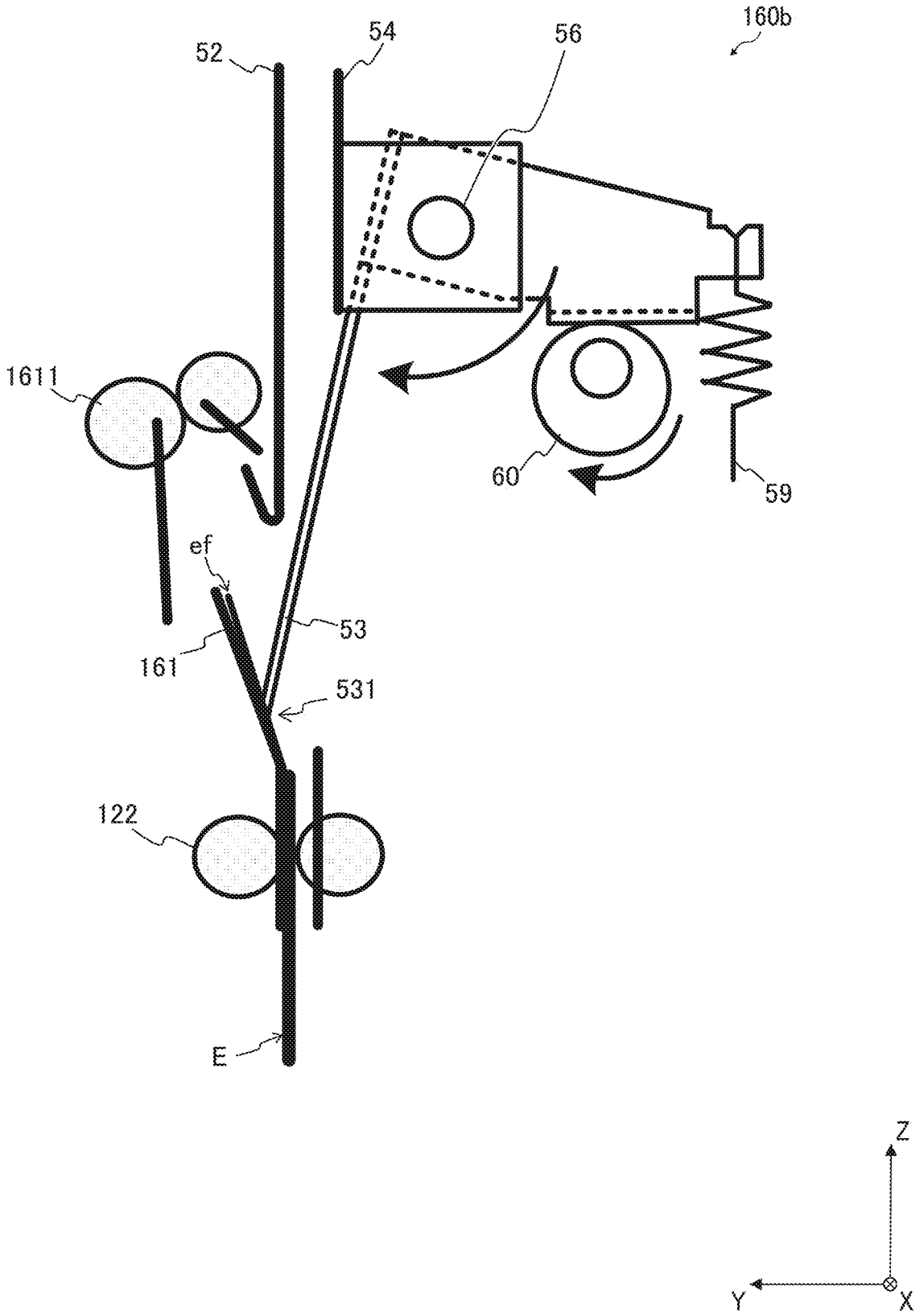
FIG. 39 is a diagram of the enclosing support according to the third embodiment depicted in FIG. 33, illustrating yet another motion thereof.

Subsequently, as illustrated in FIG. 39, the driving cam 60 rotates by a particular rotation angle. As the driving cam 60 rotates, the third enclosing guide pawl 53 pivots in a biasing direction in which the third enclosing guide pawl spring 59 biases the third enclosing guide pawl 53. As a result, the front end 531 of the third enclosing guide pawl 53 presses against the flap guide plate 161. Thus, the front end 531 of the third enclosing guide pawl 53 and the flap guide plate 161 sandwich the flap ef.

For example, when the envelope E reaches the predetermined position where the flap ef overlaps the front end 531 of the third enclosing guide pawl 53, the third enclosing guide pawl 53 orients the flap ef to the flap guide plate 161.

Figure 40:
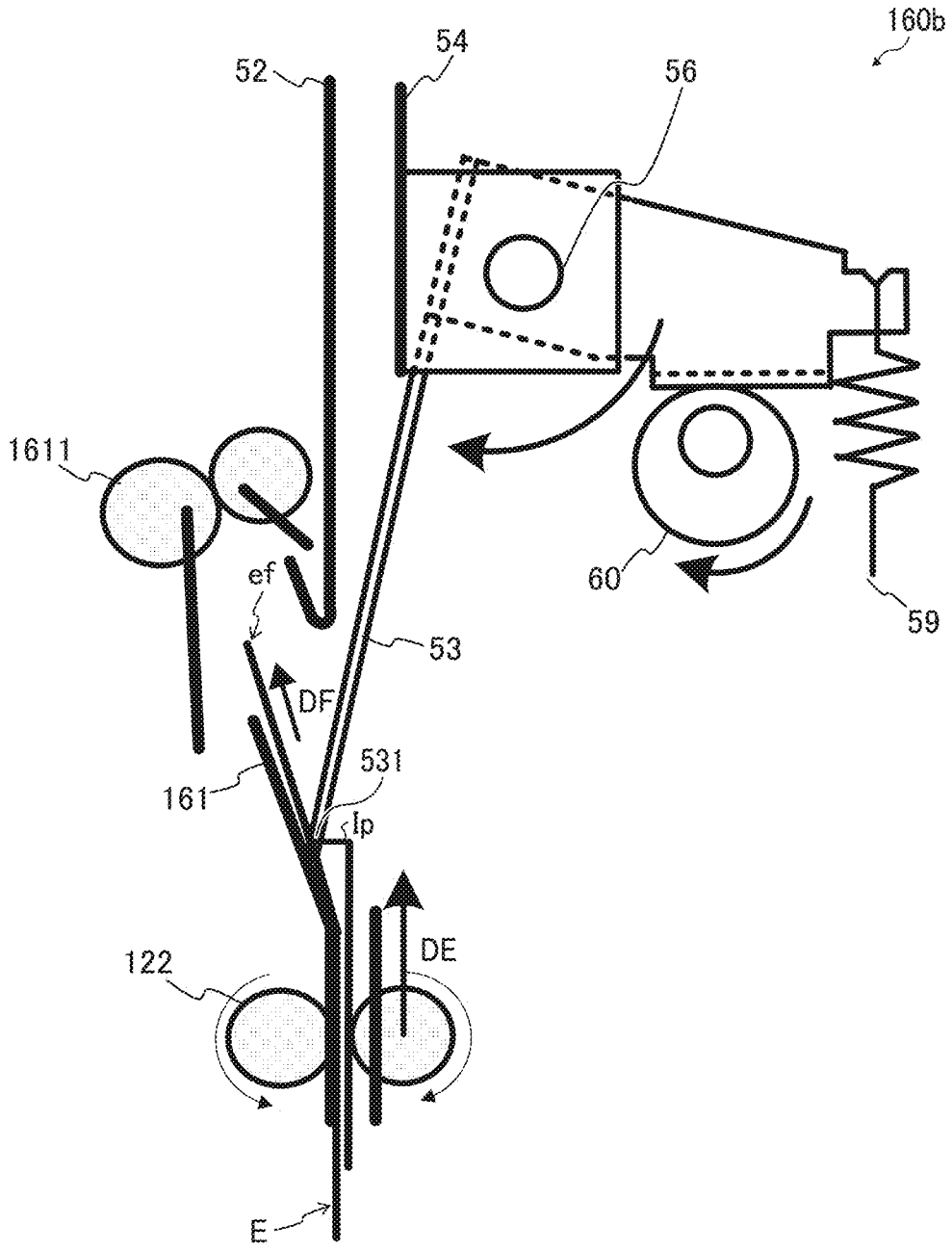
FIG. 40 is a diagram of the enclosing support according to the third embodiment depicted in FIG. 33, illustrating yet another motion thereof.
Figure 40:
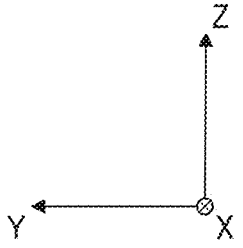

Subsequently, as illustrated in FIG. 40, the first vertical conveyance roller pair 122 and the like resume rotation, conveying the envelope E farther in the positive Z-direction. The first vertical conveyance roller pair 122 conveys the envelope E against a biasing force from the third enclosing guide pawl 53. The front end 531 of the third enclosing guide pawl 53 enters the mouth Ip of the envelope E. The first vertical conveyance roller pair 122 conveys the envelope E while the third enclosing guide pawl 53 presses the flap ef against the flap guide plate 161. Hence, the flap ef is conveyed in the flap conveyance direction DF different from the envelope conveyance direction DE in which the mouth Ip of the envelope E is conveyed. As a result, as the flap ef is conveyed, the envelope E deforms slightly, widening the mouth Ip. The third enclosing guide pawl 53 enters the widened mouth Ip of the envelope E.

Figure 41:
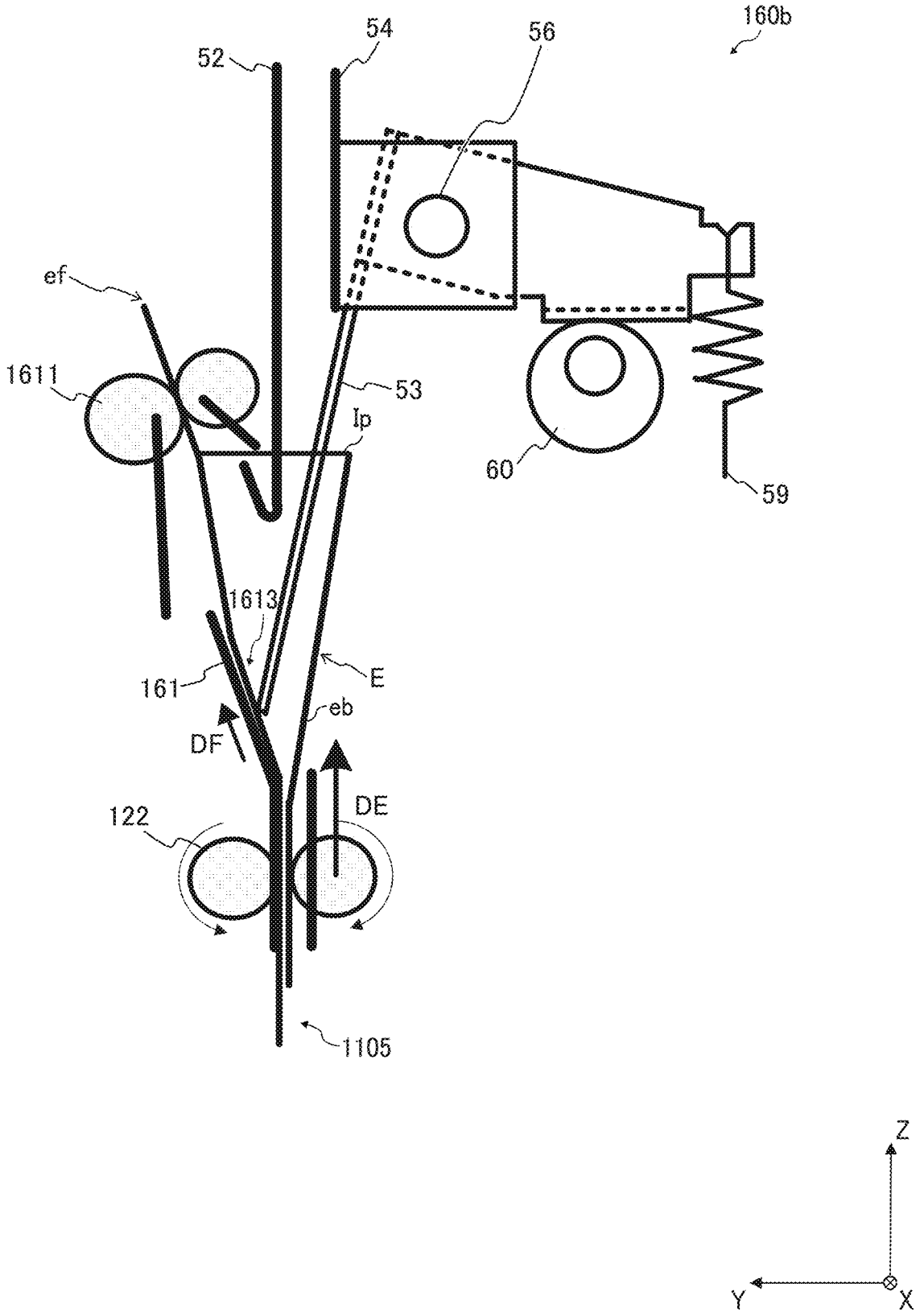
FIG. 41 is a diagram of the enclosing support according to the third embodiment depicted in FIG. 33, illustrating yet another motion thereof.

Subsequently, as illustrated in FIG. 41, as the first vertical conveyance roller pair 122 rotates and conveys the envelope E in the positive Z-direction farther, the third enclosing guide pawl 53 is inserted deep into the envelope E. When the envelope E reaches the enclosing position, the first vertical conveyance roller pair 122 interrupts rotation, interrupting conveyance of the envelope E.

When conveyance of the envelope E is interrupted, the third enclosing guide pawl 53 enters the inside of the envelope E. The flap ef is conveyed through the flap conveyance path 1613 defined by the flap guide plate 161 to the holding position where the flap holding roller pair 1611 holds the flap ef. The body eb of the envelope E is conveyed through the envelope conveyance path 1105 in the envelope conveyance direction DE different from the flap conveyance direction DF in which the flap ef is conveyed through the flap conveyance path 1613. As a result, the mouth Ip of the envelope E widens along an outer slope of the third enclosing guide pawl 53 to the outside of the envelope conveyance path 1105.

After the envelope E reaches a position illustrated in FIG. 41, as described above in the first embodiment, while the envelope E moves from a position illustrated in FIG. 19 to a position illustrated in FIG. 22, the enclosing support 160*b* retains the envelope E such that the flap ef opens.

Figure 42:
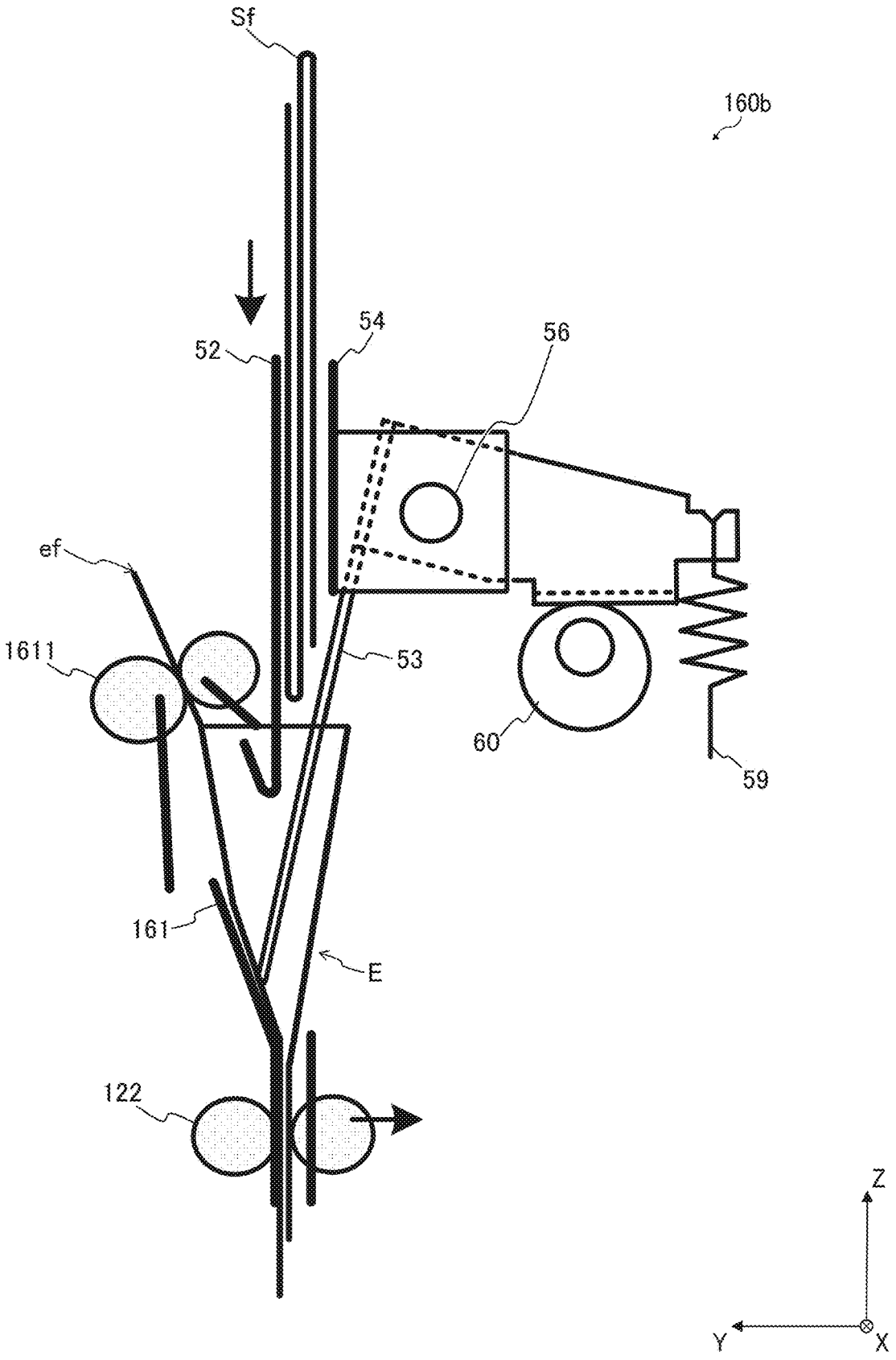
FIG. 42 is a diagram of the enclosing support according to the third embodiment depicted in FIG. 33, illustrating yet another motion thereof.

As illustrated in FIG. 42, the folded sheet Sf serving as the enclosure conveyed from the enclosing conveyance path 1104 toward the envelope E in the enclosing standby state moves through a gap between the enclosing guide pawl opposed guide plate 52 and the enclosing guide pawl securing guide plate 54. Accordingly, the third enclosing guide pawl 53 guides the folded sheet Sf along an inner slope of the third enclosing guide pawl 53 to the inside of the envelope E.

One of two opposed rollers constructing the first vertical conveyance roller pair 122 separates from another roller to create a gap between the two rollers and retracts to the position where the roller does not disturb insertion of the folded sheet Sf into the envelope E. Even if the first vertical conveyance roller pair 122 does not sandwich the envelope E to allow the folded sheet Sf to enter the envelope E, the flap holding roller pair 1611 sandwiches the flap ef. Hence, the flap holding roller pair 1611 continues holding the envelope E at the enclosing position.

Figure 43:
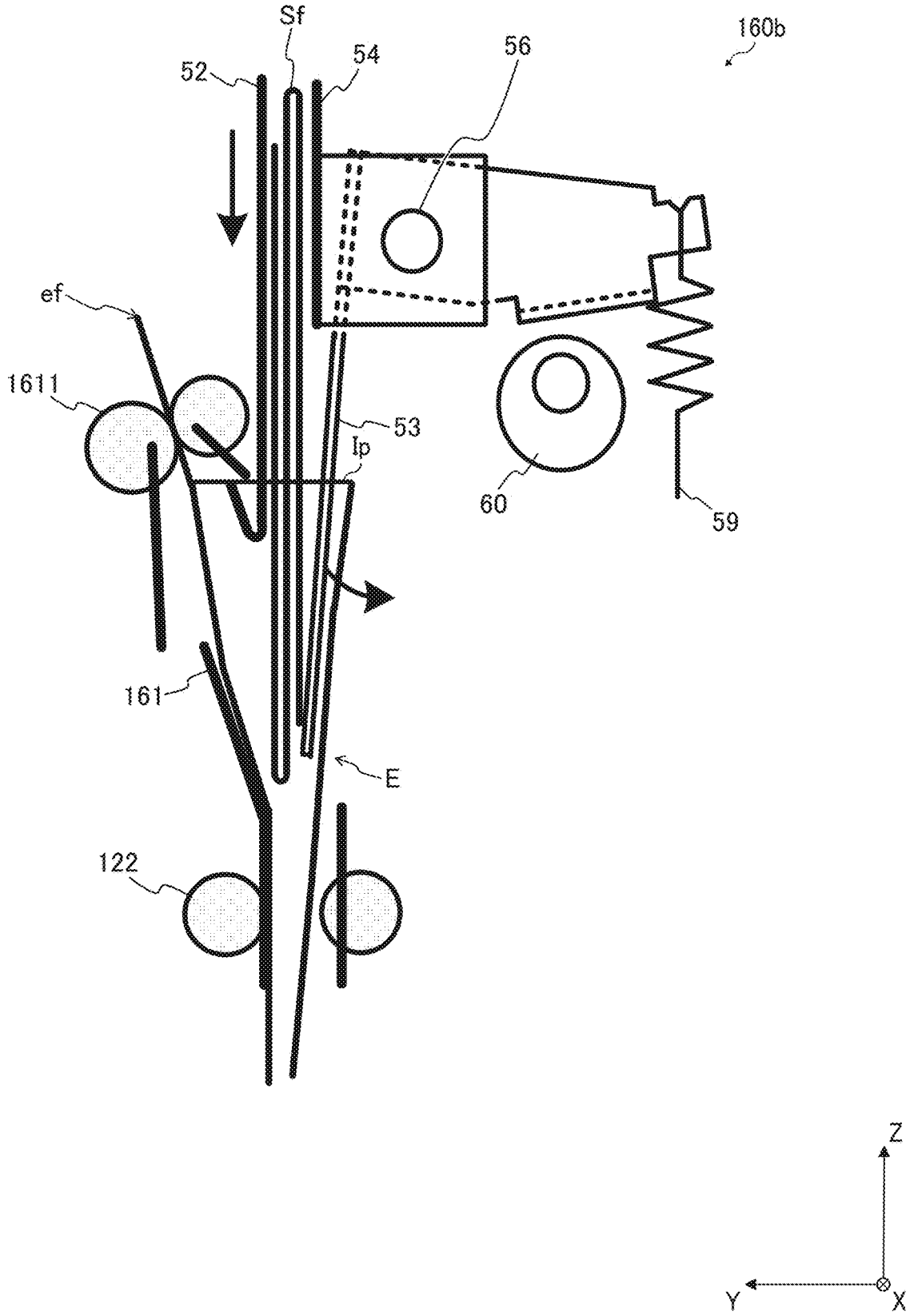
FIG. 43 is a diagram of the enclosing support according to the third embodiment depicted in FIG. 33, illustrating yet another motion thereof.

Subsequently, as illustrated in FIG. 43, as the folded sheet Sf is conveyed into the envelope E, the folded sheet Sf presses the third enclosing guide pawl 53 to pivot about the enclosing guide pawl shaft 56 and move from a conveyance route of the folded sheet Sf. Accordingly, the folded sheet Sf is conveyed into the envelope E through the mouth Ip of the envelope E sequentially.

The third enclosing guide pawl spring 59 biases the third enclosing guide pawl 53 against the flap guide plate 161. The folded sheet Sf is conveyed against a biasing force from the third enclosing guide pawl spring 59. Thereafter, a separate member conveys the folded sheet Sf deep into the envelope E, enclosing the folded sheet Sf in the envelope E.

Figure 44:
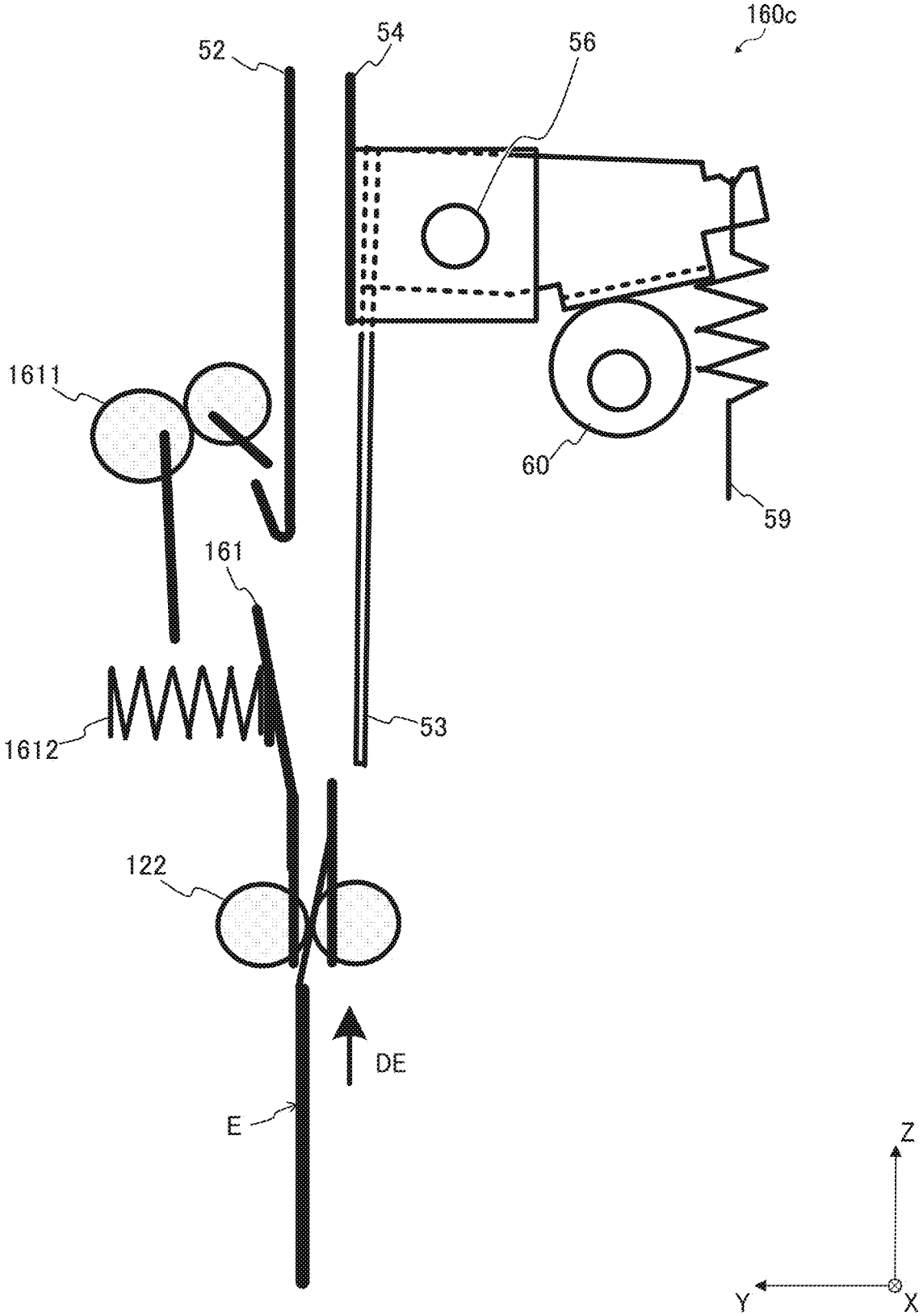
FIG. 44 is a diagram of an enclosing support according to a fourth embodiment of the present disclosure, that is installable in the enclosing-sealing apparatus depicted in FIG. 3, illustrating a motion of the enclosing support.
Figure 45:
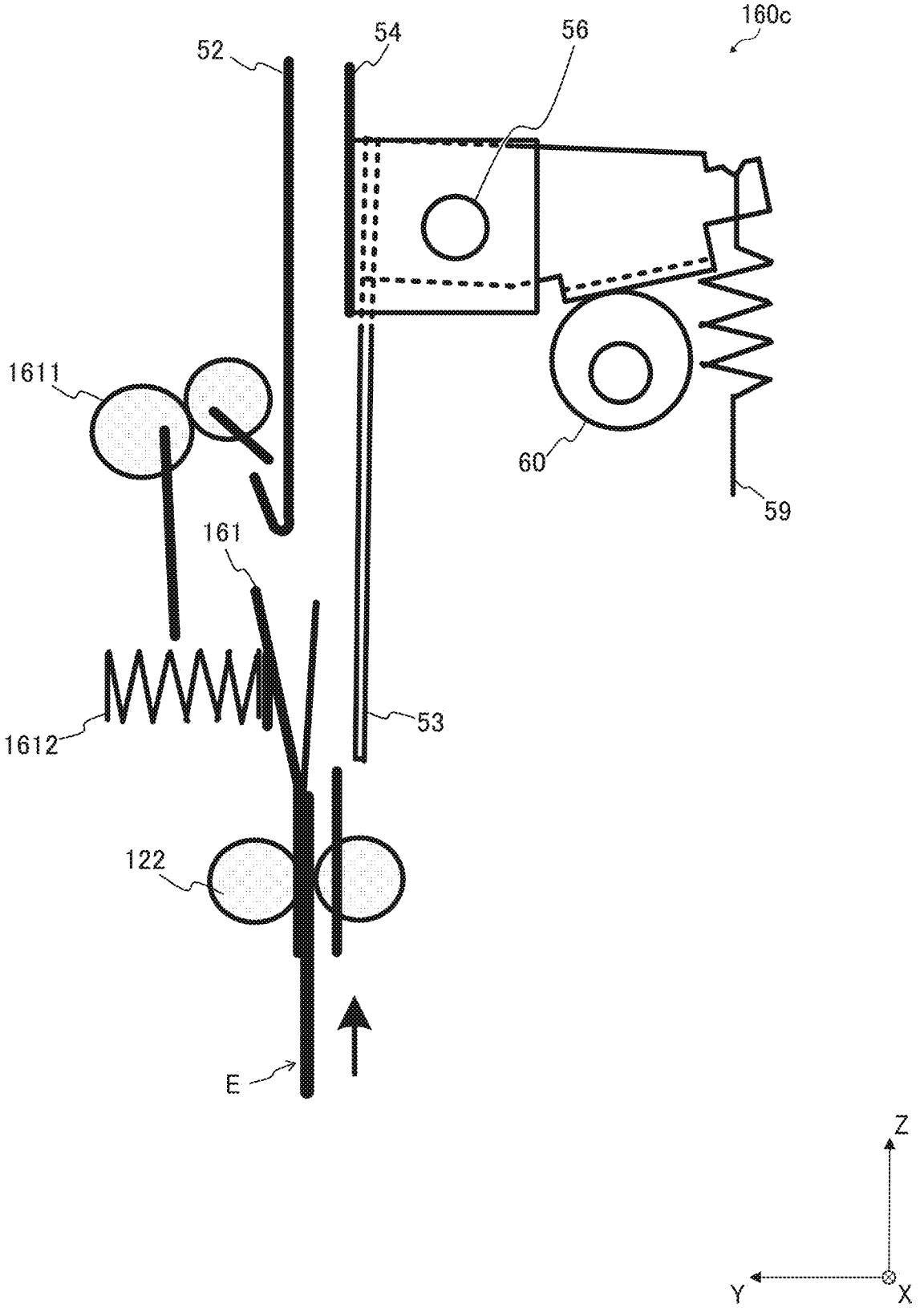
FIG. 45 is a diagram of the enclosing support according to the fourth embodiment depicted in FIG. 44, illustrating another motion thereof.
Figure 46:
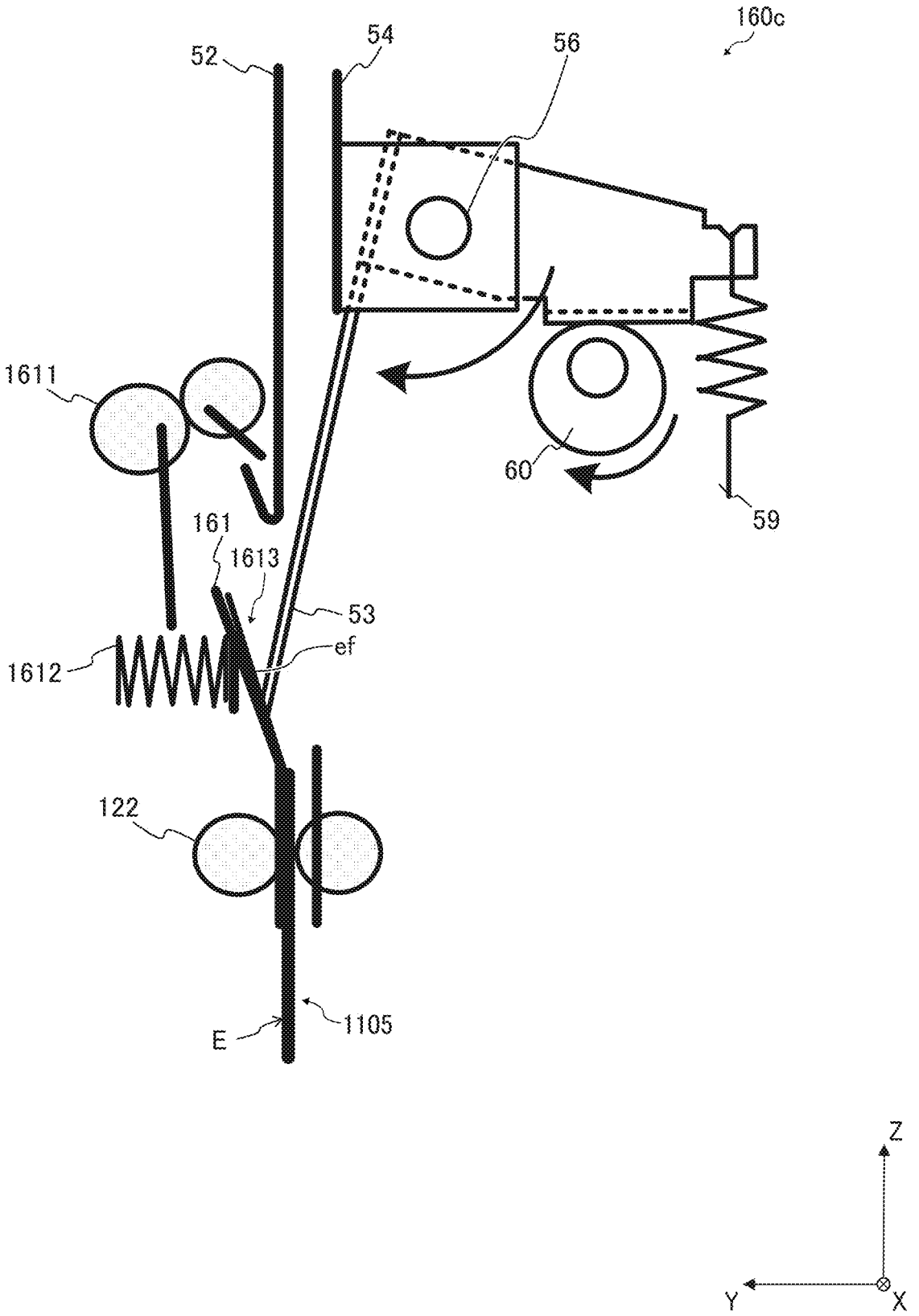
FIG. 46 is a diagram of the enclosing support according to the fourth embodiment depicted in FIG. 44, illustrating yet another motion thereof.

Referring to FIGS. 44 to 46, a description is provided of a construction of an enclosing support 160*c* according to another embodiment, that is, a fourth embodiment, of the present disclosure.

In addition to the elements of the enclosing support 160*b* according to the third embodiment, the enclosing support 160*c* according to the fourth embodiment includes the guide plate spring 1612 serving as the second biasing member that biases the flap guide plate 161 to press against the third enclosing guide pawl 53.

In the enclosing support 160*c*, biasing forces applied in opposed directions, respectively, that is, the biasing force from the guide plate spring 1612 and the biasing force from the third enclosing guide pawl spring 59, cause the flap guide plate 161 and the third enclosing guide pawl 53 to sandwich the flap ef as illustrated in FIG. 46. Accordingly, the enclosing support 160*c* conveys the flap ef precisely through the flap conveyance path 1613 that is branched from the envelope conveyance path 1105 and guides the flap ef to the flap holding roller pair 1611 so as to enclose the enclosure into the envelope E.

The technology of the present disclosure is not limited to the embodiments described above. The embodiments of the present disclosure may be modified variously within the scope of the present disclosure. The technology of the present disclosure includes technical matters encompassed by a technological concept within the scope of the present disclosure. Although the embodiments described above disclose preferable examples, the embodiments may be modified into modification examples by those skilled in the art based on the present disclosure. The modification examples are also encompassed by the technological concept within the scope of the present disclosure.

A description is provided of advantages of an enclosing apparatus (e.g., the enclosing-sealing apparatus 100).

As illustrated in FIGS. 3, 5, 30, 33, and 44, the enclosing apparatus encloses an enclosure (e.g., the sheet S or the folded sheet Sf) into an envelope (e.g., the envelope E) conveyed to an enclosing position. The enclosing apparatus includes a conveyance roller (e.g., the enclosing roller pair 121 and the first vertical conveyance roller pair 122), an envelope conveyance path (e.g., the envelope conveyance path 1105), and an enclosing support (e.g., the enclosing supports 160, 160*a*, 160*b*, and 160*c*). The conveyance roller conveys the envelope to the enclosing position through the envelope conveyance path. The enclosing support is disposed in the envelope conveyance path and supports enclosing of the enclosure into the envelope. The enclosing support retracts a flap (e.g., the flap ef) of the envelope from the envelope conveyance path while the conveyance roller conveys the envelope to the enclosing position.

Accordingly, the enclosing apparatus conveys the envelope to the enclosing position while the enclosing support retracts the flap of the envelope when the enclosure is inserted into the envelope, thus supporting smooth enclosing of the enclosure into the envelope.

The image forming apparatus 200 may be a copier, a printer, a facsimile machine, a multifunction peripheral (MFP) having at least two of copying, printing, scanning, facsimile, and plotter functions, an inkjet recording apparatus, or the like.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. An enclosing apparatus for enclosing an enclosure into an envelope at an enclosing position, the enclosing apparatus comprising:

a conveyance roller configured to convey the envelope to the enclosing position;

an envelope conveyance path through which the envelope is conveyed; and an enclosing support disposed in the envelope conveyance path and configured to support enclosing of the enclosure into the envelope, the enclosing support configured to retract a flap of the envelope from the envelope conveyance path while the conveyance roller conveys the envelope to the enclosing position, wherein the enclosing support includes a flap conveyance path branching from the envelope conveyance path, a flap guide defining the flap conveyance path, and a flap conveyance direction switching pawl configured to orient the flap toward the flap conveyance path and press the flap against the flap guide when the flap reaches a predetermined position before the envelope reaches the enclosing position, wherein the enclosing support further includes a first biasing member configured to bias the flap conveyance direction switching pawl to press against the flap guide, and wherein the enclosing support further includes a switching biasing pawl configured to block the envelope conveyance path at a default position, and a second biasing member configured to bias the switching biasing pawl at the default position.

2. The enclosing apparatus according to claim 1, wherein the enclosing support further includes an enclosing guide defining a part of the envelope conveyance path, and wherein the enclosing guide is configured to guide the enclosure to the enclosing position together with the flap conveyance direction switching pawl.

3. The enclosing apparatus according to claim 1, wherein the switching biasing pawl is configured to move from the default position against a biasing force from the second biasing member when the enclosure conveyed to the enclosing position presses the switching biasing pawl.

4. The enclosing apparatus according to claim 1, wherein the enclosing support further includes another second biasing member configured to bias the flap guide to press against the flap conveyance direction switching pawl.

5. The enclosing apparatus according to claim 4, wherein each of the first biasing member, the second biasing member, and said another second biasing member includes a spring.

6. The enclosing apparatus according to claim 1, wherein the enclosing support further includes an enclosing guide stay configured to mount the flap conveyance direction switching pawl and pivotally hold the switching biasing pawl, and wherein the first biasing member and the second biasing member are anchored to the enclosing guide stay.

7. The enclosing apparatus according to claim 1, wherein the enclosing support further includes a taper oriented upstream in an envelope conveyance direction in which the conveyance roller conveys the envelope to the enclosing position.

8. The enclosing apparatus according to claim 7, wherein the taper is configured to widen a mouth of the envelope when the flap of the envelope retracts from the envelope conveyance path and a body of the envelope reaches the enclosing position.

9. The enclosing apparatus according to claim 7, wherein the flap conveyance direction switching pawl and the switching biasing pawl define the taper.

10. The enclosing apparatus according to claim 1, wherein the flap guide is configured to guide the flap, and wherein the flap conveyance direction switching pawl includes a front end configured to press against the flap guide, the front end being round in a thickness direction of the flap conveyance direction switching pawl.

11. An image forming system comprising:

an image forming apparatus configured to form an image on a medium; and the enclosing apparatus according to claim 1.

12. An enclosing apparatus for enclosing an enclosure into an envelope at an enclosing position, the enclosing apparatus comprising:

a conveyance roller configured to convey the envelope to the enclosing position;

an envelope conveyance path through which the envelope is conveyed; and an enclosing support disposed in the envelope conveyance path and configured to support enclosing of the enclosure into the envelope, the enclosing support configured to retract a flap of the envelope from the envelope conveyance path while the conveyance roller conveys the envelope to the enclosing position, wherein the enclosing support includes a flap conveyance path branching from the envelope conveyance path, a flap guide defining the flap conveyance path, and a flap conveyance direction switching pawl configured to orient the flap toward the flap conveyance path and press the flap against the flap guide when the flap reaches a predetermined position before the envelope reaches the enclosing position, wherein the enclosing support further includes a first biasing member configured to bias the flap conveyance direction switching pawl to press against the flap guide, wherein the enclosing support further includes an enclosing guide defining a part of the envelope conveyance path, wherein the enclosing guide is configured to guide the enclosure to the enclosing position together with the flap conveyance direction switching pawl, and wherein the enclosing support further includes a second biasing member configured to bias the flap guide to press against the flap conveyance direction switching pawl.

13. The enclosing apparatus according to claim 12, wherein the flap guide is configured to guide the flap, and wherein the flap conveyance direction switching pawl includes a front end configured to press against the flap guide, the front end being round in a thickness direction of the flap conveyance direction switching pawl.

14. An image forming system comprising:

an image forming apparatus configured to form an image on a medium; and the enclosing apparatus according to claim 12.

* * * * *